US011821593B1

(12) United States Patent
Weatherman

(10) Patent No.: US 11,821,593 B1
(45) Date of Patent: Nov. 21, 2023

(54) PRACTICAL LIGHTING APPARATUS AND METHOD FOR USE

(71) Applicant: Kenneth Casey Weatherman, Roswell, GA (US)

(72) Inventor: Kenneth Casey Weatherman, Roswell, GA (US)

( * ) Notice: Subject to any disclaimer, the term of this patent is extended or adjusted under 35 U.S.C. 154(b) by 0 days.

(21) Appl. No.: 18/098,763

(22) Filed: Jan. 19, 2023

Related U.S. Application Data

(60) Provisional application No. 63/312,165, filed on Feb. 21, 2022.

(51) Int. Cl.

| | |
|---|---|
| ***F21K 9/275*** | (2016.01) |
| ***F21V 21/096*** | (2006.01) |
| ***F21K 9/272*** | (2016.01) |
| ***F21Y 103/10*** | (2016.01) |
| ***F21W 131/406*** | (2006.01) |
| ***F21Y 115/10*** | (2016.01) |

(52) U.S. Cl.
CPC ..... *F21K 9/275* (2016.08); *F21K 9/272* (2016.08); *F21V 21/096* (2013.01); *F21W 2131/406* (2013.01); *F21Y 2103/10* (2016.08); *F21Y 2115/10* (2016.08)

(58) Field of Classification Search
CPC ..... F21K 9/272; F21K 9/275; F21V 21/096
See application file for complete search history.

(56) References Cited

U.S. PATENT DOCUMENTS

| | | | | |
|---|---|---|---|---|
| 7,507,001 | B2 | 3/2009 | Kit | |
| 9,295,117 | B2 | 3/2016 | Acatrini | |
| 9,488,351 | B1 * | 11/2016 | Szeto | F21V 19/0055 |
| 10,890,311 | B2 | 1/2021 | Barnetson | |
| 2014/0126199 | A1 * | 5/2014 | Heeter | F21V 21/096 362/396 |
| 2015/0077983 | A1 * | 3/2015 | Pan | F21V 29/763 362/218 |
| 2016/0305641 | A1 * | 10/2016 | Lin | F21V 19/0045 |
| 2018/0058638 | A1 * | 3/2018 | Deng | F21S 8/026 |

OTHER PUBLICATIONS

Rainbow tube by Quasar Science—accessed and printed as screenshot May 9, 2023—https://www.quasarscience.com/collections/lights/products/rainbow-2-ex-demo.

(Continued)

*Primary Examiner* — William N Harris
(74) *Attorney, Agent, or Firm* — GRONHOLM PATENT SERVICES

(57) ABSTRACT

Practical lighting is the technique of using light sources that are seen within the frame of a shot. Apparatus 10 and 10A is a lightweight, magnetically mounted, light diffusing housing for LED ribbon which is designed to look like a standard fluorescent tube when used as practical lighting. Control wires can be easily and repeatedly removed via screwed terminal housings (10) or connected via industry standard phoenix receptacle (10A) housed discreetly one of its two end caps, providing a solderless connection with either apparatus. The magnets internally installed adhere the apparatus to standard metal fluorescent housings without damage to the installed fixture negating the need of additional mounting rigging hardware.

20 Claims, 41 Drawing Sheets

Exploded view of Apparatus 10

(56) References Cited

OTHER PUBLICATIONS

Q-Ion by Quasar Science—accessed and printed as screenshot May 9, 2023—https://www.quasarscience.com/collections/lights/products/q-lion-us-charger.
FreeStyle by Kino Flo—accessed and printed as screenshot May 9, 2023—https://kinoflo.com/freestyle-t41-t21-led/.
Color Corrected Fluorescent tubes by Kino Flo—accessed and printed as screenshot May 9, 2023—https://www.filmandvideolighting.com/4fttubesbulbs.html.
The Ultimate LED Tube by Astera—Titan Tube—Downloaded May 9, 2023 From https://astera-led.com/products/titan/—Titan Tube is the ultimate LED tube for filmmakers, studios, event technician and any creative person. It emits powerful, tunable whites with ultra-high color rendering as well as colored light which can be applied to individual pixels or the whole tube. The tube offers unlimited range of usage; indoor or outdoor, AC-powered or on battery, on the go with the AsteraApp, with wired or wireless DMX.

* cited by examiner

Exploded view of Apparatus 10

End B of Apparatus 10

End B of Apparatus 10

End A of Apparatus 10

Terminal block

Apparatus 10A Exploded View

Apparatus 10A

Apparatus 10A,
Female Phoenix Connector(200)

Apparatus 10A Opened

End Cap A 10, Tube Screw 30
Aluminum Rail Channel 70

End Cap B 130,
Tube Screw 30, Rail Screws 35

End Cap A 10 Exploded View

End Cap B 130 Exploded View

Receiving Slot 60 Detail
Retention Block Slide Lock 50

Contact Pin Housing 210
Installed in End Cap B 130

Aluminum Rail 70
Magnet 90 and LED 100

Aluminum Rail 70
End Cap B 130 and LED 100

Aluminum Rail 70
Tube Housing 40 and LED 100

Angle of Light Emission from Tube Housing 40 and LED 100

Tube Housing 40,
End Cap A 10 Connection

Tube Housing 40,
End Cap B 130 Connection

End Cap A 10, Dimensions

End Cap B 130, Dimensions

Tube Screw Retention
Block 50 Dimensions

Contact Pin Retention
Housing 210 Dimensions

Tube Housing 40
Dimensions

Aluminum Rail 70 and Magnet 90
Dimensions

Contact Pins 220 and Rail 221
Dimensions

Phoenix Connector 200
Dimensions

Screws, Inserts and Bolt Dimensions

PRACTICAL LIGHTING APPARATUS AND METHOD FOR USE

FIELD

This disclosure relates generally to lighting in video production environments, particularly lighting which may be in view of the video camera during filming (aka on camera "practical lighting", or "practicals").

SUMMARY

The present application is directed towards a system, method, and apparatus for the use in film practical lighting. Providing a lightweight, light diffusing housing for LED ribbon, designed to look like a standard fluorescent tube, which mounts into metal fixtures primarily via magnetic force without the aid of additional rigging hardware.

An aspect of the present invention includes a film lighting apparatus simulating the appearance of a fluorescent tube and configured to be attached relative to an overhead member having a downwardly facing flat horizontal surface being attracted to a magnet, said lighting apparatus configured for selective electrical power connection with an external electrical power supply, said lighting apparatus itself comprising: A) an elongate generally tubular housing, said housing defining an elongate internal cavity and at least one end opening, and having an elongate tubular housing portion being comprised of a surrounding wall surrounding said elongate internal cavity, said surrounding wall having a substantially consistent wall thickness; B) an elongate internal rail configured to detachably fit within said elongate internal cavity of said tubular housing, said internal rail including an upwardly facing portion and an opposing, downwardly facing portion; C) at least one light source configured to be attached relative to said downwardly facing portion of said internal rail; D) at least one magnet including an upwardly facing portion and an opposing, downwardly facing portion, said downwardly facing portion of said magnet configured to be attached relative to said upwardly facing portion of said internal rail; E) at least one detachable end cap configured to fit within said end opening of said tubular housing, said end cap including internally and externally facing terminal connection ports, said externally facing ports configured for selective electrical connection with said external electrical power supply; and F) an internal wiring assembly configured to fit within said elongate internal cavity of said tubular housing, said wiring assembly providing electrical connection between said internally facing terminal connection ports of said detachable end cap and said light source, such that an electrical connection is provided between said external power supply and said light source, such that said magnet attracts said overhead member sufficient to cause said film lighting apparatus to be detachably fixed relative to said overhead member.

Another aspect of the present invention includes a film light apparatus as noted above, wherein said magnet is a first magnet, and further comprising a second magnet attached relative to said upwardly facing portion of said internal rail, such that said first and second magnets provide the primary means of connecting said film lighting apparatus to said overhead member.

Another aspect of the present invention includes a film light apparatus as noted above, wherein said externally facing terminal connection ports in said end cap are provided at least in part by a Phoenix connector.

Another aspect of the present invention includes a film light apparatus as noted above, wherein said internal rail is metal, and provides a heat sink for heat generated by said light source.

Another aspect of the present invention includes a film light apparatus as noted above, wherein said detachable end cap is a first detachable end cap, wherein said end opening is a first end opening, and further comprising a second detachable end cap configured to fit within a second end opening of said tubular housing, said second end opening facing opposite to said first end opening.

Another aspect of the present invention includes a film light apparatus as noted above, wherein said internal rail has elongate opposing long sides which fit within corresponding cofacing channels defined by said tubular housing, such that a sliding and guiding action is provided by said cofacing channels to said opposing long sides, such that said internal rail may slide in and out of place during installation and removal, respectively, while being guided by said cofacing channels.

Another aspect of the present invention includes a film light apparatus as noted above, wherein said tubular housing is comprised of a generally tubular plastic having translucent properties through its walls to provide a diffusion of light from said light source when passing therethrough.

Another aspect of the present invention includes a film light apparatus as noted above, wherein said light source is an LED ribbon.

Another aspect of the present invention includes a film light apparatus as noted above, wherein said lower surface of said rail is above the height midpoint of said tubular housing, and above the central circumferential axis, and wherein said tubular housing is translucent, thus allowing for light emitted from said LED ribbon attached to said rail to pass through said translucent housing to illuminate approximately 240 degrees of said housing's circumference.

An aspect of the present invention includes a film lighting apparatus simulating the appearance of a fluorescent tube and configured to be attached relative to an overhead member having a downwardly facing flat horizontal surface being attracted to a magnet, said lighting apparatus configured for selective electrical power connection with an external electrical power supply, said lighting apparatus itself comprising: A) an elongate generally tubular housing, said housing defining an elongate internal cavity and at least one end opening, and having a surrounding wall surrounding said elongate internal cavity, said surrounding wall having a substantially consistent wall thickness, said surrounding wall defining a cylindrical shape with the exception of a flat wall section in its otherwise tubular cylindrical wall shape, said flat section having parallel outer and inner wall surfaces, each of said flat section outer and inner wall surfaces lying in a plane being generally parallel to each other and with said longitudinal axis of said elongate generally tubular housing; B) an elongate internal rail configured to detachably fit within said elongate internal cavity of said tubular housing, said internal rail including an upwardly facing portion and an opposing, downwardly facing portion; C) at least one light source configured to be attached relative to said downwardly facing portion of said internal rail; D) at least one magnet including an upwardly facing portion and an opposing, downwardly facing portion, said downwardly facing portion of said magnet configured to be attached relative to said upwardly facing portion of said internal rail such that said upwardly facing portion of said magnet is in substantial contact with said underside surface of said flat wall section of said tubular housing; E) at least one detachable end cap configured to fit within said end opening of said tubular housing, said end cap including internally and externally facing terminal connection ports, said externally facing ports configured for selective electrical connection with said external electrical power supply; and F) an internal wiring assembly configured to fit within said elongate internal cavity of said tubular housing, said wiring assembly providing electrical connection between said internally facing terminal connection ports of said detachable end cap and said light source, such that electrical connection is provided between said external power supply and said light source, such that said magnet attracts said overhead member sufficient to cause said film lighting apparatus to be detachably fixed relative to said overhead member with said magnet urging said flat section of said tubular housing into planar contact with and against said downwardly facing flat horizontal surface of said overhead member.

Another aspect of the present invention includes a film light apparatus as noted above, wherein said magnet is a first magnet, and further comprising a second magnet attached relative to said upwardly facing portion of said internal rail, such that said first and second magnets provide the primary means of connecting said film lighting apparatus to said overhead member.

Another aspect of the present invention includes a film light apparatus as noted above, wherein said externally facing terminal connection ports in said end cap are provided at least in part by a Phoenix connector.

Another aspect of the present invention includes a film light apparatus as noted above, wherein said internal rail is metal, and provides a heat sink for heat generated by said light source.

Another aspect of the present invention includes a film light apparatus as noted above, wherein said detachable end cap is a first detachable end cap, wherein said end opening is a first end opening, and further comprising a second detachable end cap configured to fit within a second end opening of said tubular housing, said second end opening facing opposite to said first end opening.

Another aspect of the present invention includes a film light apparatus as noted above, wherein said internal rail has elongate opposing long sides which fit within corresponding cofacing channels defined by said tubular housing, such that a sliding and guiding action is provided by said cofacing channels to said opposing long sides, such that said internal rail may slide in and out of place during installation and removal, respectively, while being guided by said cofacing channels.

Another aspect of the present invention includes a film light apparatus as noted above, wherein said tubular housing is comprised of a generally tubular plastic having translucent properties through its walls to provide a diffusion of light from said light source when passing therethrough.

Another aspect of the present invention includes a film light apparatus as noted above, wherein said light source is an LED ribbon.

Another aspect of the present invention includes a film light apparatus as noted above, wherein said lower surface of said rail is above the height midpoint of said tubular housing, and above the central circumferential axis, and wherein said tubular housing is translucent, thus allowing for light emitted from said LED ribbon attached to said rail to pass through said translucent housing to illuminate approximately 240 degrees of said housing's circumference.

An aspect of the present invention includes a method of replacing a light source in a film lighting apparatus simulating the appearance of a fluorescent tube and configured to be attached relative to an overhead member having a downwardly facing flat horizontal surface being attracted to a magnet, said apparatus configured for selective electrical power connection with an external electrical power supply, said method including the following steps: A) providing a lighting apparatus itself comprising: 1) an elongate generally tubular housing, said housing defining an elongate internal cavity and at least one end opening, and having a tubular housing portion being comprised of a surrounding wall surrounding said elongate internal cavity, said surrounding wall having a substantially consistent wall thickness; 2) an elongate internal rail configured to detachably fit within said elongate internal cavity of said tubular housing, said internal rail including an upwardly facing portion and an opposing, downwardly facing portion; 3) at least one first light source configured to be attached relative to said downwardly facing portion of said internal rail; 4) at least one magnet including an upwardly facing portion and an opposing, downwardly facing portion, said downwardly facing portion of said magnet configured to be attached relative to said upwardly facing portion of said internal rail; 5) at least one detachable end cap configured to fit within said end opening of said tubular housing, said end cap including internally and externally facing terminal connection ports, said externally facing ports configured for selective electrical connection with said external electrical power supply; and 6) an internal wiring assembly configured to fit within said elongate internal cavity of said tubular housing, said wiring assembly providing electrical connection between said internally facing terminal connection ports of said detachable end cap and said light source, such that electrical connection is provided between said external power supply and said light source, such that said magnet attracts said overhead member sufficient to cause said film lighting apparatus to be detachably fixed relative to said overhead member; and B) replacing said first light source by performing the following sub-steps: 1) detaching said selective electrical connection between said externally facing ports of said end cap and said external electrical power supply; 2) removing said end cap from said elongate generally tubular housing; 3) removing said elongate internal rail by sliding it out of place from within said elongate internal cavity of said tubular housing; 4) detaching said first light source from said downwardly facing portion of said internal rail; 5) attaching a second light source to said downwardly facing portion of said internal rail; 6) replacing said elongate internal rail by sliding it into place from within said elongate internal cavity of said tubular housing; 7) replacing said end cap on said elongate generally tubular housing; and 8) reattaching said selective electrical connection between said externally facing ports of said end cap and said external electrical power supply.

Another aspect of the present invention includes a method as noted above, wherein said light source is an LED ribbon.

BRIEF DESCRIPTION OF THE DRAWINGS

The figures presented correspond to two variations of an apparatus contained within. Apparatus 10 and apparatus 10A.

Apparatus 10 Figures

Elements listed for apparatus 10 Figures are exclusive to apparatus 10 and found in the Apparatus 10 Elements List located within.

Figure 1:
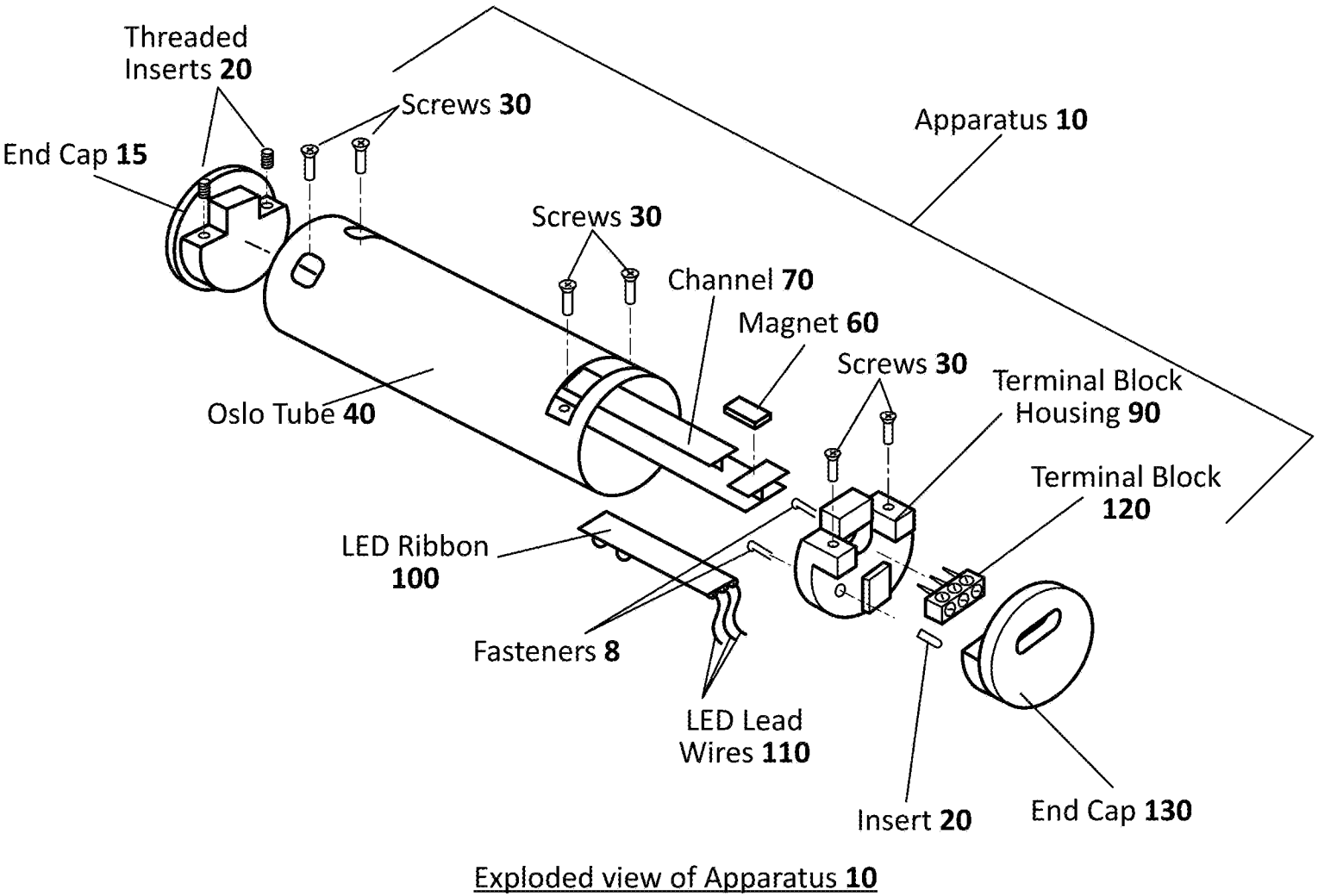
FIG. 1 through FIG. 22 illustrates apparatus 10. Whereas figures

FIG. 1 is an exploded view of apparatus 10, showing its multiple components.

Figure 2:
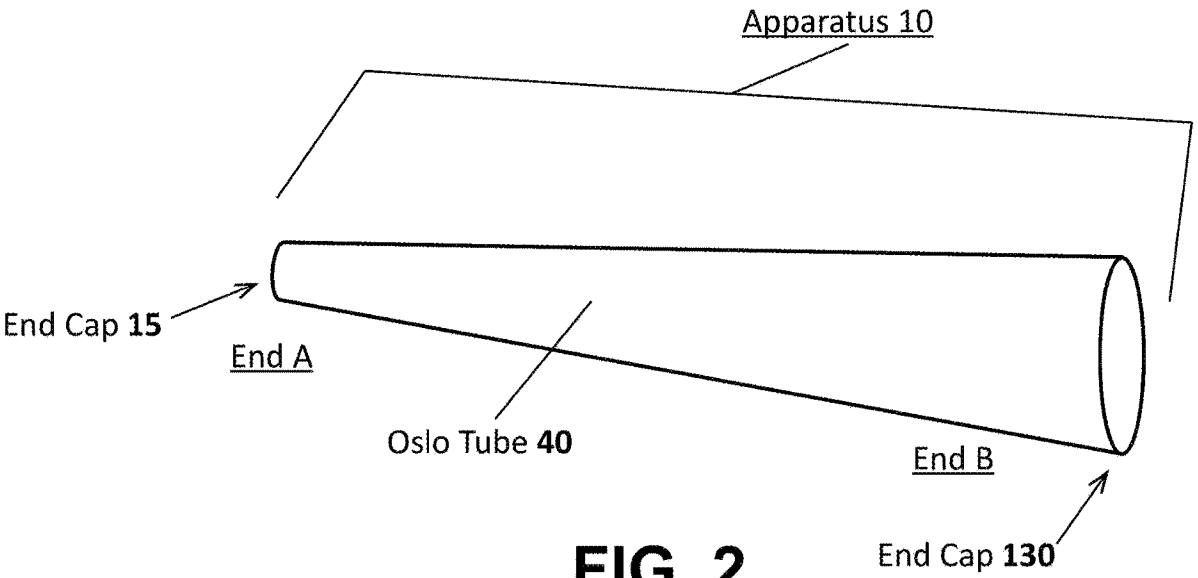

FIG. 2 is a pictorial view of Apparatus 10, showing its two ends A and B. Proximate each of said ends A and B are corresponding end caps 15 and 130. End cap 130 is the cap including wiring shown also in FIG. 3. End cap 15 at end B does not include wiring.

Figure 3:
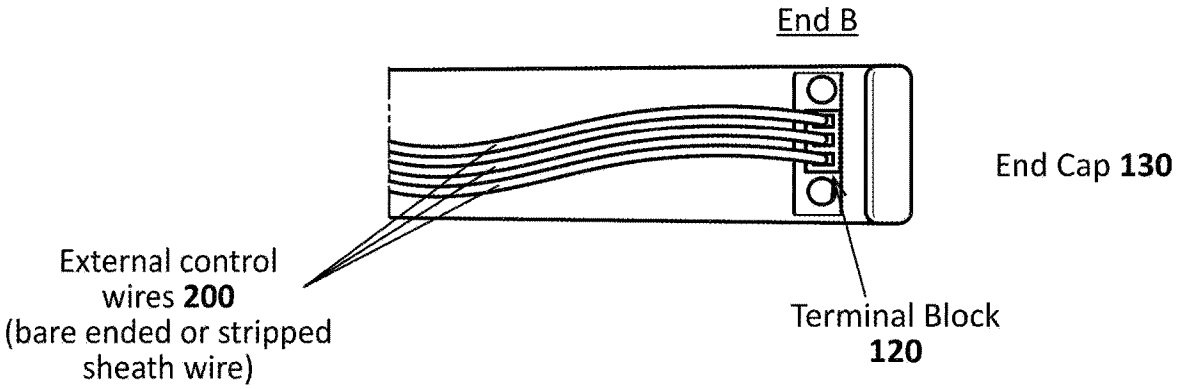

FIG. 3 is a partial view of Apparatus 10, showing the "upper" side of its end B, which shows where the external control wires 200 connect to the apparatus 10 via the terminal block 120.

Figure 4:
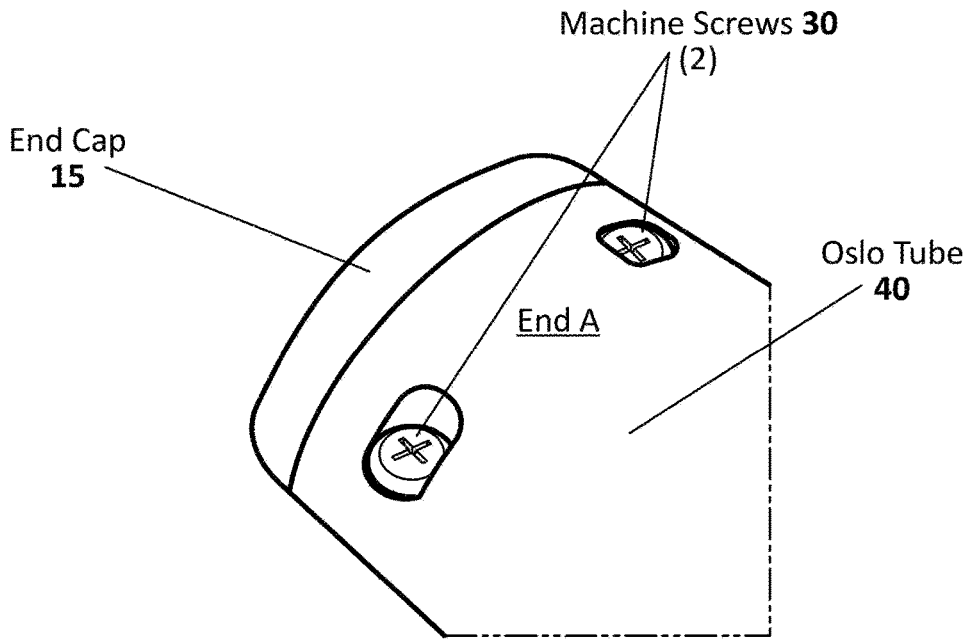

FIG. 4 is a partial view of Apparatus 10, showing the "upper" side of its end A, showing the two screws 30 which attach the end cap to the Oslo tube 40 as well as the end cap 15, as described in further detail below.

Figure 5:
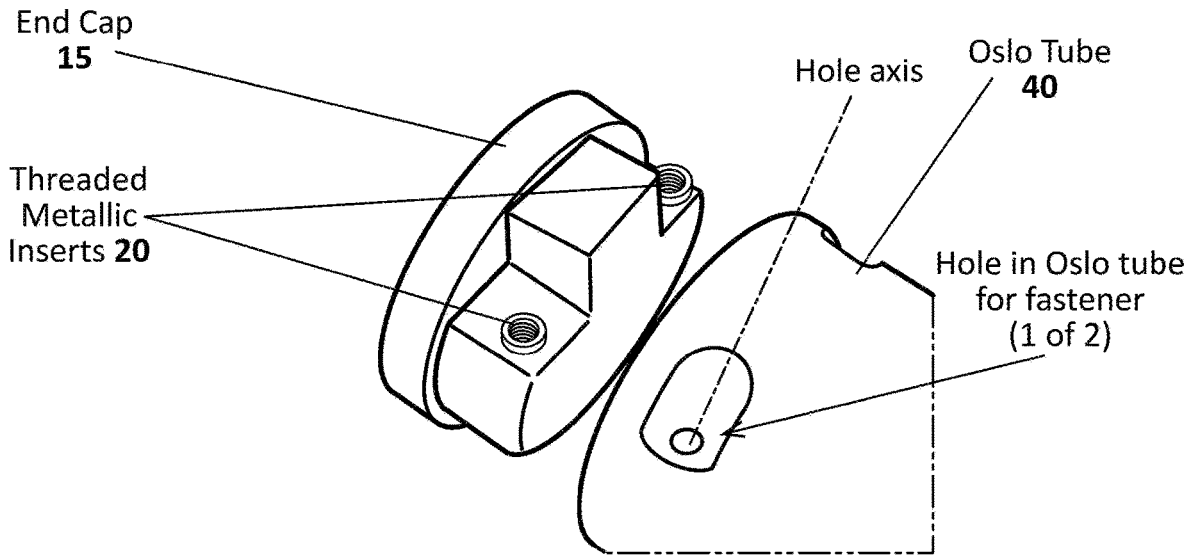

FIG. 5 is a view similar to that of FIG. 4, except that the end cap 15 has been removed from the main assembly 10, by removing the machine screws 30 and pulling out the end cap 15. Shown installed are two threaded inserts 20 which accept the machine screws 30 and are configured to frictionally engage holes drilled in the end cap 15, such that the end cap may be selectively attached in place by the screws 30 (not shown in FIG. 5). The axis of one of the two holes is shown by a dotted line.

Figure 6:
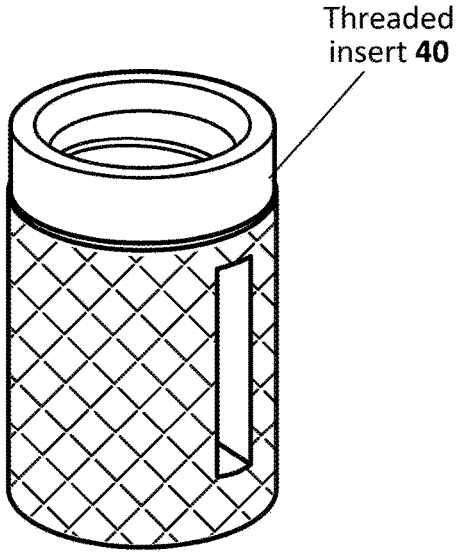

FIG. 6 is an isolated view of a threaded insert 20.

Figure 7A:
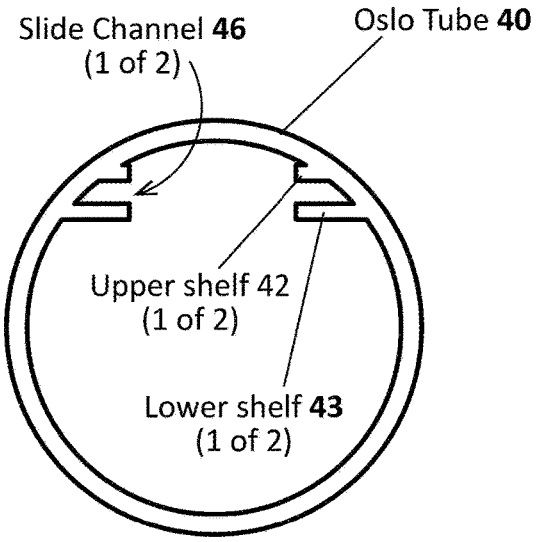
Figure 7B:
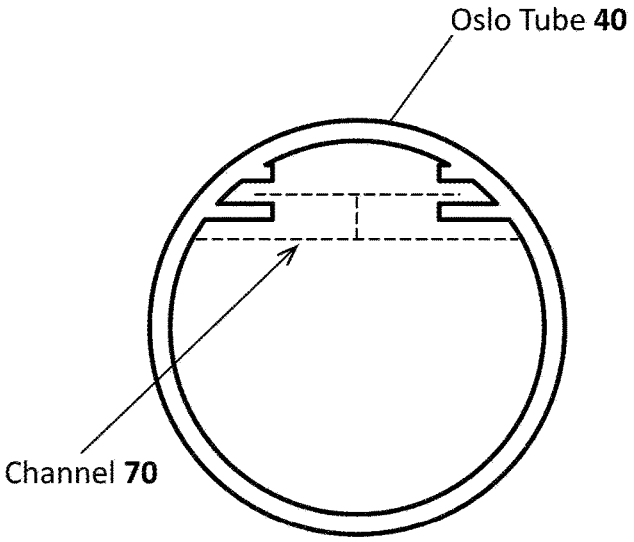

FIGS. 7A and 7B are illustrative transverse cross sections of the Oslo tube 40. FIG. 7A shows the Oslo tube 40 with its interior upper shelves 42 and interior lower shelves 43. Each of these interior shelves runs the length of the tube 40 (with the exception of certain parts cut out along the length as discussed elsewhere). The upper and lower shelves 42, 43 combine to create two elongated slide channels 44, each of which is configured to accept an elongate side edge of the upper face member 72 of the channel 70, as shown in FIG. 7B.

Figure 8:
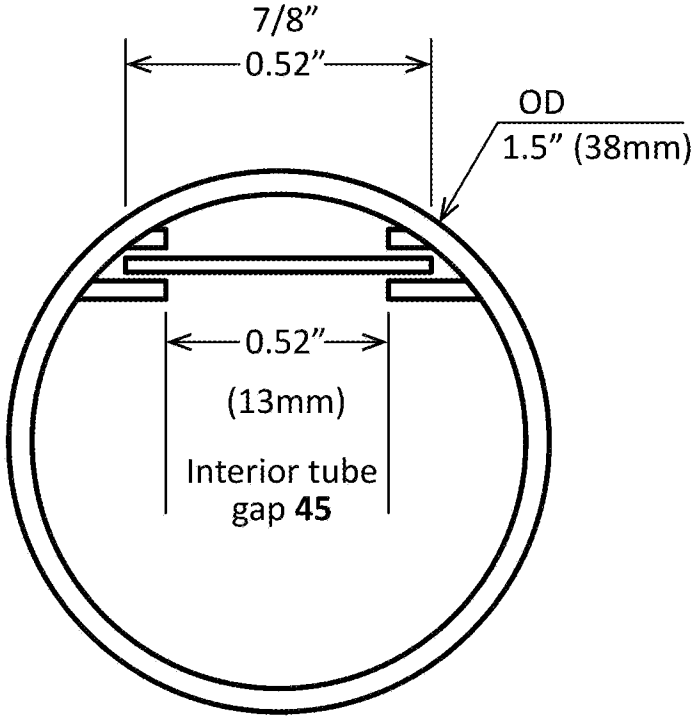

FIG. 8 shows some typical dimensions of the Oslo tube 40, but these should not be limiting. Note that the "interior tube gap 45" which is shown as 13 mm in drawing is the gap into which the upper key 96 of the terminal block housing 90 fits when installed. This same gap 45 is the gap into which the upper key 136 of the terminal block housing 130 fits when installed.

Figure 9:
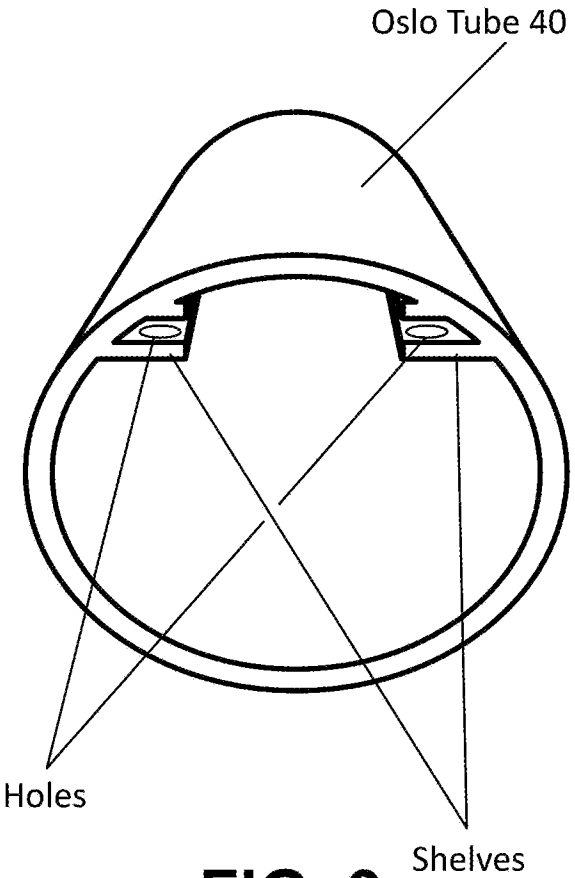

FIG. 9 shows the Oslo tube 40, with holes and shelves as discussed elsewhere.

Figure 10C:
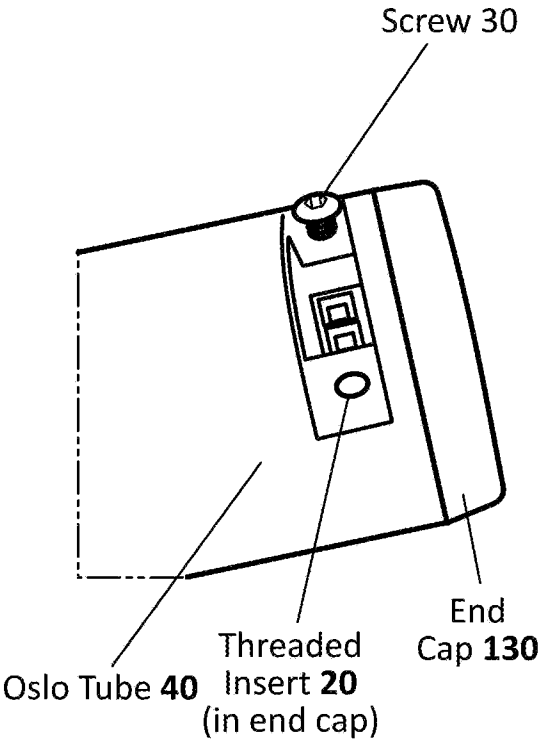
Figure 10B:
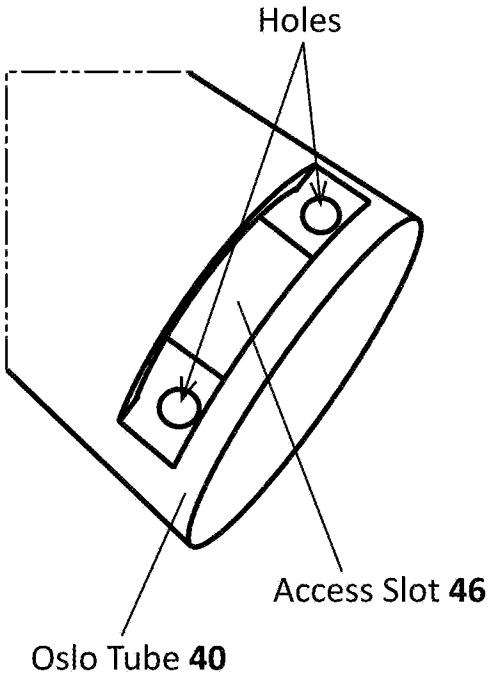
Figure 10A:
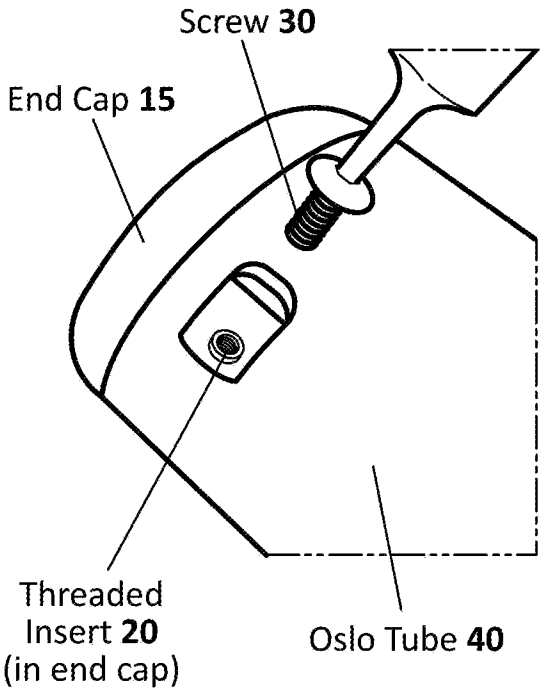

FIGS. 10A-C are various views showing the way end caps are attached. FIG. 10A shows End A of the apparatus 10, showing the end cap 15 in place, with a screw 30 being prepared to be installed into a threaded insert 20 in the end cap 15 securing end cap 15 relative to the Oslo tube 40. FIG. 10B shows End B of the apparatus 10, showing the Oslo tube in isolation, with access slot 46 cut therein to enable the drilling of holes in the lower interior shelf of the Oslo tube 40. FIG. 10C shows End B of the apparatus 10, showing the end cap 130 installed, and showing a screw 30 being installed into a threaded insert 20 (press fit in a hole in the end cap 130). It should be understood that the screw 30 in this configuration may be of a different length than the one in FIG. 10A, depending on the application).

Figure 11:
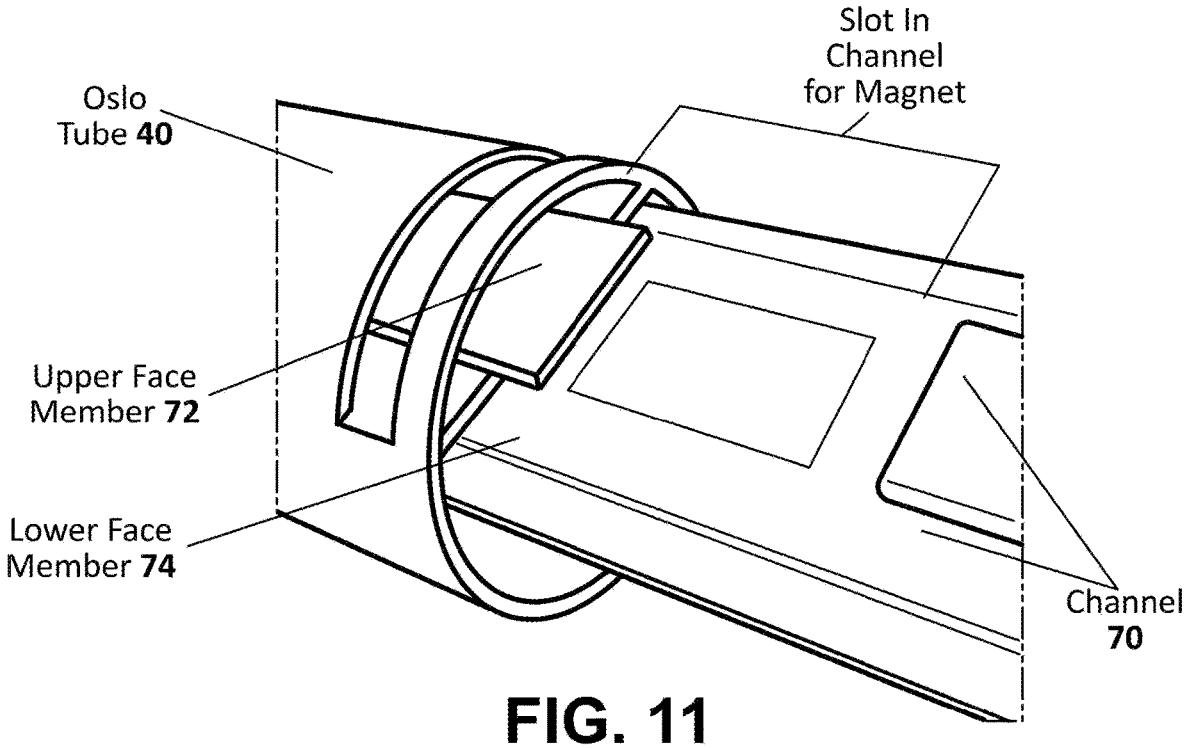

FIG. 11 is a view showing an Oslo tube 40 having channel 70 installed in its interior. This figure also shows the upper small face member 72 and the lower larger face member 72. Also shown here is a transverse slot which has been cut into channel 70, such that a magnet 60 can be installed into the slot in the channel.

Figure 12:
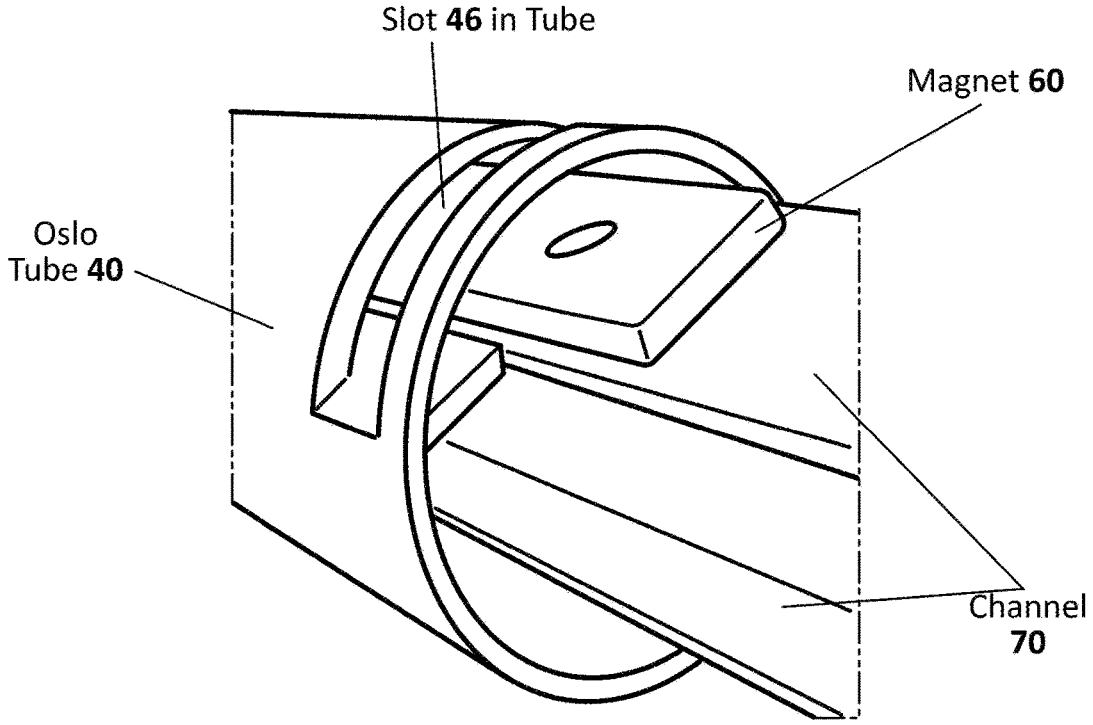

FIG. 12 is a view similar to that of FIG. 11, except that a magnet 60 has been installed therein.

Figure 13:
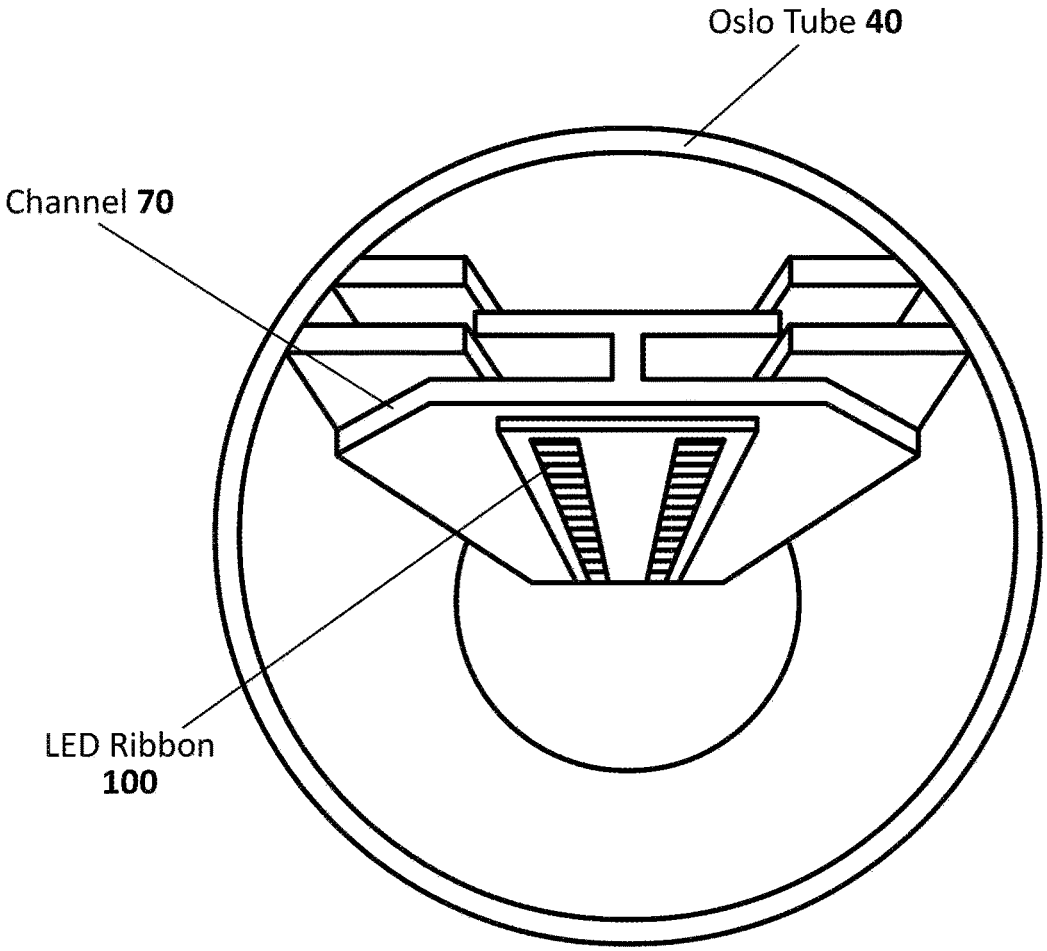

FIG. 13 is an illustrative view of the Oslo tube 40, showing the LED ribbon 100 installed on the typically downwardly facing lower surface of channel 70.

Figure 14:
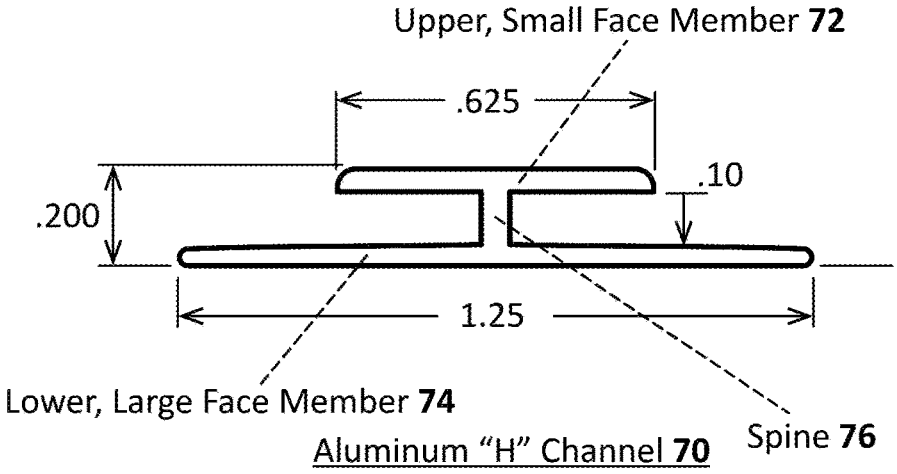

FIG. 14 shows channel 70, which includes a large lower face member 74 having a one 1.25" wide face side and a smaller 0.625" upper face member 72 separated by a 0.10" spine 76 down the middle. These dimensions are exemplary only and should not be considered exclusive or limiting.

Figure 15A:
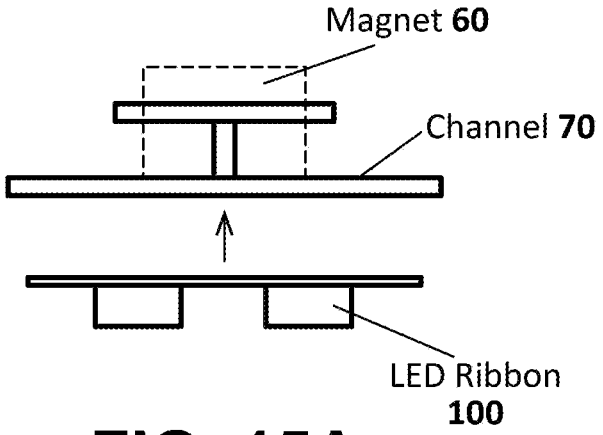
Figure 15B:
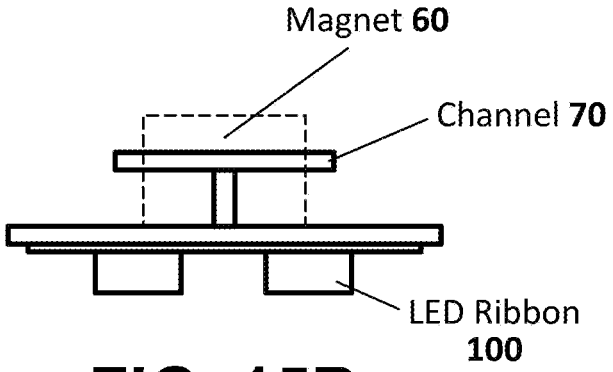
Figure 15C:
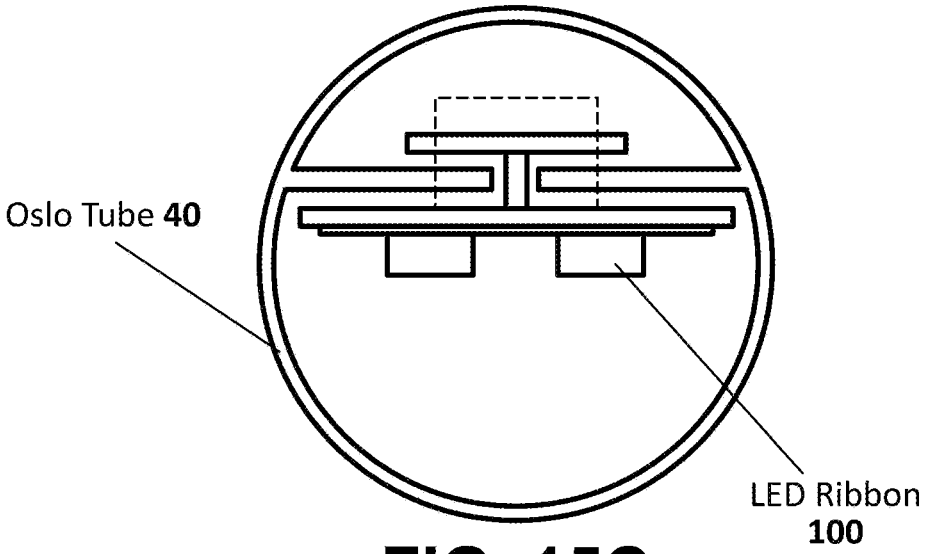

FIGS. 15A-C are sequential illustrative views of the assembly of the LED Ribbon 100, channel 70, and magnet 60. FIG. 15A shows the LED Ribbon 100 being attached to the underside of channel 70, and the magnet 60 (shown in dotted line) in place atop the channel 70.

FIG. 15B shows the LED Ribbon 100 attached to the underside of channel 70, and the magnet 60 in place atop channel 70. FIG. 15C shows the assembly shown in FIG. 15B installed within the interior of Oslo tube 40. This can also be seen in FIG. 13. However, FIG. 15C shows the magnets relation to the slide channel 46 and lower shelf 43 discussed elsewhere.

Figure 16:
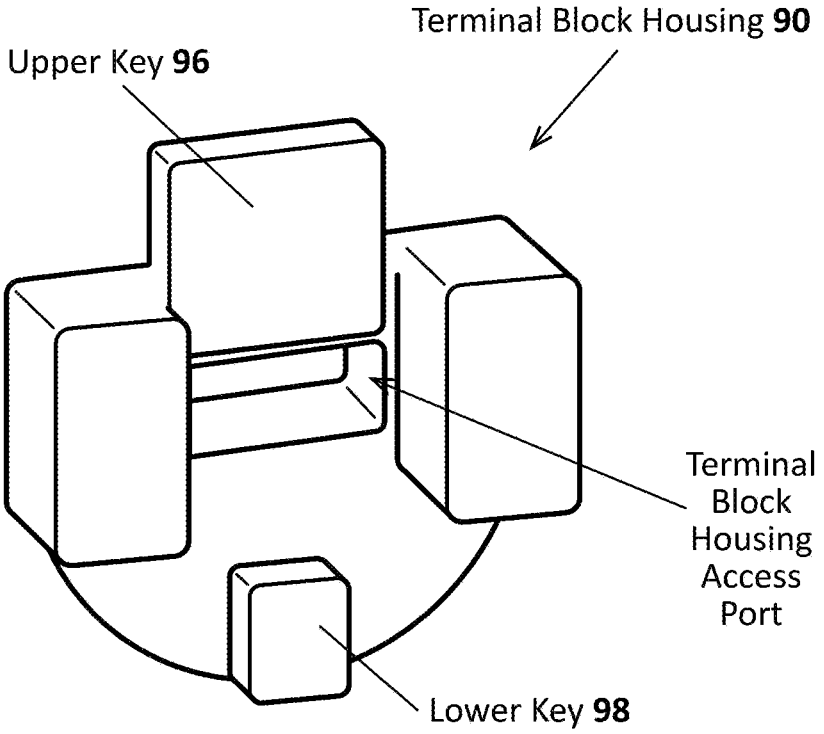

FIG. 16 is a view of the terminal block housing 90, showing the terminal block housing access port, and the upper key 96, which locates between the "interior tube gap 45" which is between the two opposing interior channels of the Oslo tube 40. Also shown is the lower key 98 which mates with the lower key slot 138 defined by the end cap 130.

Figure 17:
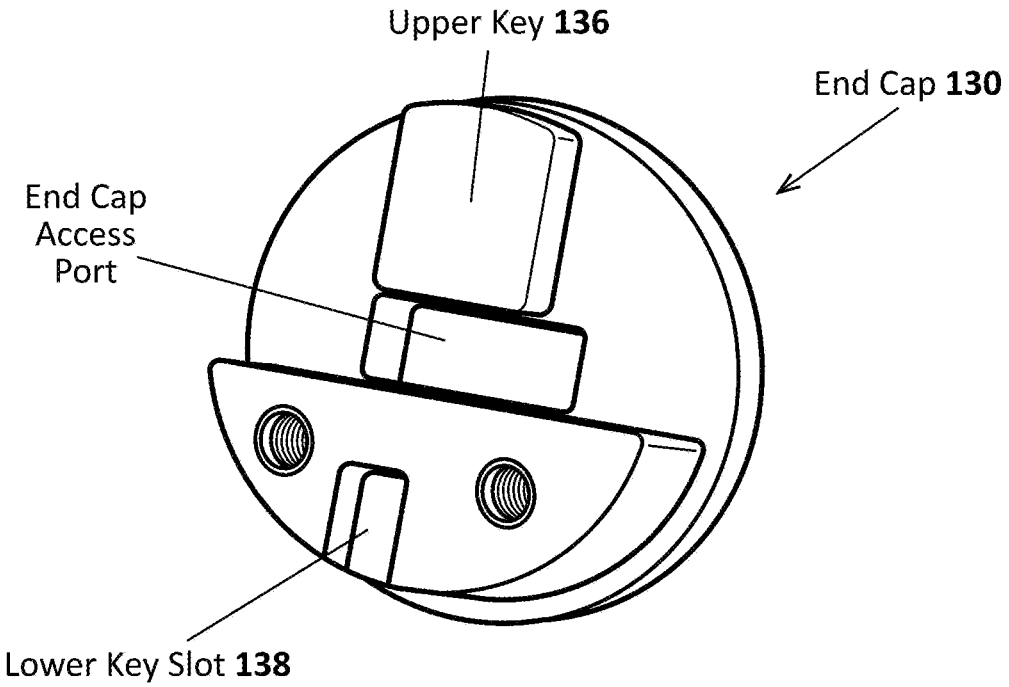

FIG. 17 is a view of the end cap 130, showing the end cap access port as well as the upper key 96 which locates between the "interior tube gap 45" which is between the two opposing interior channels of the Oslo tube 40. FIG. 8 shows some typical dimensions of the Oslo tube 40, but these should not be limiting. Note that the "interior tube gap 45" which is shown as 13 mm in drawing is the gap into which the upper key 96 of the terminal block housing 90 fits when installed. This same gap is the gap into which the upper key 136 of the terminal block housing 130 fits when installed.

Also shown is the lower key slot 138 which accepts the lower key 98 of the terminal block housing 90 when the elements 90, 130 are fastened together.

Figure 18A:
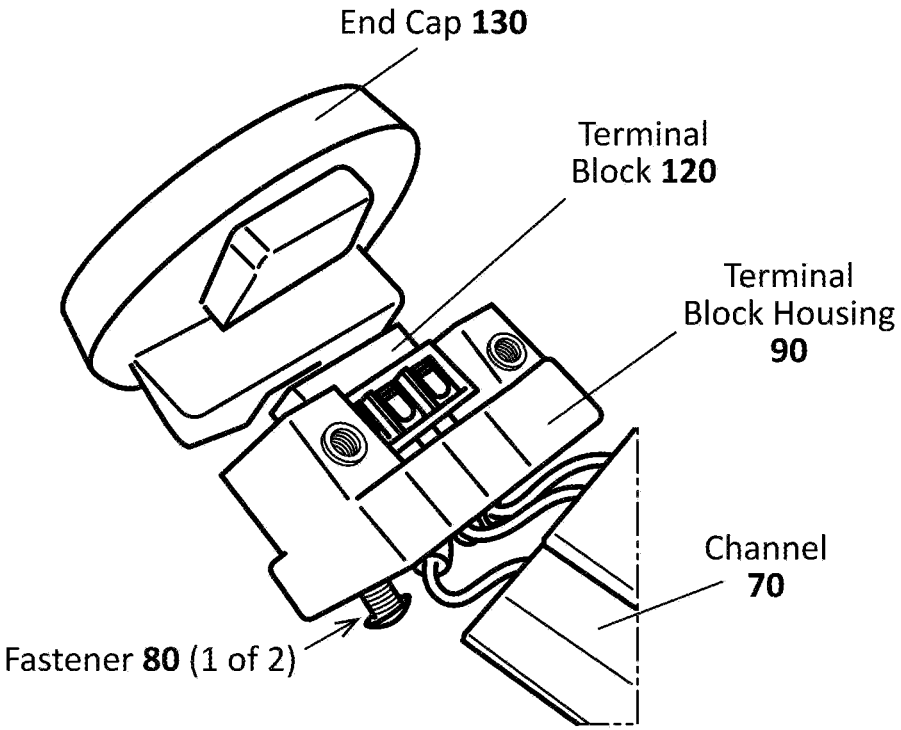
Figure 18B:
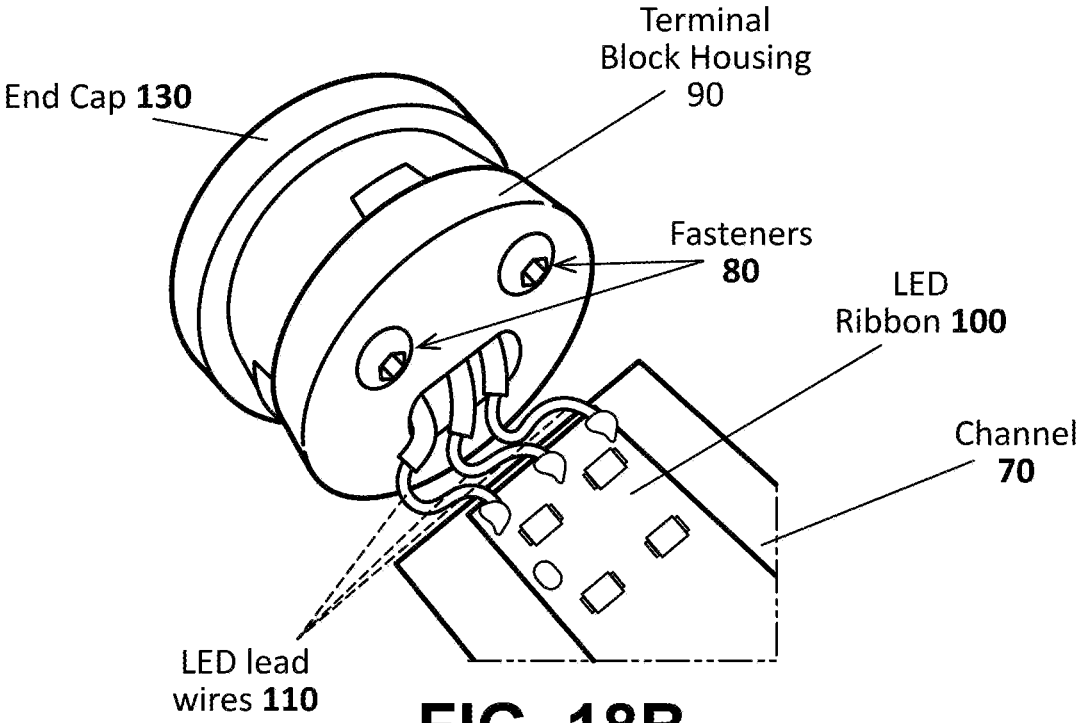

FIGS. 18A-B are sequential assembly views showing the attachment of the end cap 130 to the terminal block housing 90, in the process capturing the terminal block therebetween. FIG. 18A shows the terminal block in position before the end cap 130 is attached to the terminal block housing. This figure shows one screw 80 which will eventually have its free end engaging the end cap 130, thus fastening the end cap 130 to the terminal block housing 90. FIG. 18A shows the configuration "turned over" in an upside-down configuration in order to show the two screws 80 which will eventually have their free ends engaging the end cap 130, thus fastening the end cap 130 to the terminal block housing 90. In this configuration the terminal block is captured by the end cap 130 and the terminal block housing 90.

Figure 19:
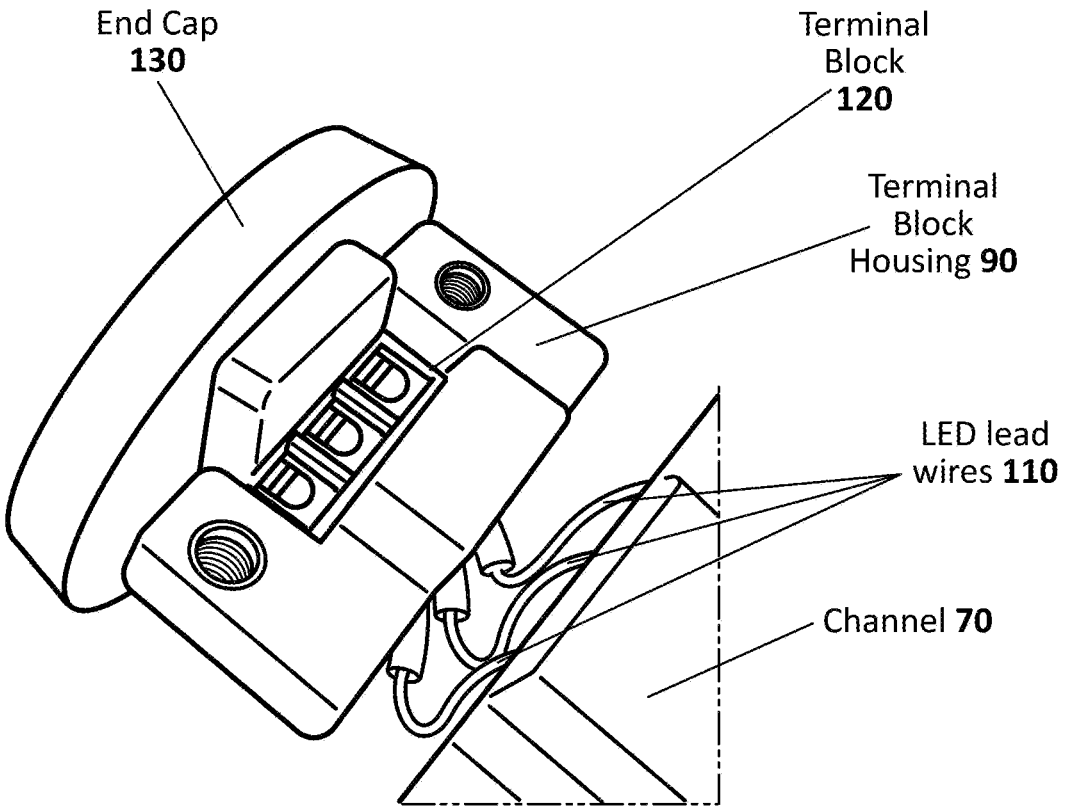

FIG. 19 shows the elements of FIG. 18B in their generally upright configuration, with the end cap 130 attached to the terminal block housing 90. In this configuration the terminal block 120 is captured by the end cap 130 and the terminal block housing 90.

Figure 20:
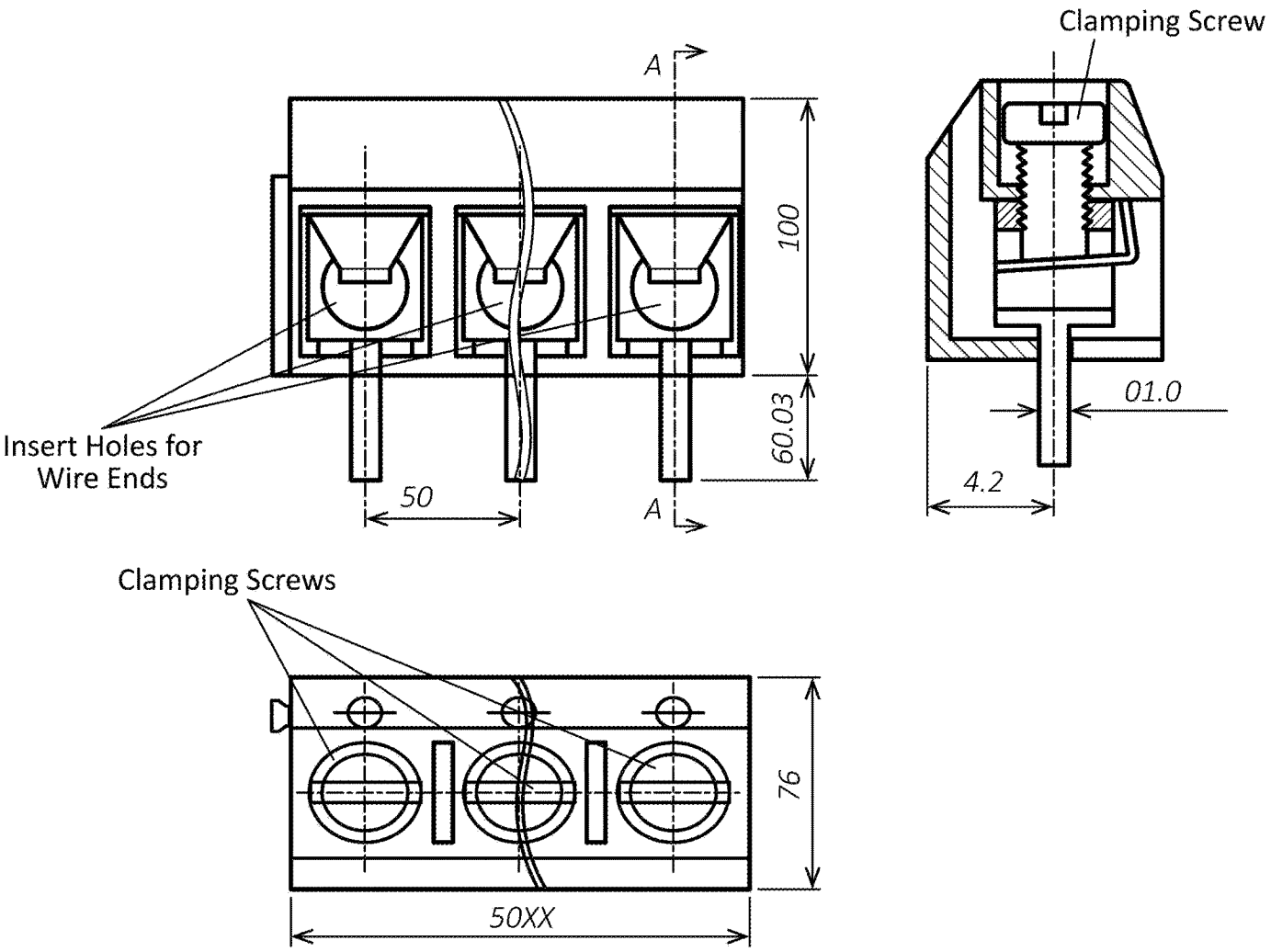

FIG. 20 is a drawing of terminal block 120 in one embodiment.

Figure 21:
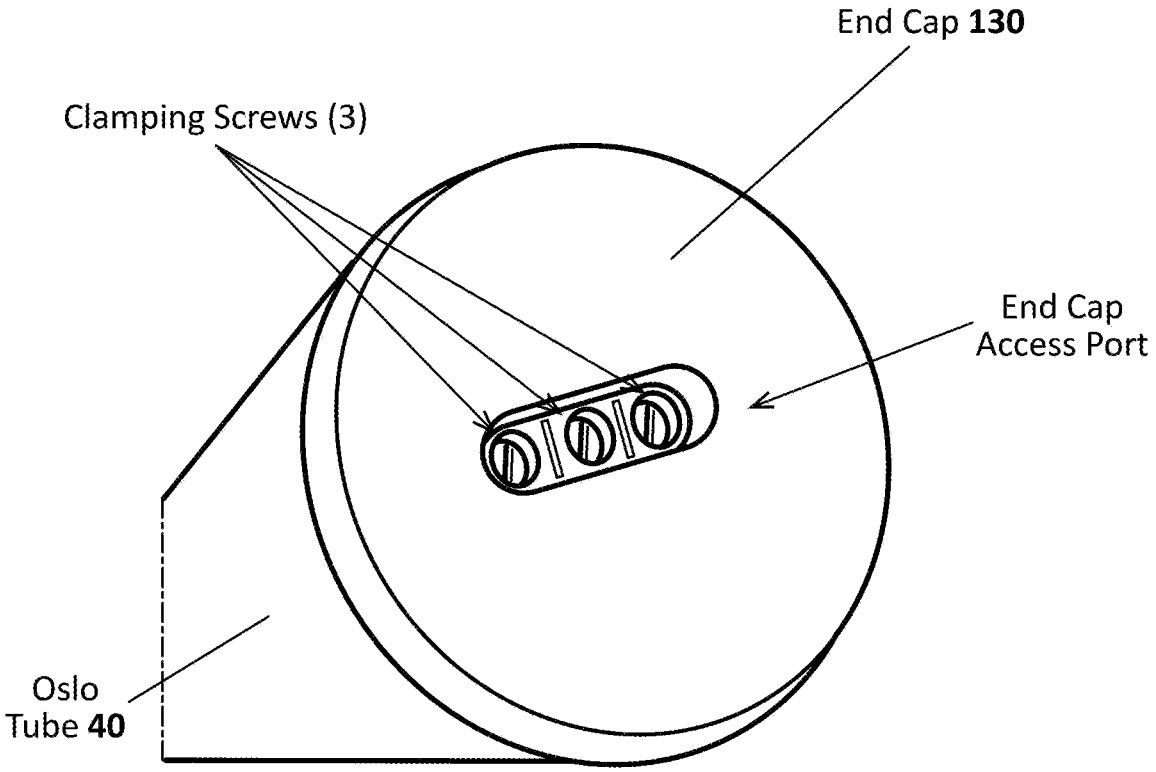

FIG. 21 is a view of End B of assembly 10, showing the end cap 130 attached to the Oslo tube 40. Also shown is the end cap access port in the end cap 130. This end cap access port allows for the manipulation of clamping screws in the terminal block 120, such that the screws can be screwed in or out in order to secure or release external control wires 200 relative to the apparatus 10. In one embodiment, these control wires are bare end or stripped end.

Figure 22:
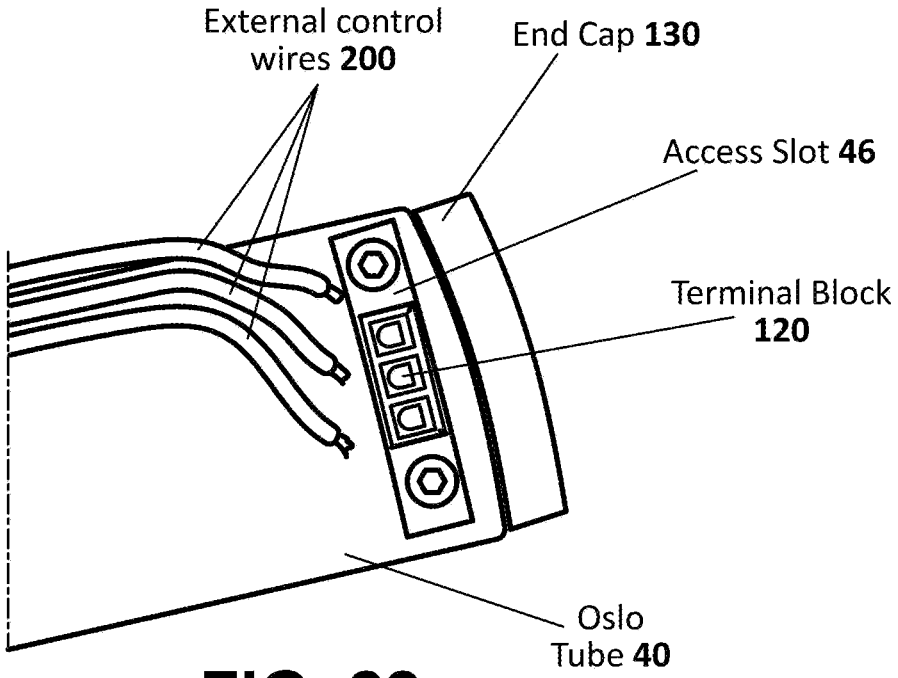

FIG. 22 is a view of End B of the assembly 10, showing the end cap 130 attached to the Oslo tube 40. Also shown is terminal block 120, viewable though a slot provided in the Oslo tube 40. This slot allows for external control wires 200 to be connected to the terminal block 120, such that its clamping screws can be screwed in or out to fix or release the external control wires 200 (bare ended or stripped sheath wire) relative to the apparatus 10.

APPARATUS 10A FIGURES

Elements listed for apparatus 10A Figures are exclusive to apparatus 10A and found in the Apparatus 10A Elements List located within.

Figure 23:
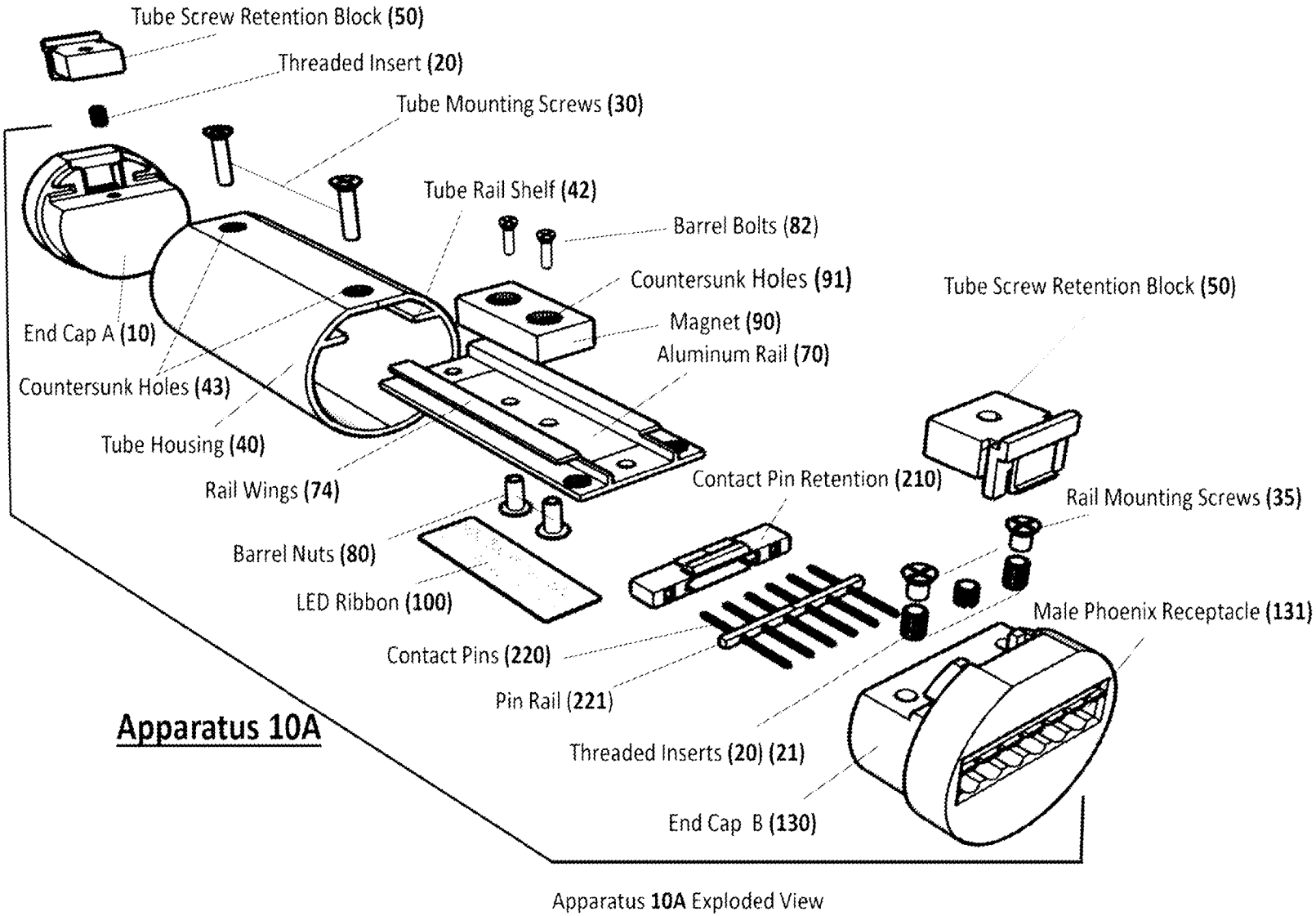
FIG. 23 through FIG. 43 illustrate apparatus 10A.

FIG. 23 is an exploded pictorial view of apparatus 10A, showing its multiple components. Length of apparatus 10A will be manufactured for a variety of typical fluorescent tube lengths. 2 Ft, 4 Ft or 8 Ft length are standard fluorescent sizes. However, these dimensions are exemplary only and should not be considered exclusive or limiting. Representations shown in the following figures will be in a condensed fashion for illustration purposes.

Figure 24:
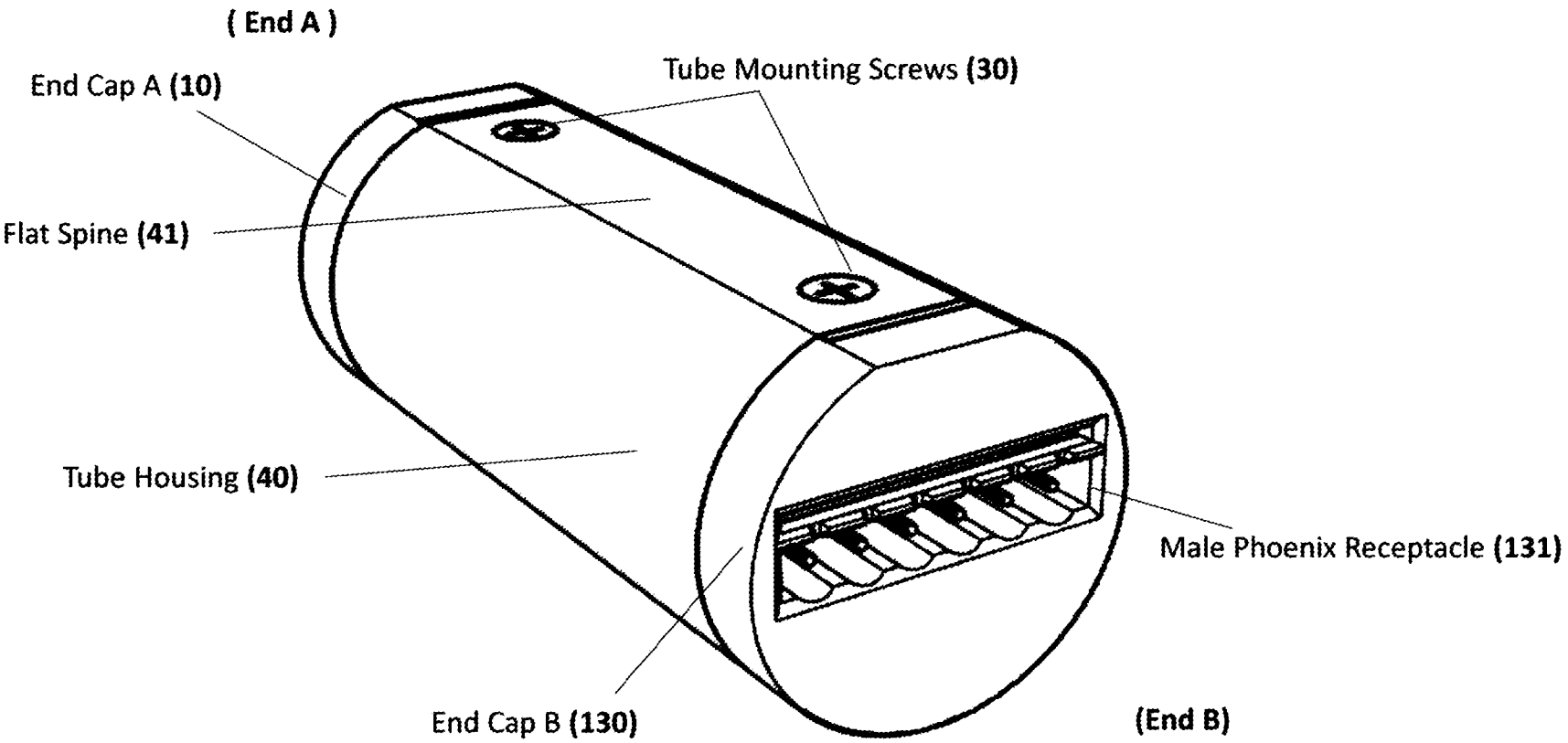

FIG. 24 is a condensed length, pictorial view of apparatus 10A when fully assembled, showing its two ends A and B. Proximate each of said ends A and B are corresponding end caps A 10 and B 130. End cap B 130 includes the male phoenix receptacle 131. End cap A 10 at end A does not include this receptacle.

Figure 25:
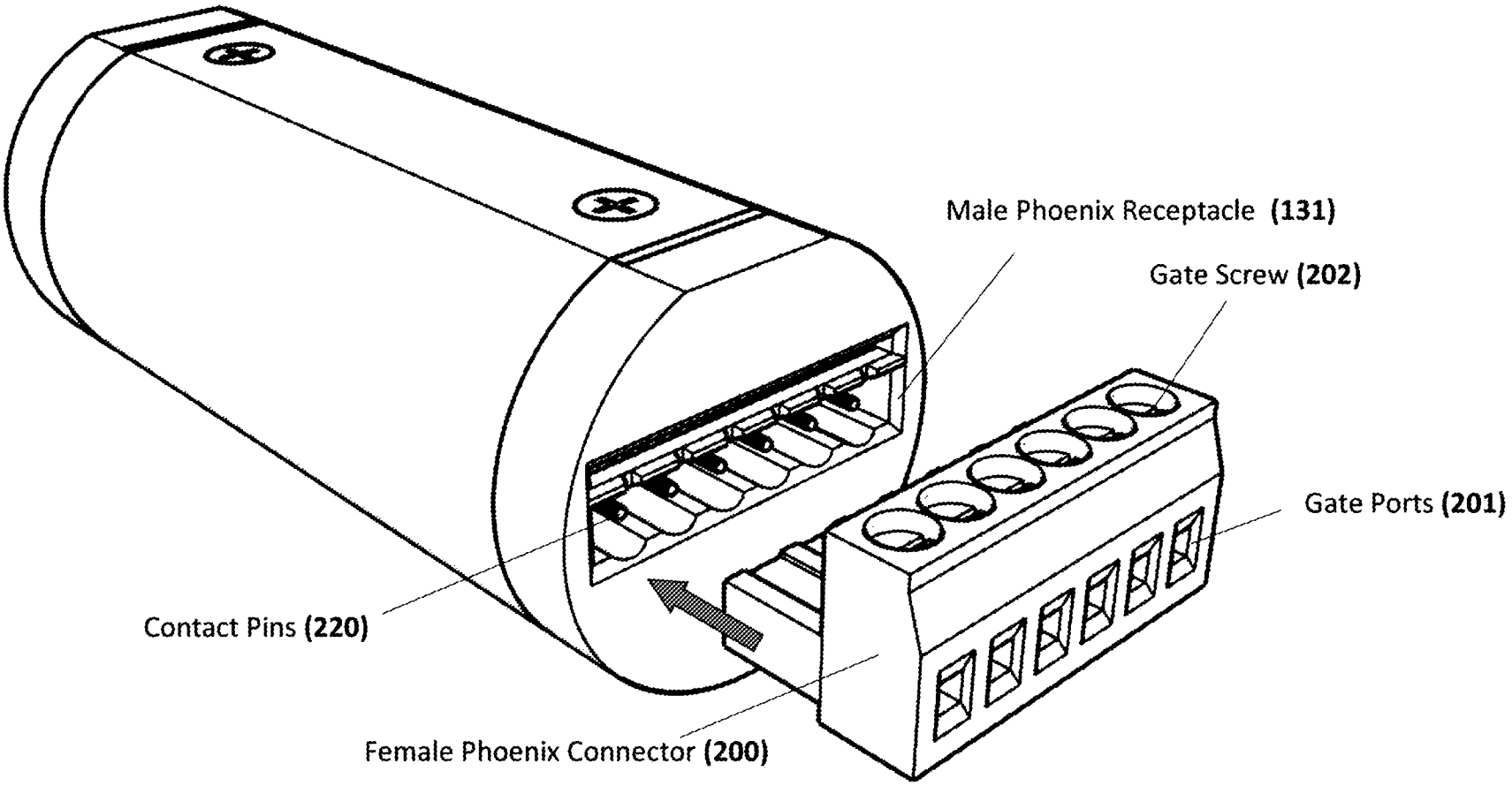

FIG. 25 full view of apparatus 10A, showing End B, which depicts where the premanufactured, external, female control wire connecter, known as a phoenix connector 200, connects to the apparatus 10A via the male phoenix receptacle 131 embedded in end cap B 130.

Figure 26:
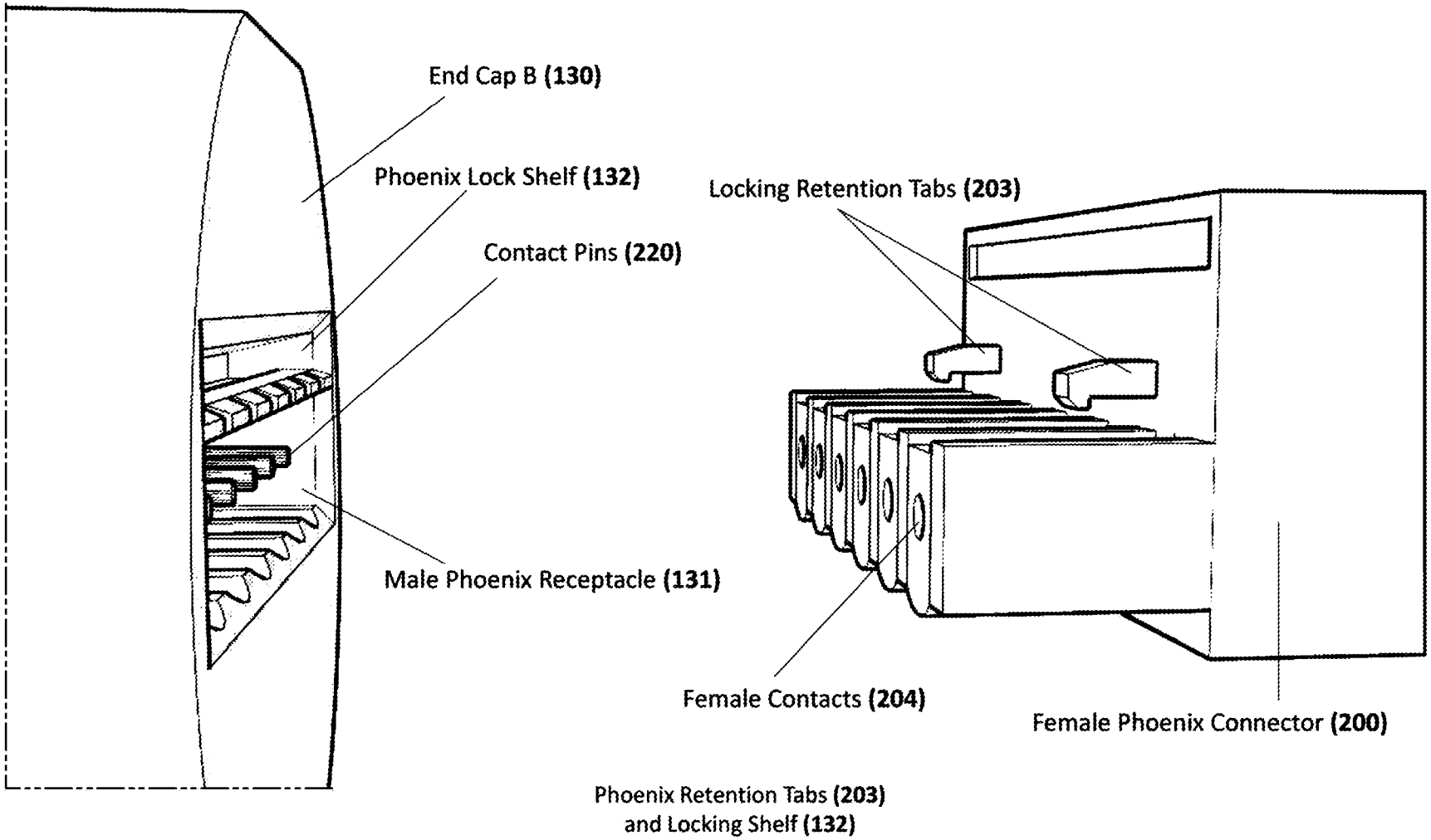

FIG. 26 is a close-up, side view, of end B with end cap B 130 and female phoenix connector 200. Detailing the lock shelf 130 and the locking retention tabs 203.

Figure 27:
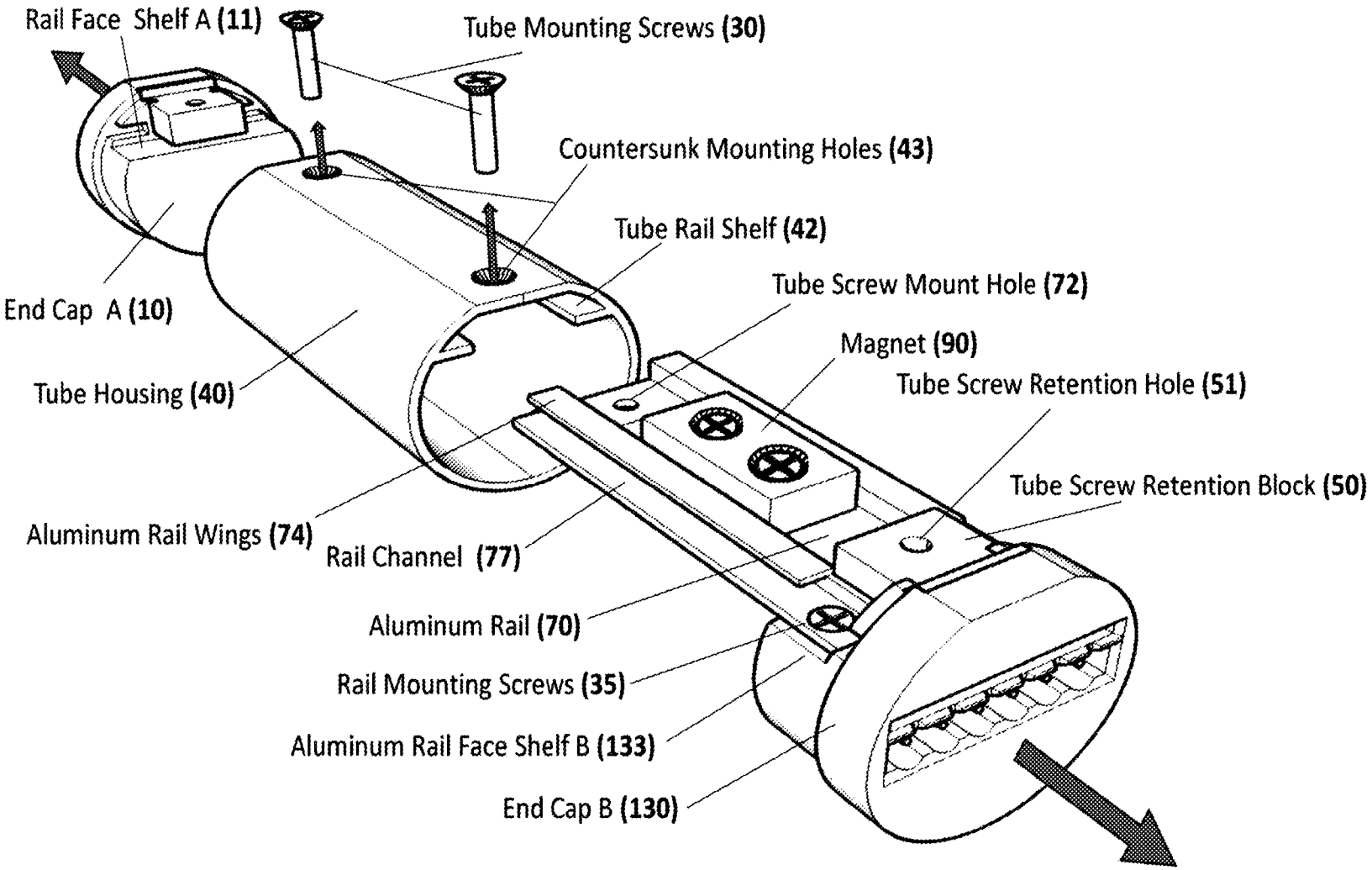

FIG. 27 Shows a view of components that are released once the tube mounting screws 30 are removed from the tube housing 40. Depicts the end user's disassembly procedure.

Figure 28A:
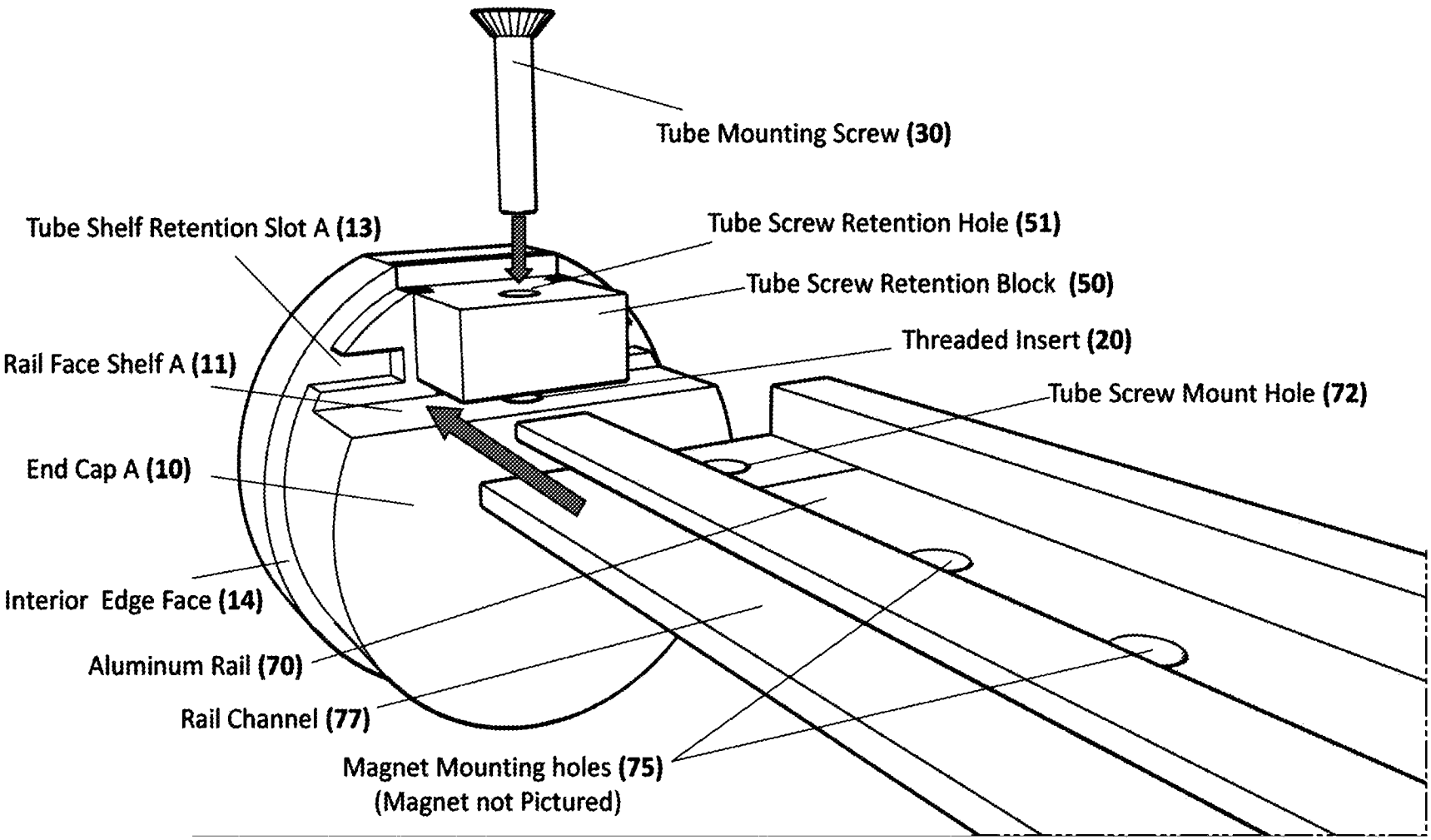

FIG. 28A looks at the mounting mechanism for components of End A.

Figure 28B:
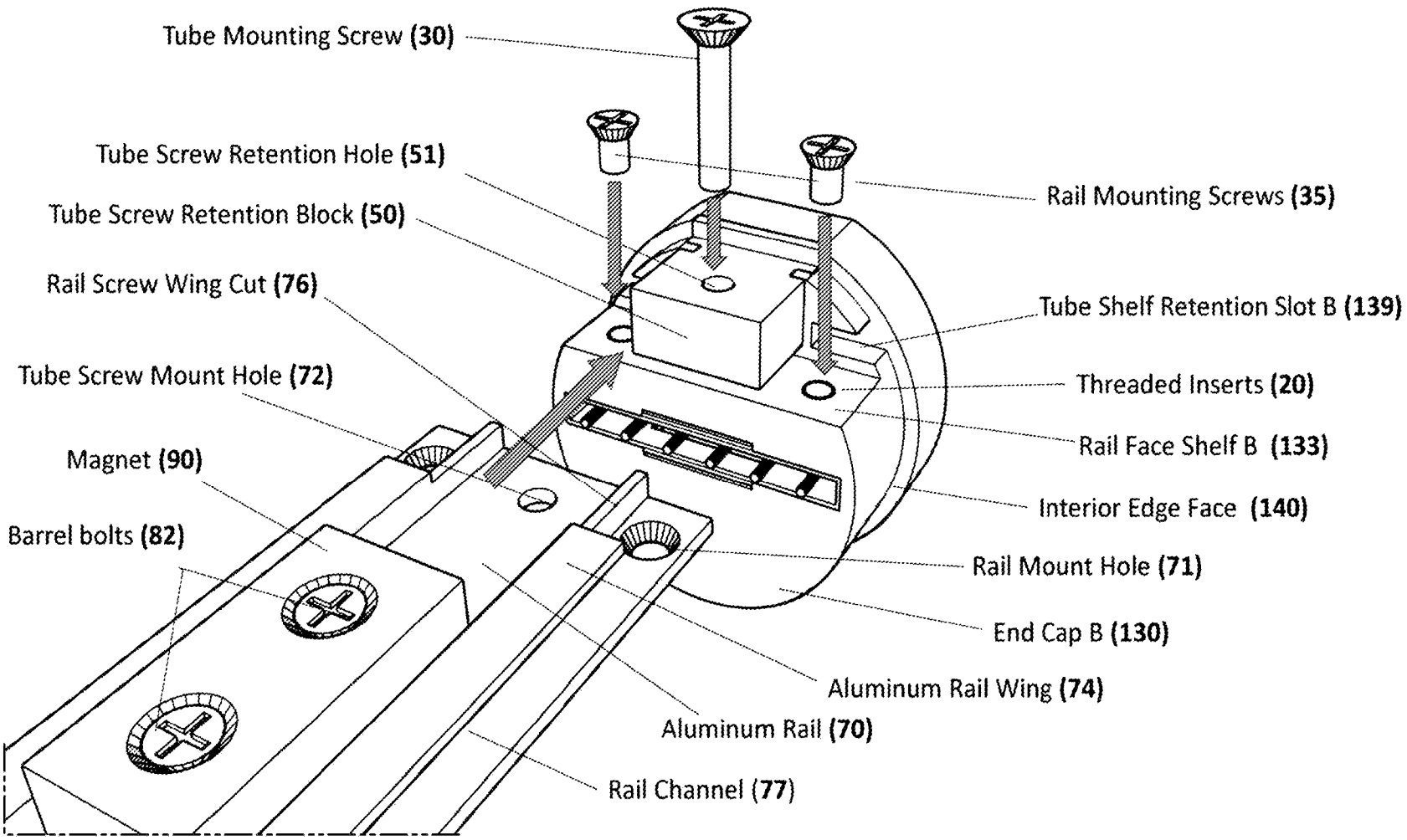

FIG. 28B looks at the mounting mechanism for components of End B.

Figure 29A:
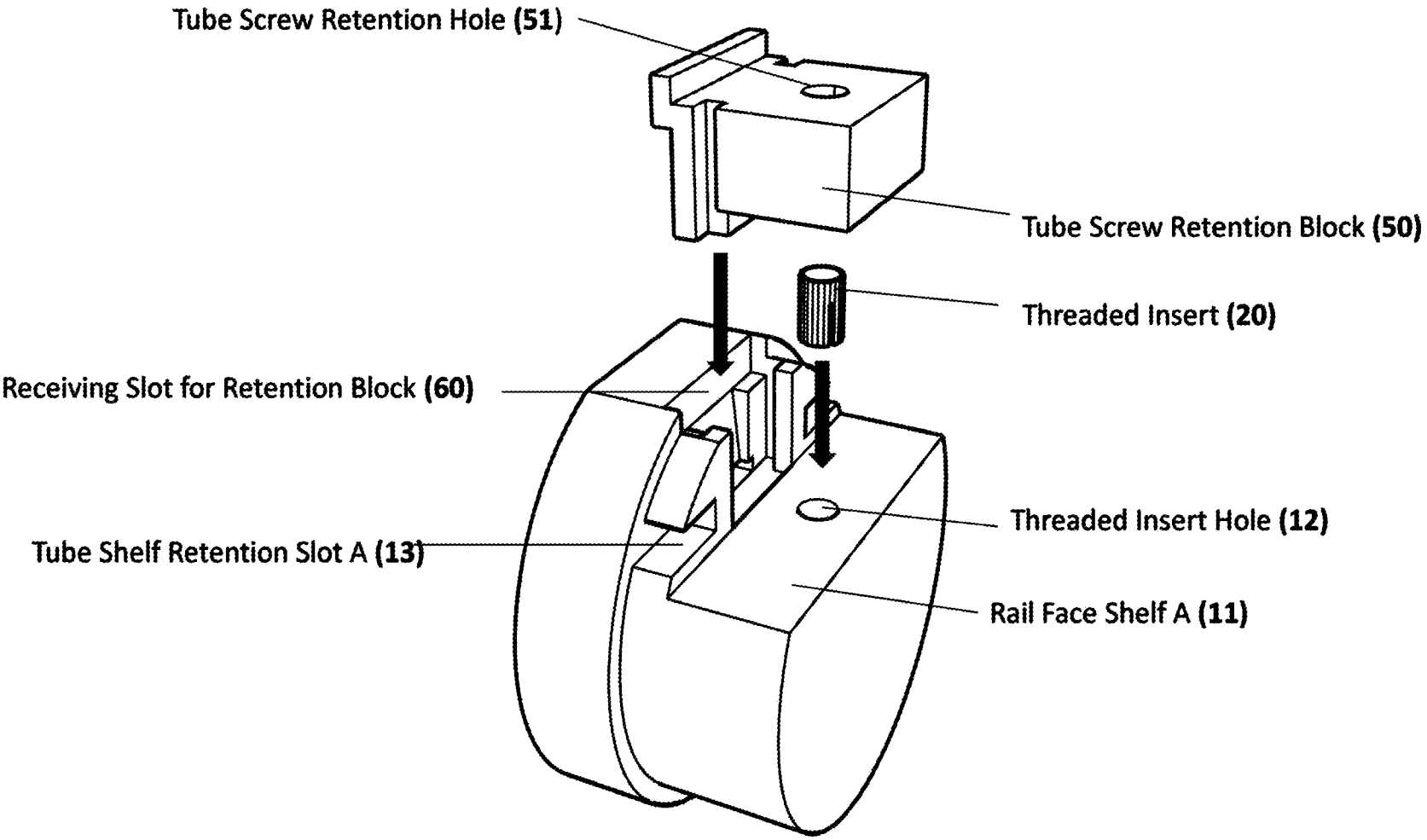

FIG. 29A shows an exploded view of components that insert into end cap A 10.

Figure 29B:
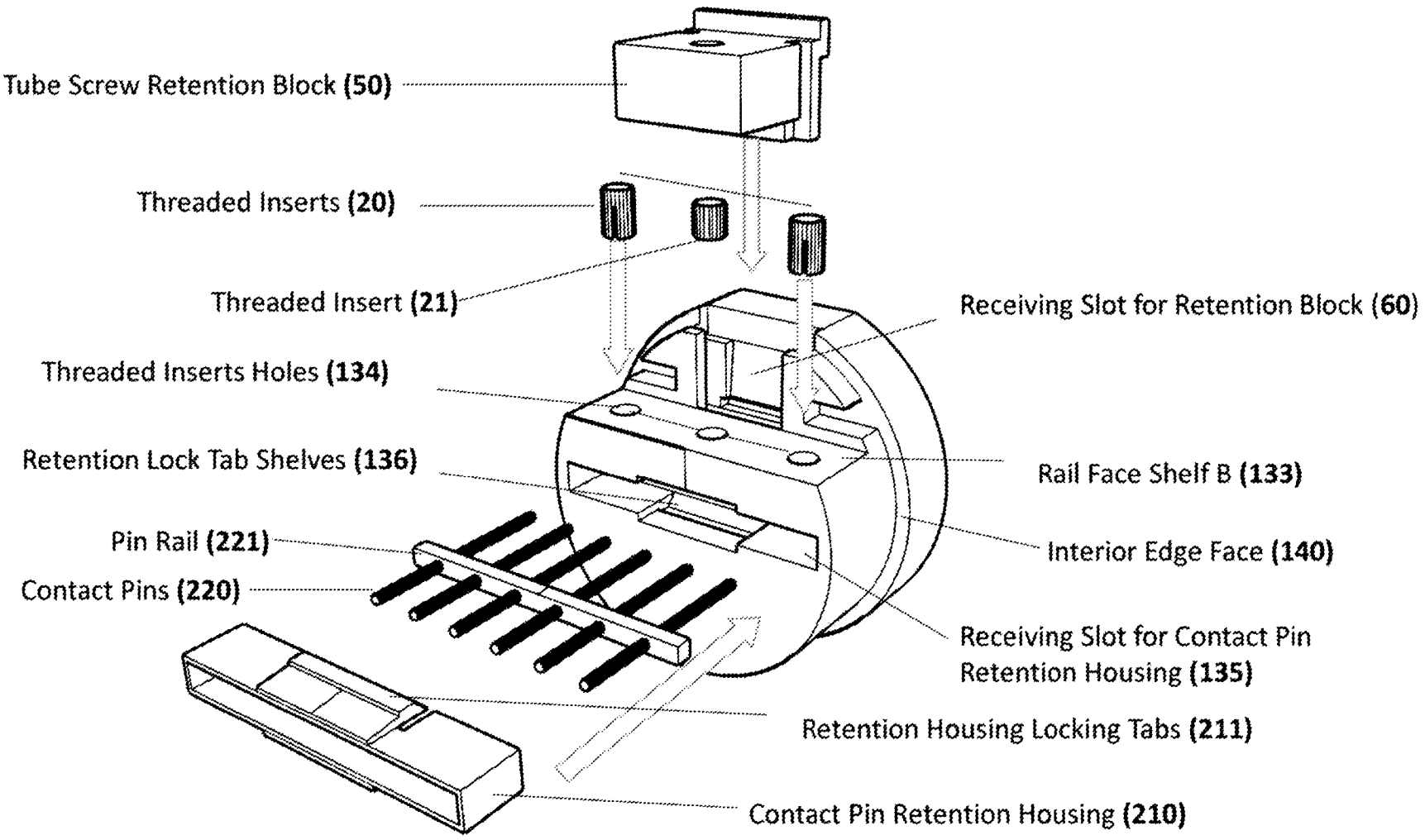

FIG. 29B shows an exploded view of components that insert into end cap B 130.

Figure 30:
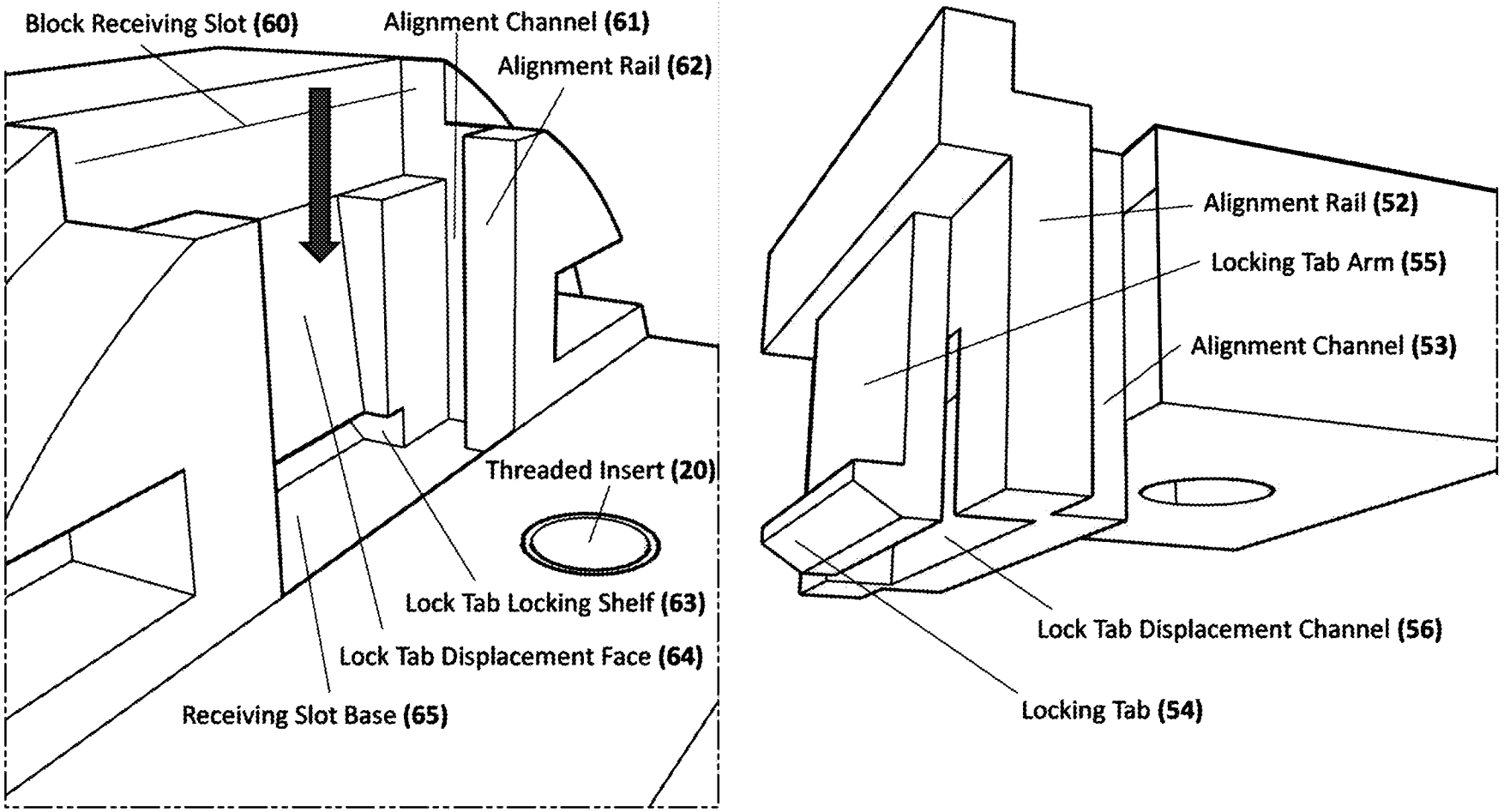

FIG. 30 shows the permanent locking mechanism of the tube screw retention blocks 50 when pressed into the receiving slot 60 of each corresponding end cap. The mechanism is the same for both end caps A 10 and B 130 but is only shown in detail in FIG. 30.

Figure 31A:
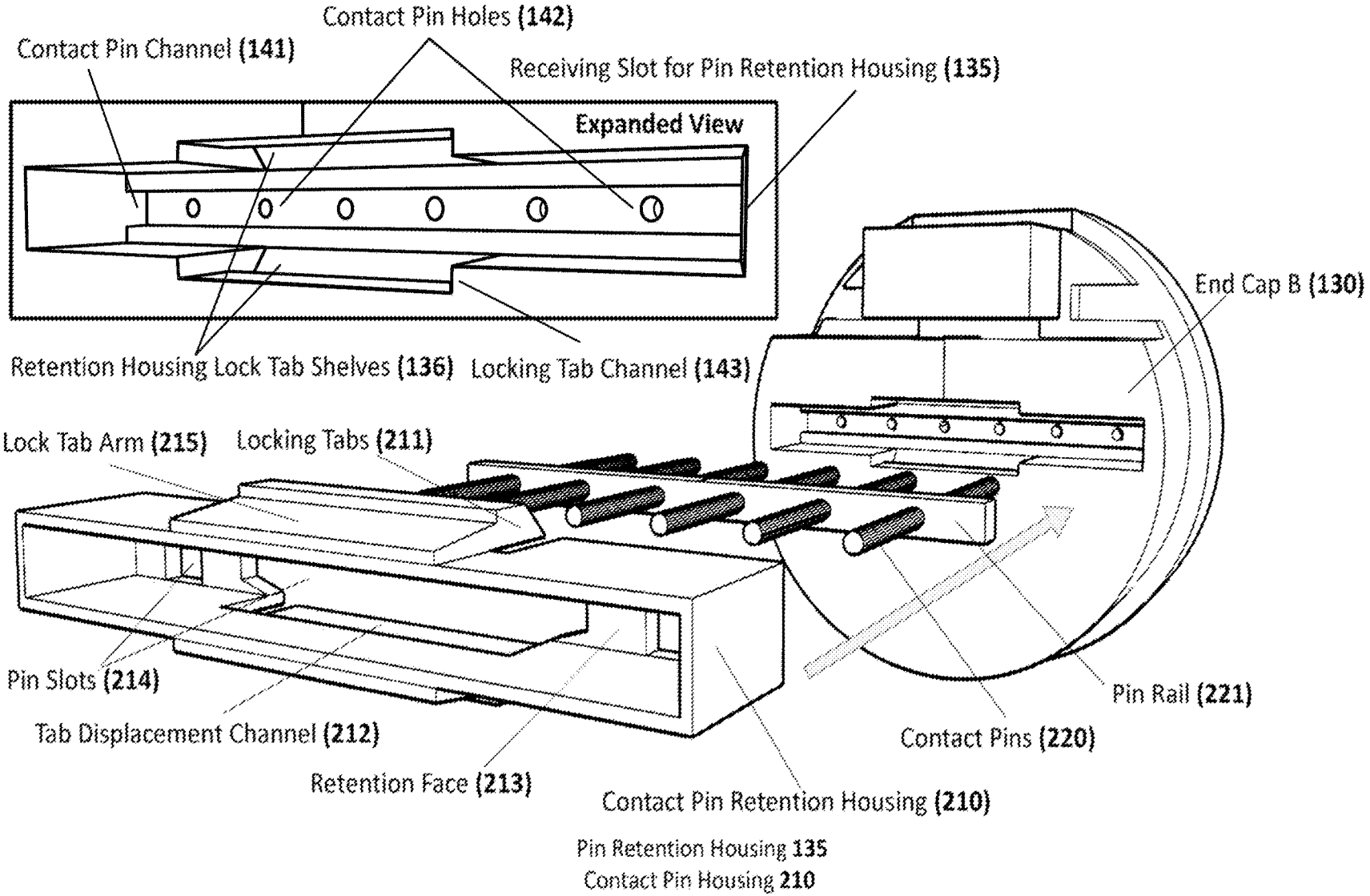

FIG. 31A details the components and installation of the contact pins 220 and the contact pin retention housing 210 into the retention housing receiving slot 135 of end cap B 130. An expanded view window shows details of the retention housing receiving slot 135 and its components.

Figure 31B:
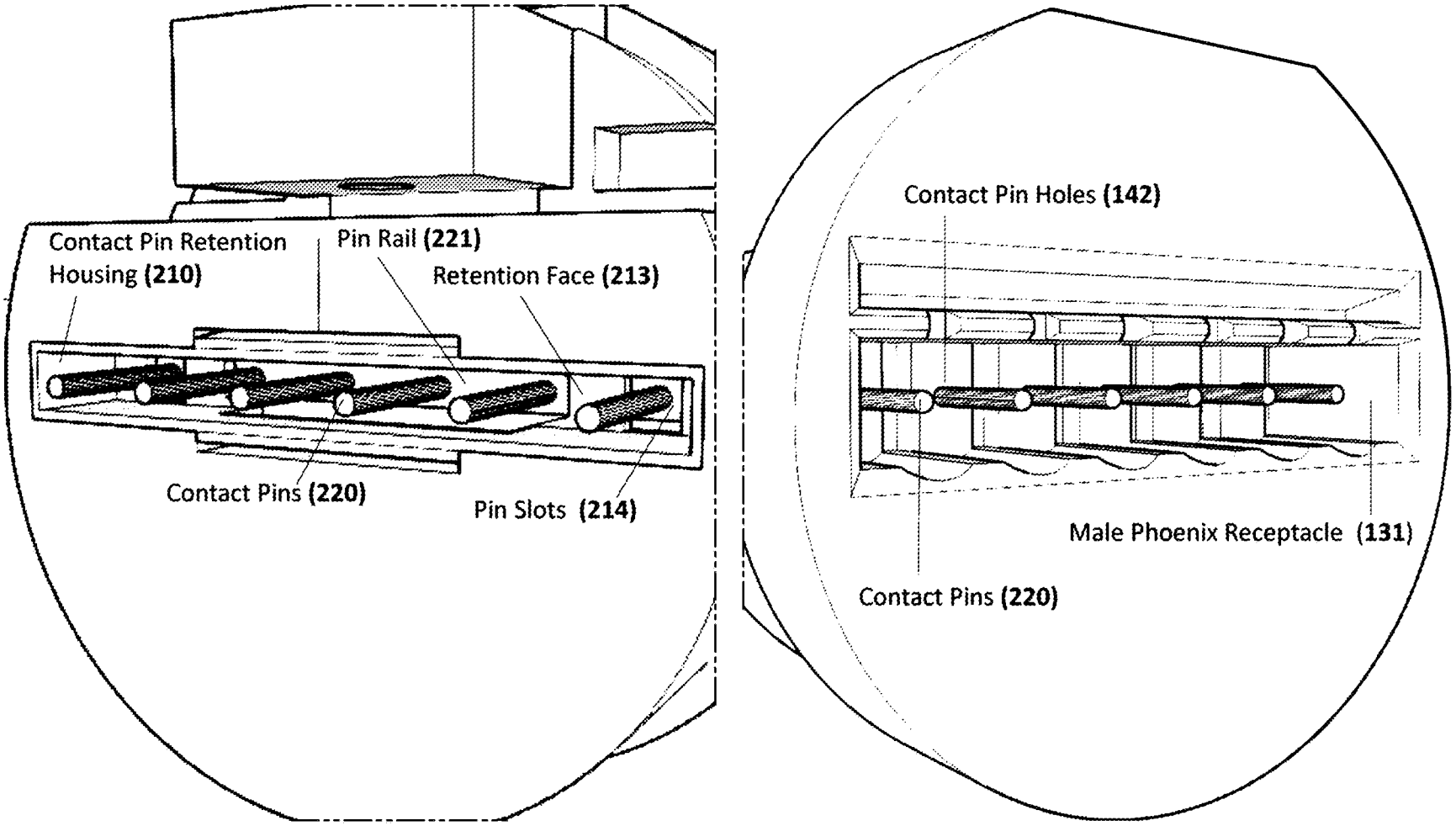

FIG. 31B shows both interior face and exterior face of end cap B 130 when all components are installed. Contact pins 220 are retained by the contact pin housing 210.

Figure 32:
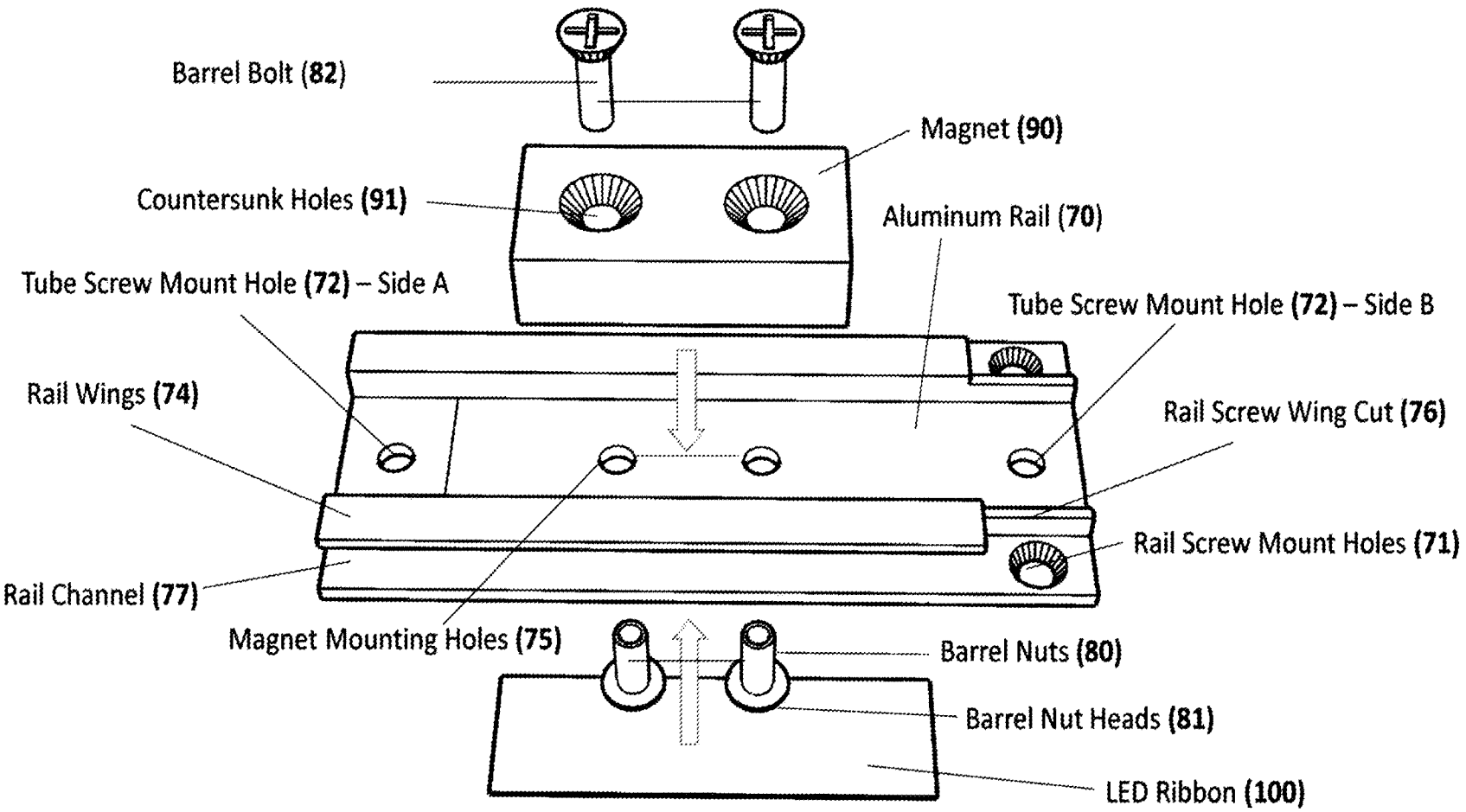

FIG. 32 is an exploded view of components which mount to the aluminum rail 70.

Figure 33A:
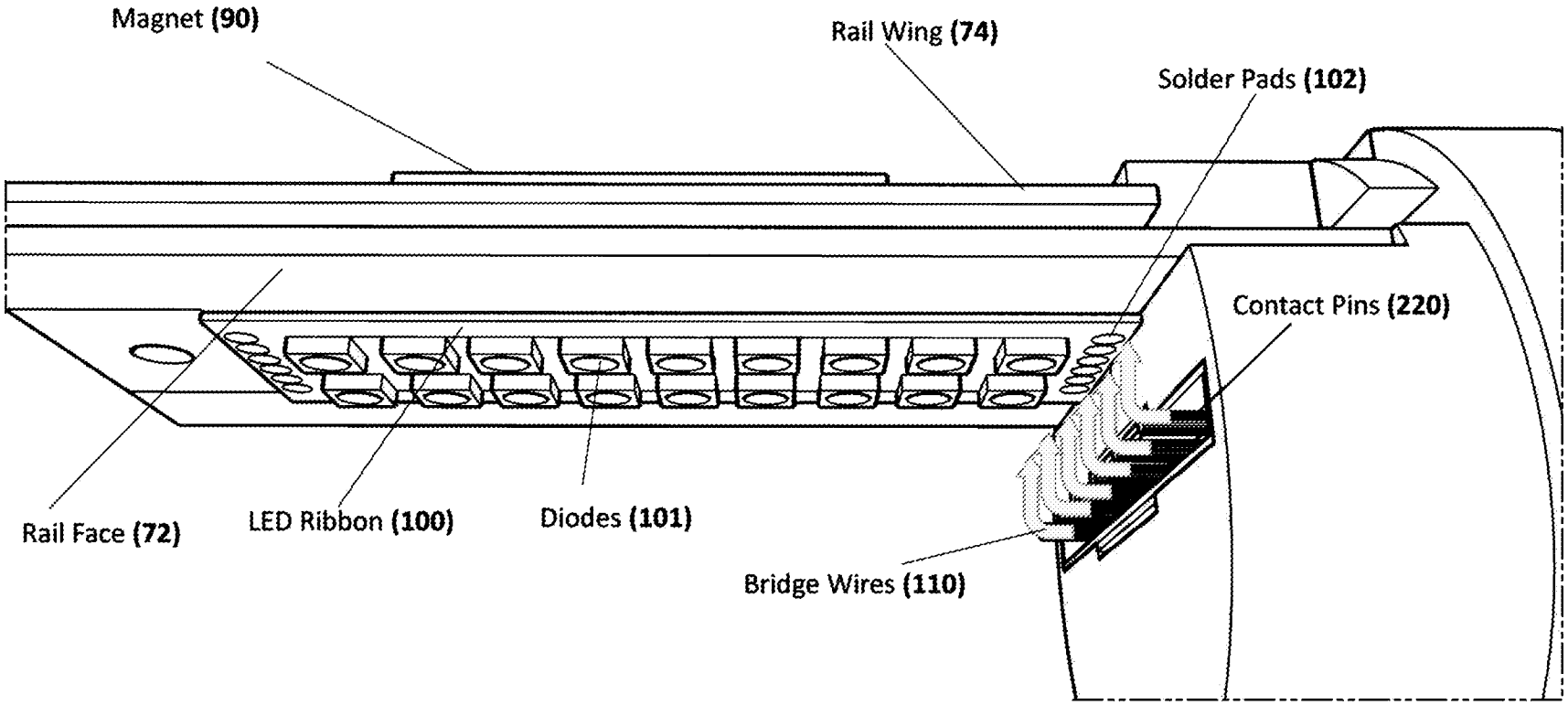

FIG. 33A shows LED ribbon 100 attached to the rail face 72 of the aluminum rail 70 with end cap B 130 attached. Details the connection of the contact pins 220 to the solder pads 102 of the LED ribbon 100, via soldered bridge wires 110. (Similar bridge wires can also be seen in Apparatus 10 FIG. 18B.)

Figure 33B:
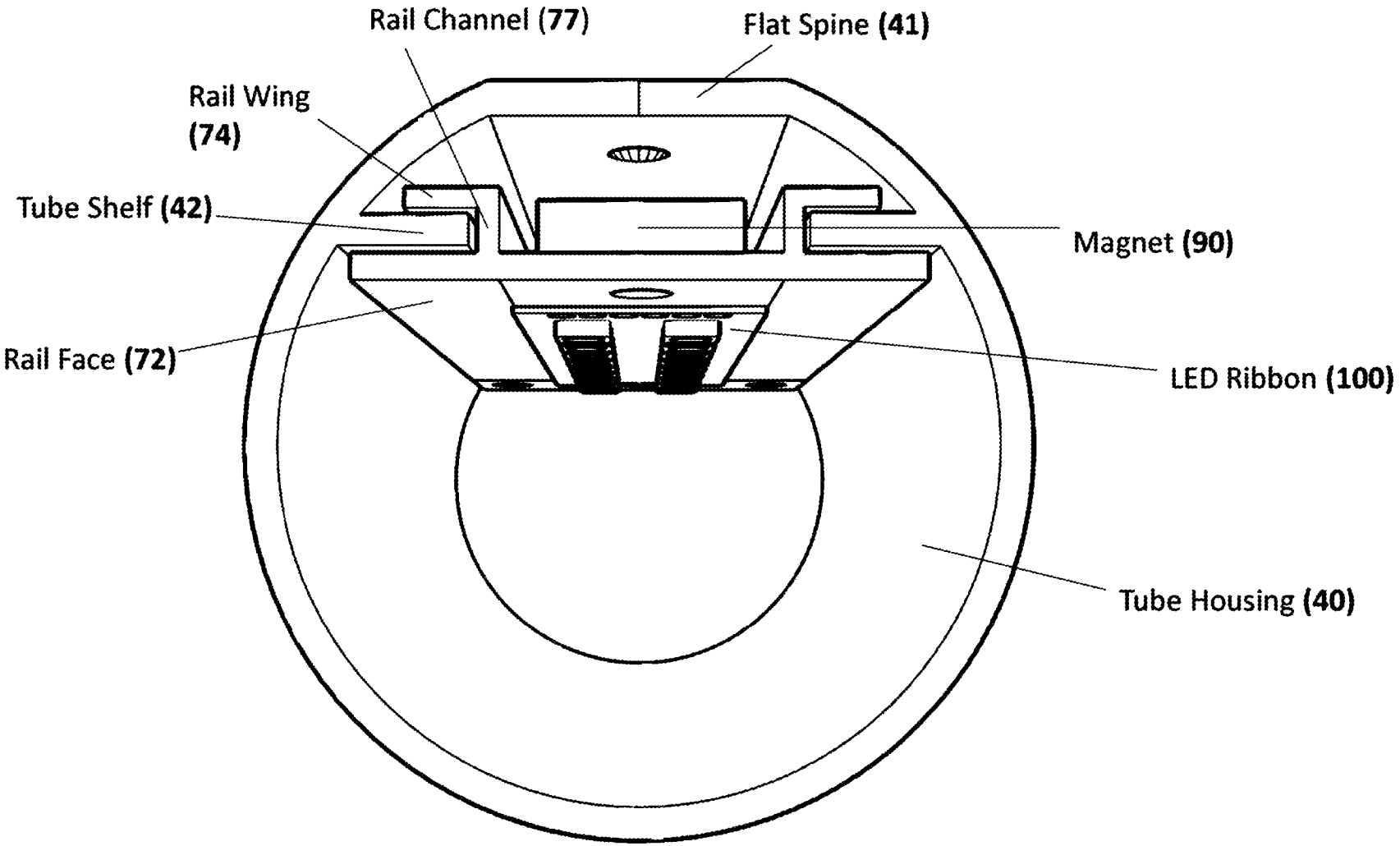

FIG. 33B shows the A side of the aluminum rail 70 installed into the tube housing 40 with the tube shelf 42 mating with the rail channel 77 and rail wing 74.

Figure 33C:
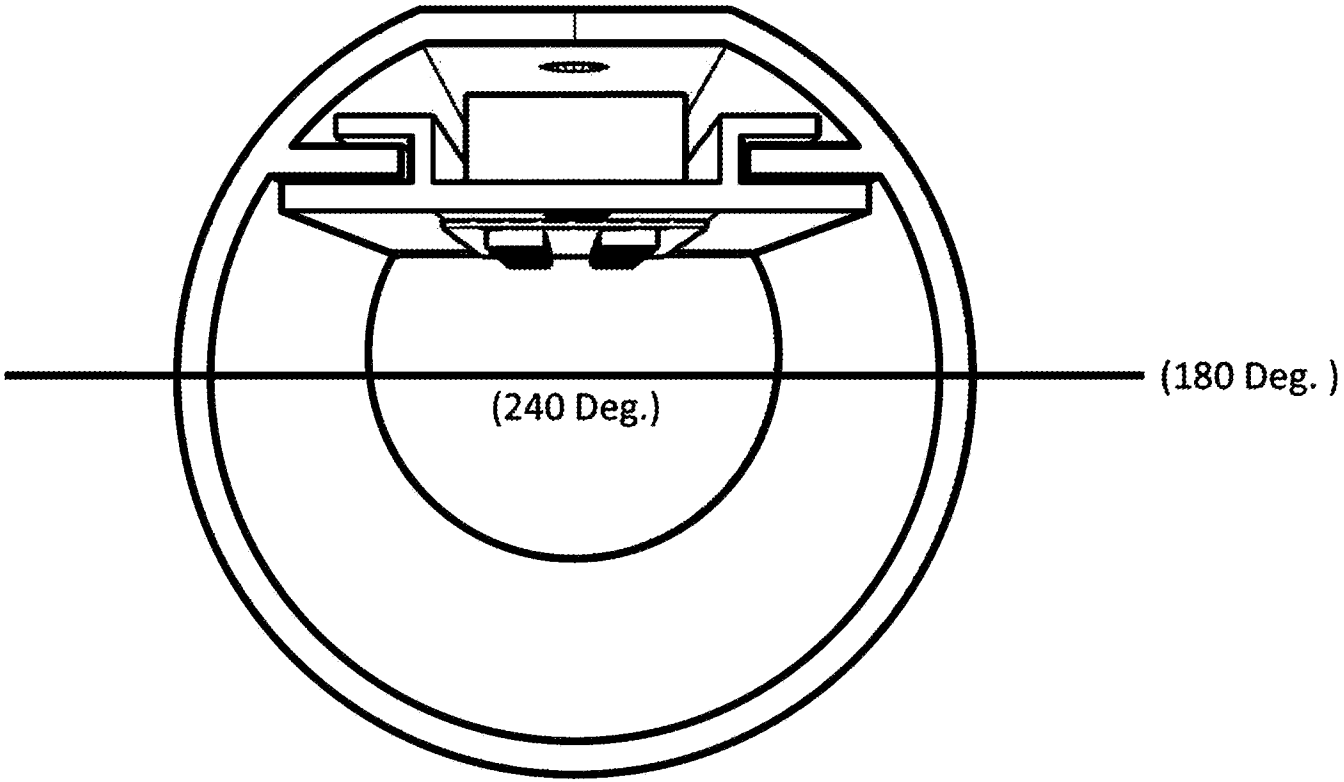

FIG. 33C is the same view as FIG. 33B. However, blue diagrams illustrate the angle of light emissions from the tube when LED 100 is illuminated.

Figure 34A:
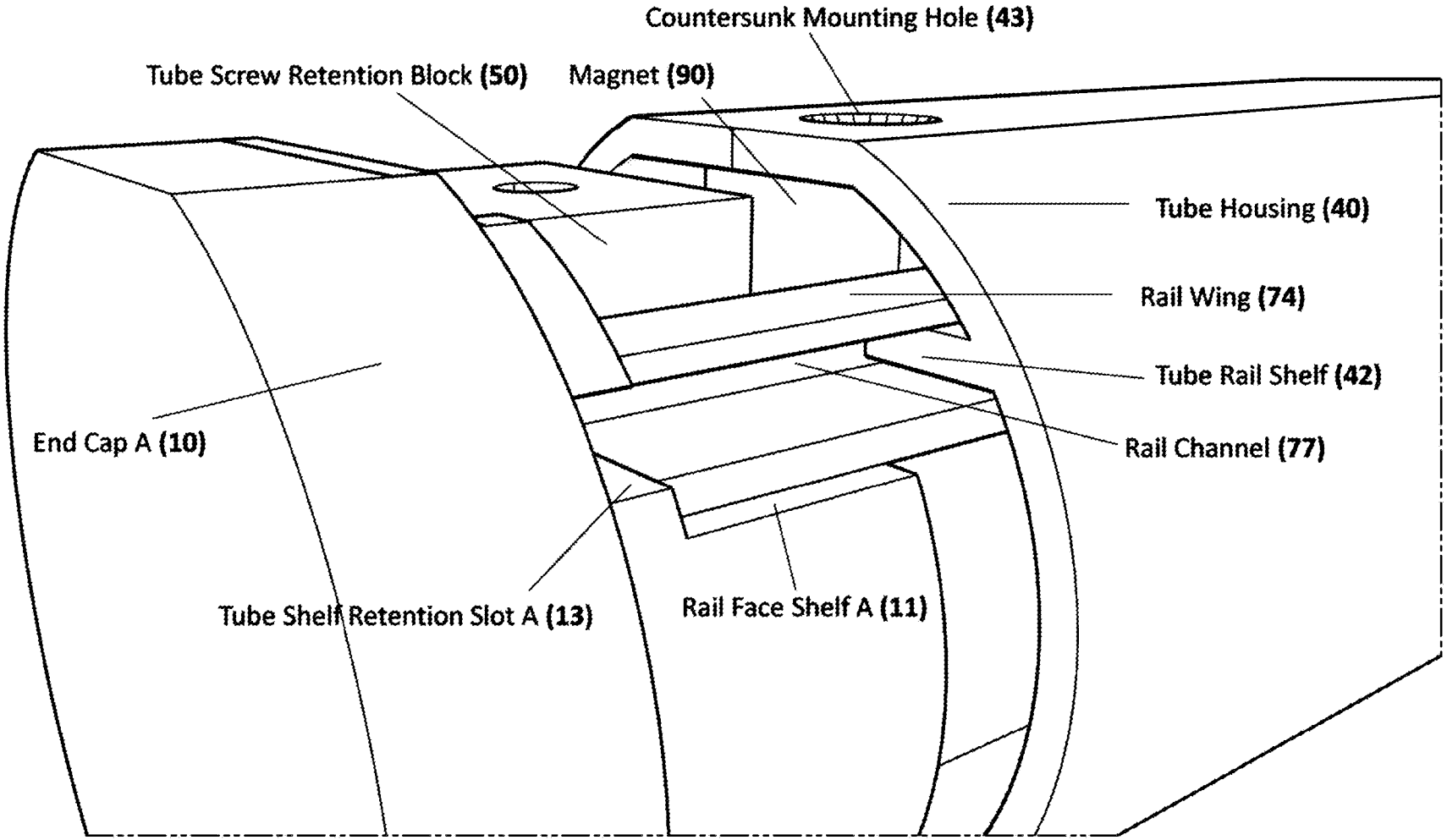

FIG. 34A is a partial view of side A of apparatus 10A detailing the connections of the tube rail shelf 42, mated with the rail channel 77 and the rail wing 74 when end cap A 10 is installed.

Figure 34B:
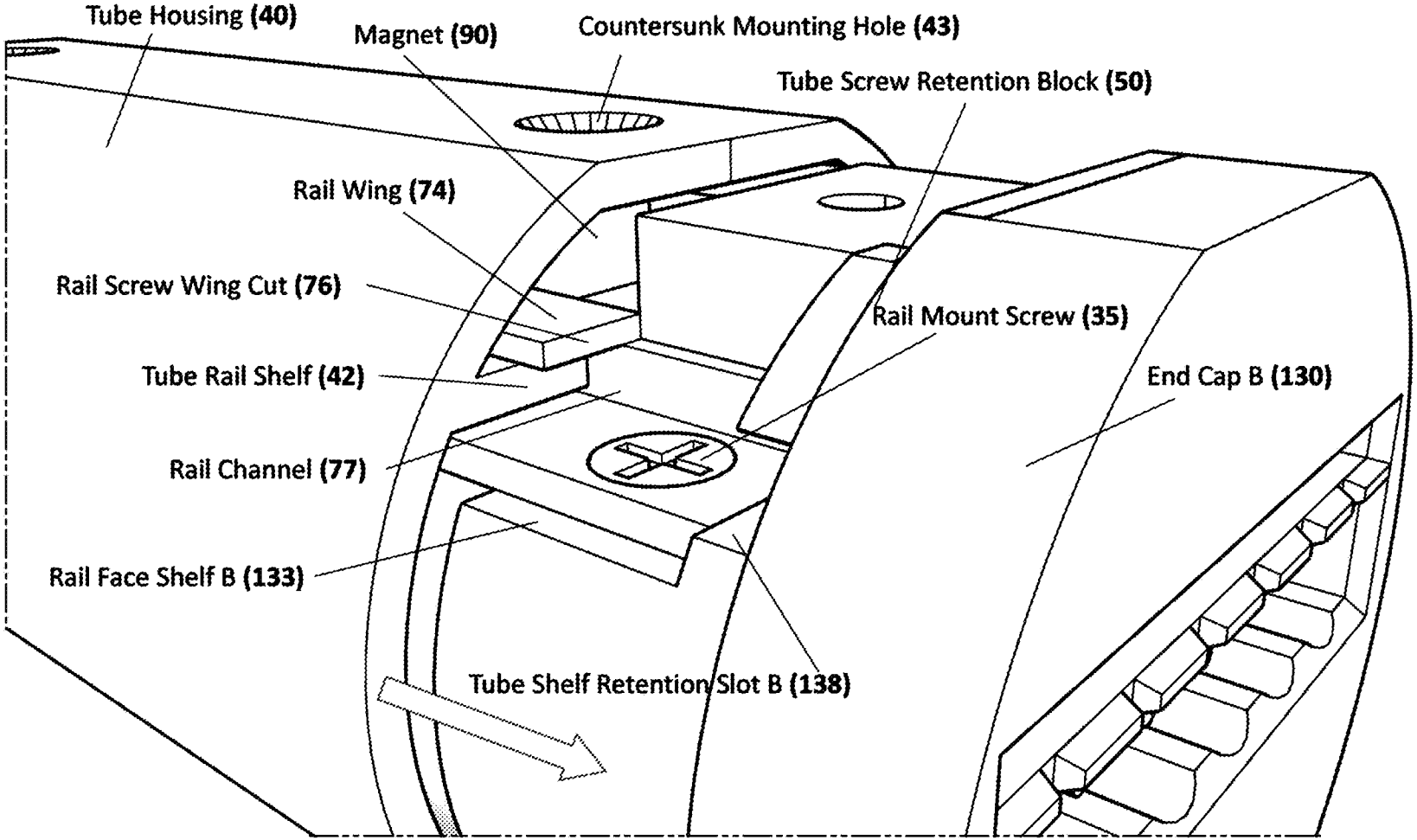

FIG. 34B is a similar view to FIG. 34A but showing the B side of apparatus 10A, detailing the connections of the tube rail shelf 42, mated with the rail channel 77 and the rail wing 74 when end cap B 130 is installed.

Figure 35:
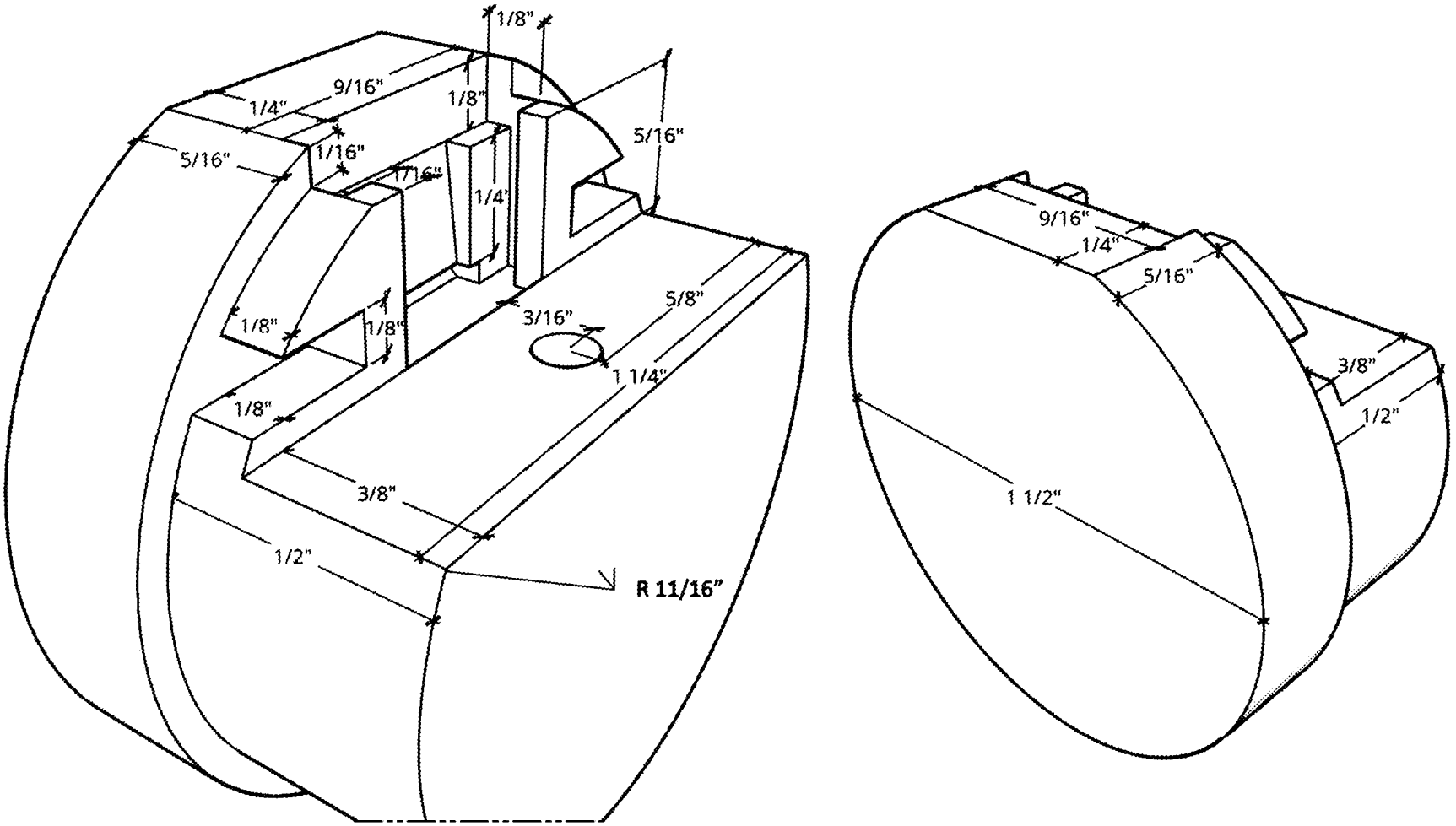

FIG. 35 details the dimensions of end cap A 10.

Figure 36:
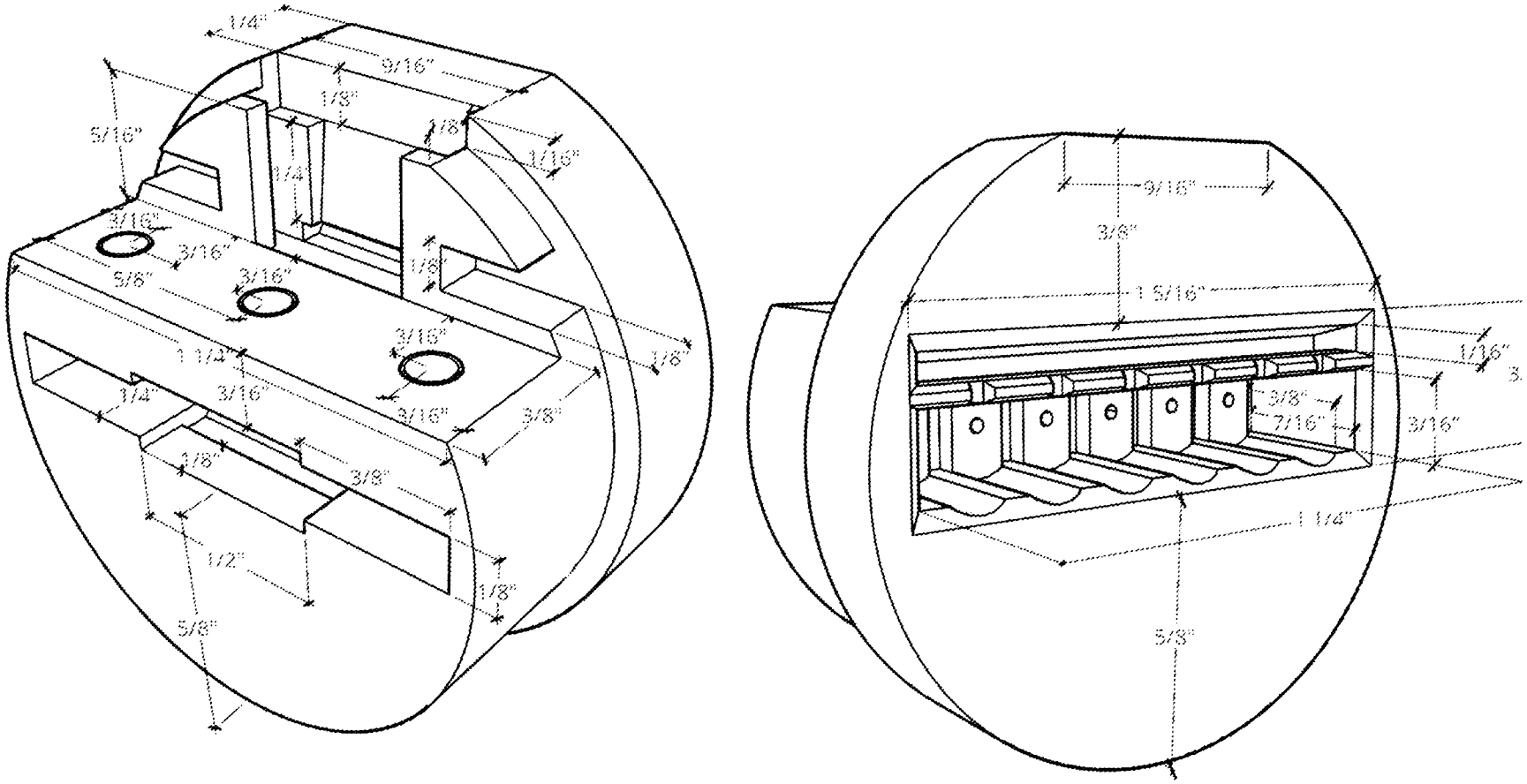

FIG. 36 details the dimensions of end cap B 130.

Figure 37:
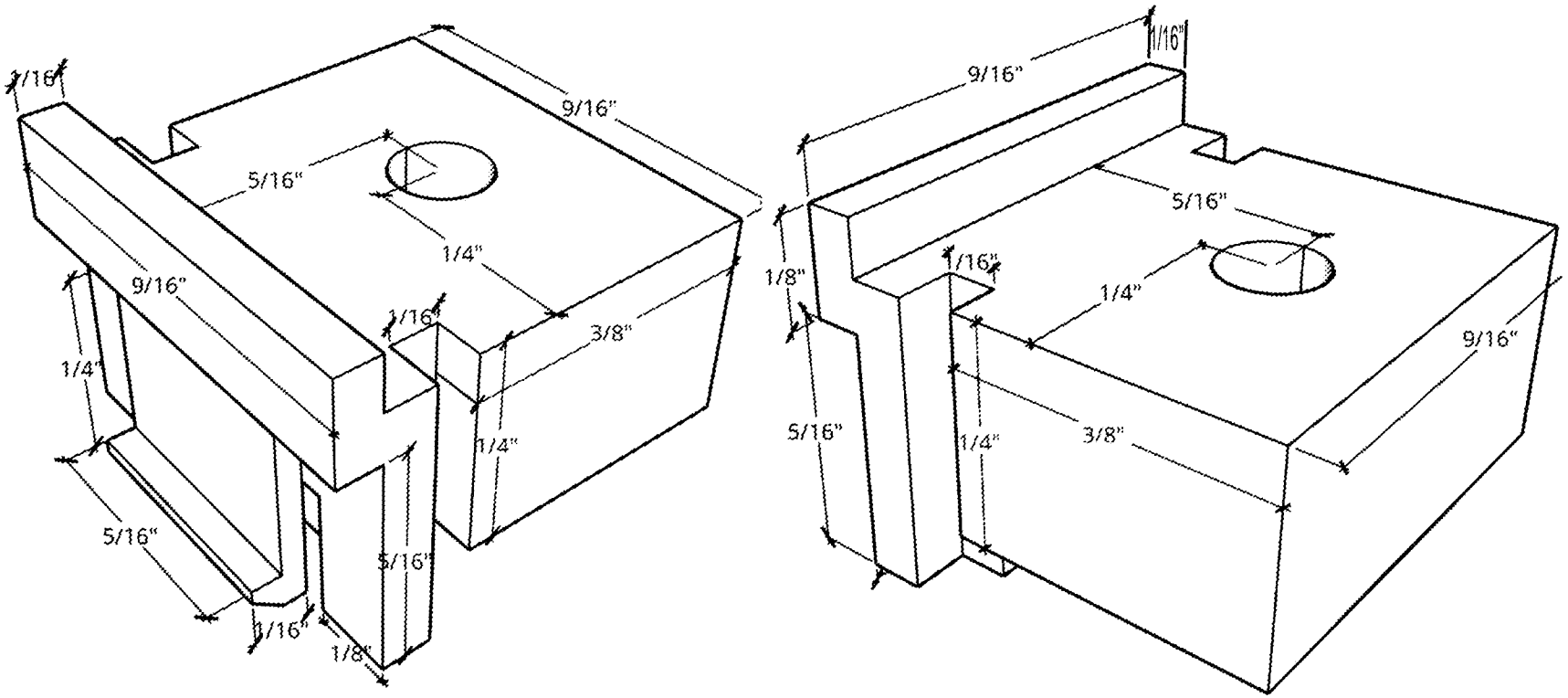

FIG. 37 details the dimensions of the tube screw retention block 50.

Figure 38:
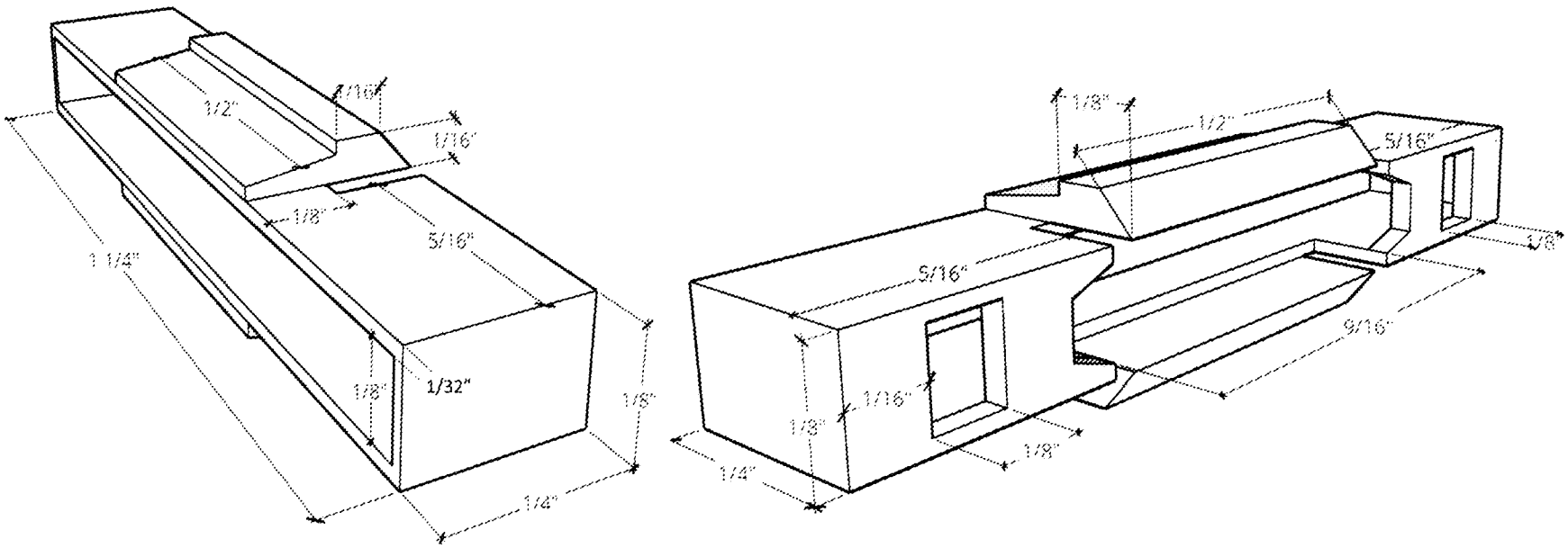

FIG. 38 details the dimensions of the contact pin retention housing 210.

Figure 39:
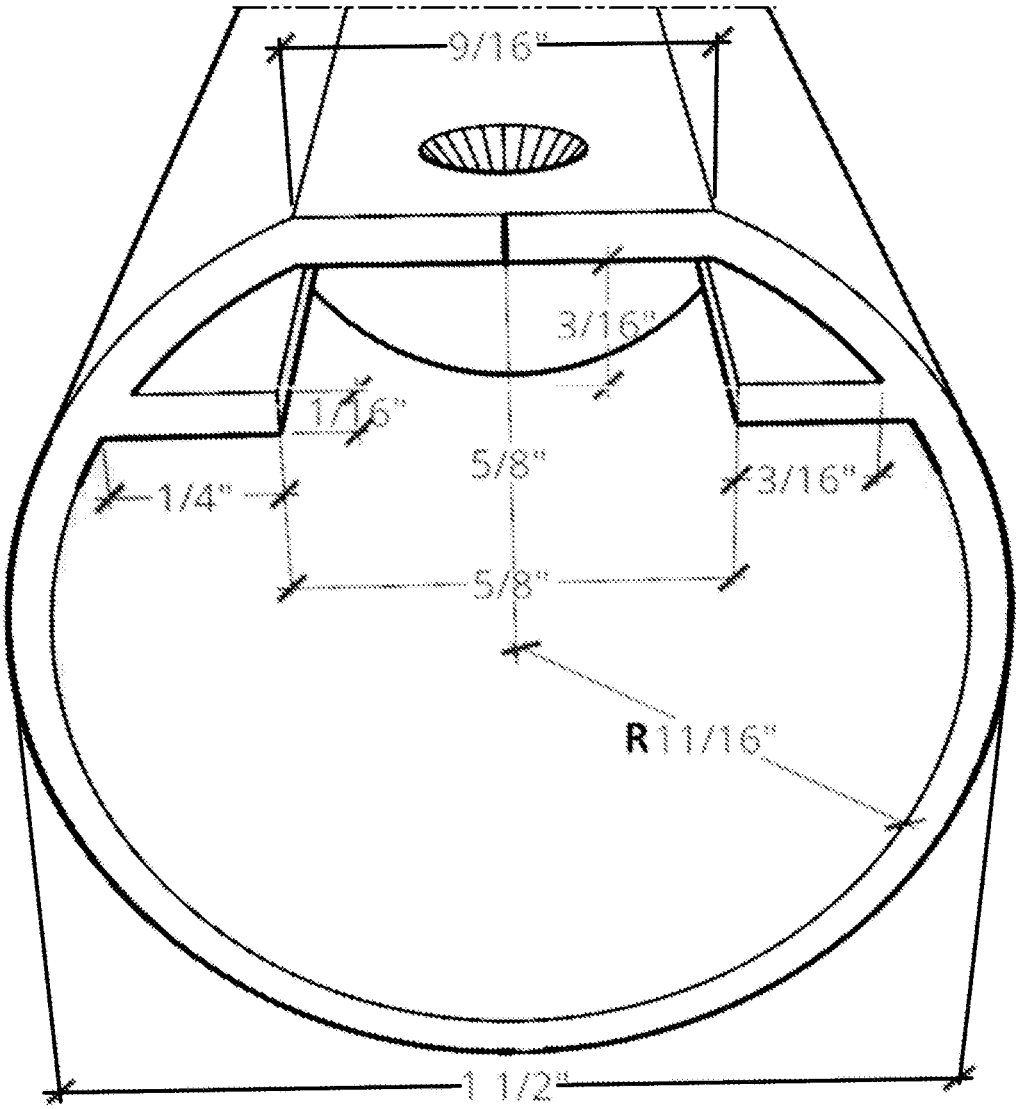

FIG. 39 details the dimensions of the tube housing 40. One line is a measurement reference for the distance between the flat spine 41 and the tube rail shelves 42. The flat spine 41 may also be referenced as a flat wall section having a wall thickness.

Figure 40:
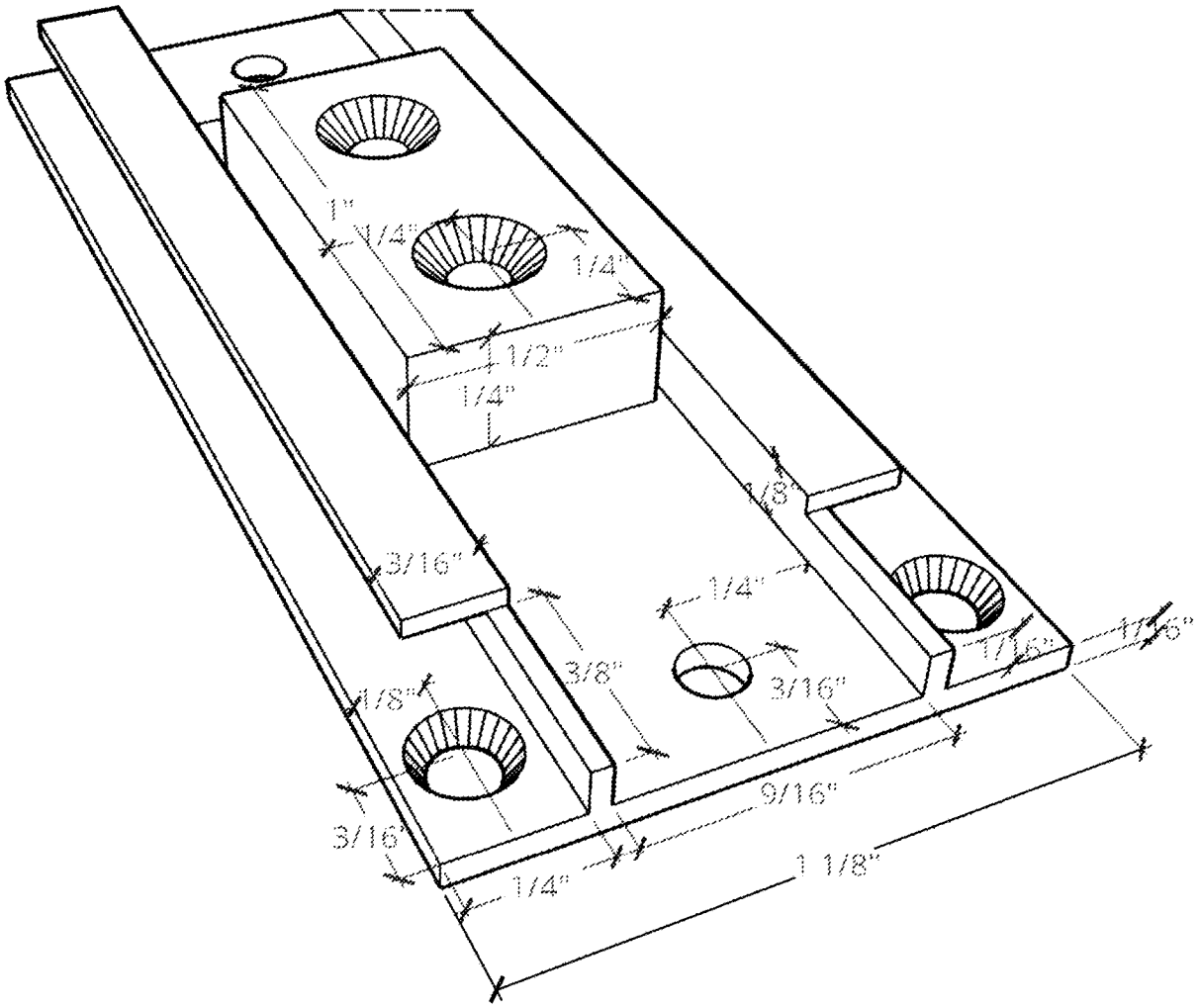

FIG. 40 details the dimensions of the aluminum rail 70 and magnet 90.

Figure 41:
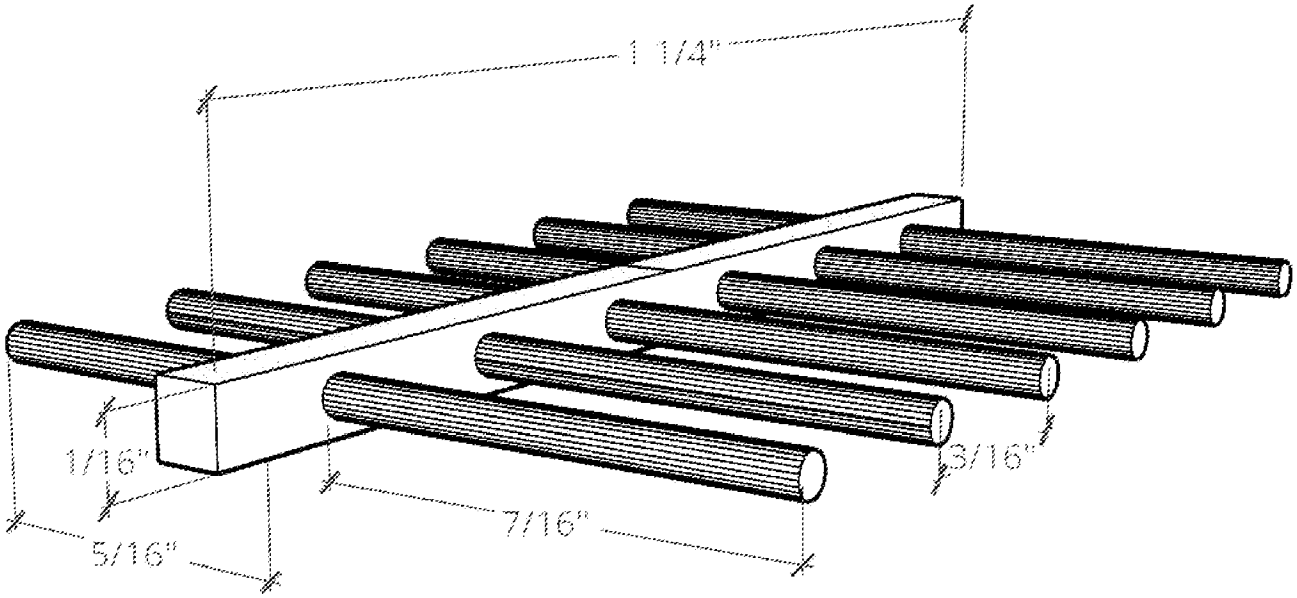

FIG. 41 details the dimensions of the contact pins 220.

Figure 42:
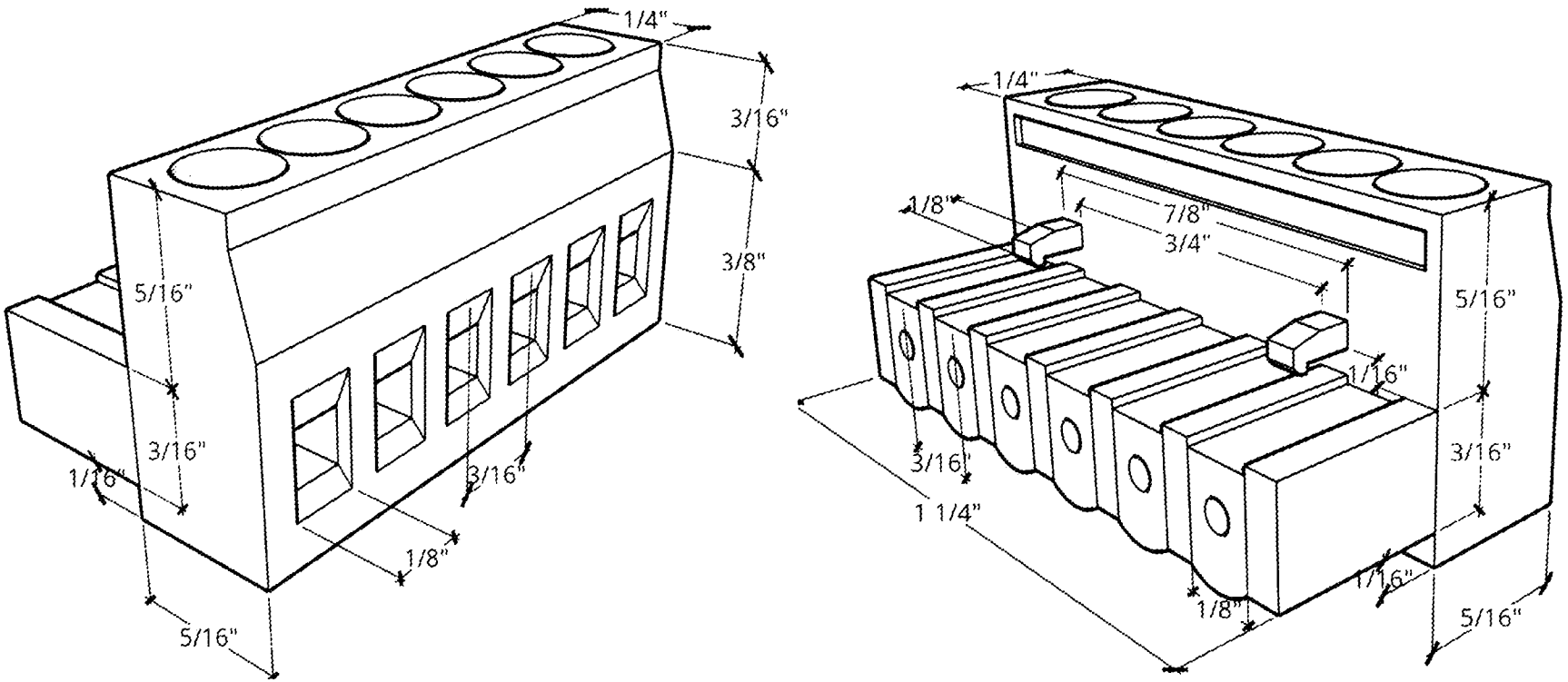

FIG. 42 details the dimensions of the female phoenix connector 200.

Figure 43:
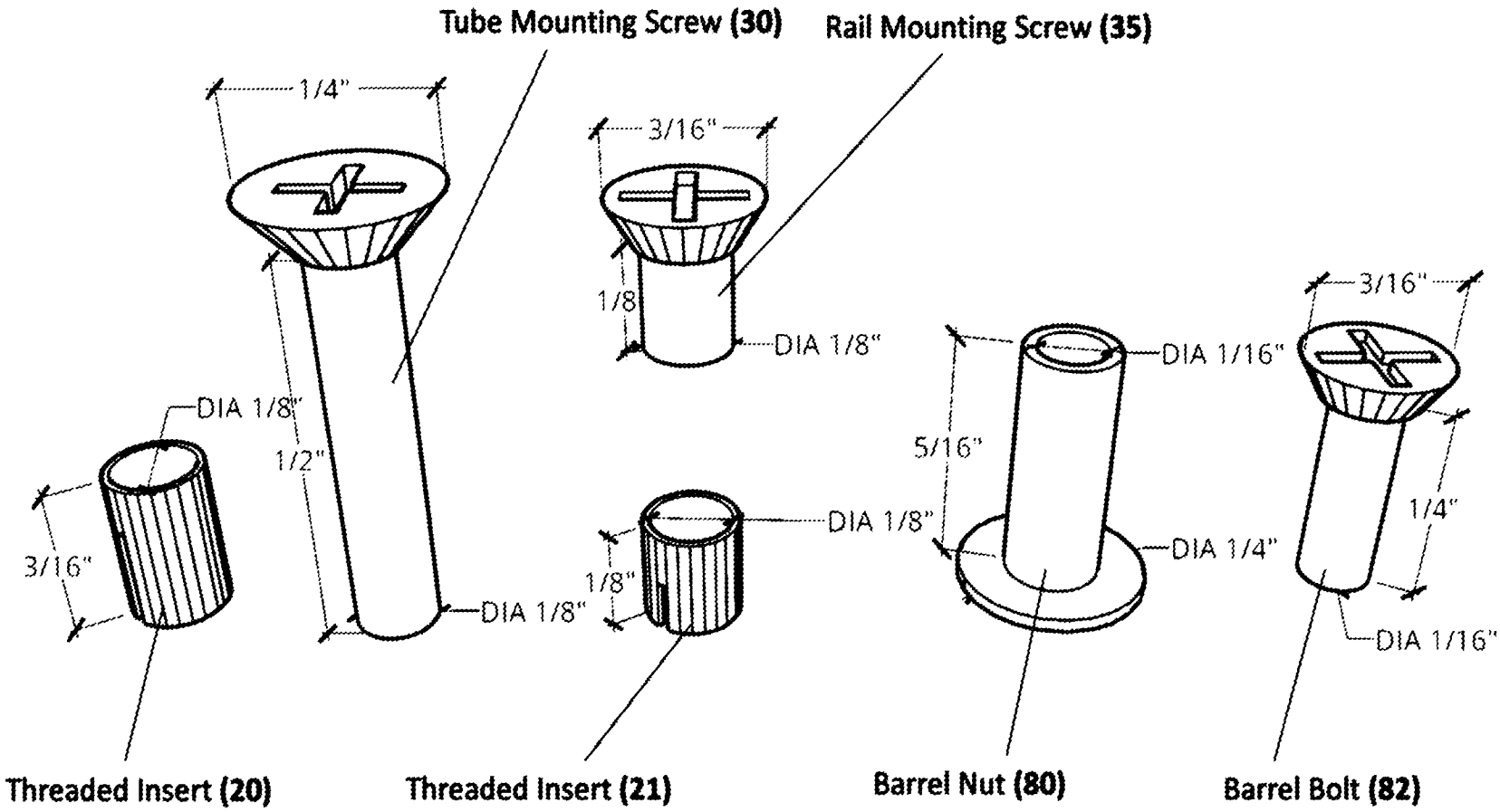

FIG. 43 detail the dimensions of screws (30, 35) inserts (20, 21) barrel nuts 80, and barrel bolt 82.

DETAILED DESCRIPTION

Introduction

The present invention now will be described more fully hereinafter with reference to the accompanying drawings, in which some, but not all embodiments of the inventions are shown. This invention may be embodied in many different forms and should not be construed as limited to the embodiments set forth herein; rather, these embodiments are provided so that this disclosure will satisfy applicable legal requirements. Like numbers refer to like elements throughout.

Reference is now made to FIGS. 1 through 22, in which like elements indicate like elements throughout the several views of apparatus 10.

ELEMENT LIST: APPARATUS 10

10. Apparatus 10
15. End Cap A (w/o connections)
20. Inserts
30. Screws
40. Oslo Tube Housing
  42 Upper Shelf
  43 Lower Shelf
  44. Slide Channel
  45. Interior Tube Gap
  46 Slot
50. Mounting Locations
60. Magnets
70. Prefabricated Aluminum H Channel

72 Small Upper Face Member
74 Large Lower Face Member
76 Spine
80. Fasteners
90. Terminal Block Housing
100. LED Ribbon
110. LED Bridge Wires
120. Terminal Block
130. End Cap B (w/connections)
200. External control wires (bare ended or stripped sheath wire)

Reference is now made to FIGS. 23 through 43, in which like elements indicate like elements throughout the several views of apparatus 10A.

ELEMENT LIST: APPARATUS 10A

1. Lighting Apparatus 10A
10. End Cap A
11. Aluminum Rail Face Shelf
12. Threaded Insert Hole
13. Tube Shelf Retention Slot
14. Interior Cap Edge Face
20. Threaded Inserts Long
21. Threaded Inserts Short
30. Tube Mounting Screws
35. Rail Mounting Screws
40. Tube Housing
41. Flat Spine (aka flat wall section in otherwise cylindrical enclosure)
42. Tube Rail Shelf
43 Countersunk Mounting Holes
50. Tube Screw Retention Block
51. Tube Screw Retention Hole
52. Alignment Rails
53. Alignment Channel
54. Locking Tab
55. Locking Tab Arm
56. Locking Tab Displacement Channel
60. Receiving Slot for Tube Screw Retention Block
61. Alignment Channels
62. Alignment Rail
63. Lock Tab Locking Shelf
64. Lock Tab Displacement Face
65. Receiving Slot Base
70. Aluminum Rail
71. Rail Screw Mount Holes
72. Tube Screw Mount Holes
72. Rail Face
74. Rail Wings
75. Magnet Mounting Holes
76. Rail Screw Wing Cut
77. Rail Channel
80. Barrel Nuts
81. Barrel Nut Head
82. Barrel Bolt
90. Neodymium Magnet
91. Countersunk Holes
100. LED Ribbon
101. Diodes
102. Solder Pads
110. LED Bridge Wires
130. End Cap B
131. Male Phoenix Receptacle
132. Phoenix Lock Tab Shelf
133. Aluminum Rail Face Shelf
134. Threaded Insert Holes
135. Receiving Slot for Contact Pin Retention Housing
136. Retention Housing Lock Tab Shelves (top and bottom)
137. Contact Pin Channel
137. Receiving Slot for Tube Screw Retention Block
138. Retention Block Lock Tab Shelf
139. Tube Shelf Retention Slot
140. Interior Edge Face
141. Contact Pin Channel
142. Contact Pin Holes
143. Locking Tab Channel
200. Female Phoenix Connector
201. Gate Port
202. Gate Screw
203. Locking Retention Tab
204. Female Contacts
210. Contact Pin Retention Housing
211. Retention Housing Locking Tabs (top and bottom)
212. Tab Displacement Channel
213. Retention Face
214. Pin Slots
215. Lock Tab Arm
220. Contact Pins
221. Pin Rail

DETAILED DISCUSSION

Intro and Background

Practical lighting is a term in film making which utilizes light sources that are seen within the frame of any given shot to light sets or actors. These light sources that are seen within the frame are called "practical lights" or "practical's." Typical examples include things like desk lamps and wall sconces. However, any light source which is established in a set or installed on location which is seen on screen is considered a "practical". Practical's are effective at establishing motivated light sources in a scene and creating a sense of realism for the audience.

Most film lighting tools are not seen on camera and are generally used to light the actors/action from off screen, we refer to these lights as film lights or set lighting, that is, lights that are off screen which shine into frame to light the actors or sets.

Film crews are broken up by many departments, most notable are camera, make up, wardrobe etc. However, we will focus on two main distinctions which do encompass many departments. The shooting crew, film crew or 1$^{st}$ unit are all descriptions of the crew that is actually doing the work of filming any given scene of action with the actors, either on location or in sets built on sound stages. The rigging crew are the people who do all the prep work for the shooting crew to film, which includes construction, lighting, creating wardrobe etc. The rigging electric crew is the prep crew that sets up and tests all the lighting gear that the shooting crew will use on the day of filming. When the shooting crew finishes filming the rigging crew then comes the day after to break down the set and rig the next one. Leap frogging every set for the shooting crew. Future discussions will focus mainly on the lighting dept known as rigging electric however some overlap is understood and won't be specified.

The Kelvin color scale is used for describing color tones which create white light in film making and will be used in this discussion. Generally, the lower the number in the scale the "warmer" or redder the color of light will be. 3200 degrees Kelvin, or 3200K, is commonly called "tungsten" and is based on the color temperature of light the element tungsten, the filament used in traditional light bulbs, will emit when electrified. The higher the number value in the Kelvin scale the "cooler" or more blue the color will be. 5600K is called "daylight" and is similar to the light emitted by the sun which reaches Earth (diffused though our atmosphere measured at high noon or when the light is parallel to the surface). Light from the sun, diffusing through more atmosphere tends to loose color value and turn reddish orange around 2900 k or so, as what happens a sunset or sunrise, typically referred to as "magic hour" in the film industry. Historically, film lights were specifically designed to create one of these color tones, either by using tungsten lamps (3200K) or HMI lamps (5600K). Early LED products also started with these two distinctions as well, technicians would have to choose LED fixtures that were either 3200K or 5600K. Next generation of LEDs could mix between the two giving technicians more options in a single package. Current LED fixtures and ribbon can mix between the two as well as add Red Green and Blue (RGB) to any color mix which can create thousands of color possibilities and new LED products are being invented every day. LED ribbon has many of these functions as well as being able to stick to surfaces via adhesive backing and rolled out like tape. Soldering end points allow for many customizable options to install into many different situations.

Lighting for film and television has become a huge market. New tools and practices always try to become more efficient, brighter and with more control over the output, specifically with regards to color temperature and dimmability. Most film lighting tools are not seen on camera. However more film crews are relying on using on set practicals, that is lights within the frame of the camera, to light the set or location as well as the actors. Every Gaffer, the head of the lighting department, or their boss the Director of Photography wants the ability to "dial in" every light on set. They want the ability to change its brightness, color, and if possible, its light quality (softness or hardness of shadows cast from the source).

With modern technology and the advent of LED lights most film lights have full control over color and brightness, especially when linked to the lighting control network DMX512 (digital multiplex) code. When lights are connected to this network, with a push of a button from a lighting control board, the board operator can send a signal to any fixture on a film set controlling its intensity, color, program lighting effects or strobes, flicker and so forth. This saves time for the shooting crew. But takes extra time and care by the rigging crew to install.

Fluorescent tubes have been around since the early 1900's and have been in film just about as long. These practical lights have long been in films, but film makers have always had to deal with the challenges they produce. Further discussion will focus on these challenges the film makers have had to overcome in the past.

Historical Issues with Traditional Fluorescent Tubes

Color of fluorescent tubes are a particular challenge to film crews. Color issues need to be solved before a film crew can shoot with traditional fluorescent lights in a scene. Standard fluorescent bulbs, to the naked eye, emits a nice soft cool white light in the 4100K color range. However, to the camera, when not corrected, they also emit a ghoulish green color. This can be corrected by the time-consuming process of "gelling" the tubes with a Magenta tinted transparent plastic film which wraps around the tube and corrects the color of the green hue, bringing it back to a neutral white color. Or they could replace the tube with a tube developed with gas specially formulated which creates either the 3200 k or 5600 k industry standard white color. Once this color is chosen the shooting crew has no option to change it on set without the time-consuming job of changing physically changing the gel or tube again.

Flicker is another issue facing film crews with traditional fluorescent tubes. In a fluorescent tube fixture, a ballast takes a standard 120 AC voltage and transforms it to a higher AC voltage (usually 240-700 volts). The igniter pins on either end of the fluorescent tube fire with a frequency (on and off) usually 50-60 times a second. This ignition reacts with the gas inside the tube which glows to emit light. Flickering occurs due to a mismatch of the tubes Frequency or Hertz to the camera's frame rate, which is the rate a film or video camera opens a internal mechanical gate to expose an image on a light reactive film or camera sensor. A camera's fame rate is typically 24 times a second. When the hertz of the ballast firing the tube and the camera's frame rate don't align a flicker or strobing effect is created on screen when played back at 24 frames a second. This is because different exposures levels are being received through the gate of the camera for every frame exposed. If the tube is in mid fire, so to speak and not being illuminated fully at the time the film or sensor is exposed, each frame will have a different exposure. Playing these different exposures back at 24 frames per second creates a flicker effect when in motion. The age of the ballast could also affect its frequency or voltage range limiting brightness or creating flicker.

Control is the next issue with fluorescents because the supply voltage from the ballast cannot be dimmed to change the light intensity as in typical tungsten filament bulbs as is the case with wall dimmer switches in residential applications. A fluorescent fixture and ballast cannot be connected into a dimmer switch or DMX network and thus the intensity of the lights output cannot be controlled or dimmed. Only a few options exist for achieving this goal, which is gelling the tube again with another film that cuts light intensity called Neutral Density (ND) or changing the tube out of its fixture for different desired wattage tube, lower wattage is lower light emission. This, however, creates a new problem as power supply ballast are typically rated for specific wattage bulbs. Most often is the case that a technician would have to change the ballast along with the tube wattage as to not damage the tube. Which means added cost for new ballasts and then re installing the old ballasts once production is finished with the shooting day. Which is why gelling is the preferred method for old school film makers. Still very time consuming and costly because gels, and the time of this writing are around 8 dollars a ft. However now the choice is to install LED tubes as a replacement. Residential and commercial LED fluorescent tube replacements are sold across the world and benefit from being ecofriendly, consuming less wattage and are longer lasting than fluorescent tubes, however the color balance needed for film lighting is so high, and the quality control of these tubes are so varied, these options are often a non-starter for film. These products are mostly non controllable or dimmable, however some are. Ballast replacements are needed to install these tubes and most require a constant voltage to work. Further discussion will focus only on LED tube style products made specifically for film lighting or event lighting which utilize DMX protocol for control, and their methods and uses in the industry.

Discussion of Existing Film Related LED Tube Style Light Fixtures

Many LED tube style products have been created for and utilized in the film industry over the previous decade. We will generally discuss the some of the pros and cons of the features of these products and the challenges film crews face when installing or using these products. Prior art will show examples what is discussed.

Appearance and Size is one concern, most of these products have bulky end caps, power and data cable connections which are large and inhibiting (as seen in the prior art section) and most tubes are wider in diameter than standard fluorescent tubes. None of these products look exactly like the product they are replacing, apart from having a long tubular face side that emits light. Most only achieve 180 degrees of light emission from this face, and if looked at from the side, only half of this fixture is illuminated the rest houses other technology. Half of the tube structure is to house the technology components within, only allowing half the tube to be a light emitting source. The length of most of these products don't reflect true fluorescent sizes and usually the length is short by 3-4 inches on either end, and when installed they appear to be "floating" in a fixture as the ends do not come close to the tombstones (the mounting and power supply contacts of traditional fluorescent tubes). These products are also wider in diameter than fluorescent tubes making it hard to install into tightly closed housings designed to fit them. Often having to modify the fixtures to fit the desired LED tube, especially if the rigging hardware is needed which adds extra bulk.

Internal Batteries and Wireless DMX Control Receivers are installed in most LED tubes on the market, which does give the user the option not to run the bulky power cables, however the batteries in these units are heavy, making the fixture awkward to install even with mounted rigging hardware. Wireless DMX control is great in theory, being able to link the tube to a transmitter via radio signal from the control board and not having to install bulky wires for control or power. However, the battery run time of these tubes, at their highest output setting (the most draw on the battery), is only a few hours at best. This technology is great for getting a shot or two in a pinch. Say needing to add one last light far off in the background to make the shot perfect. The shooting crew just would just need to mount some rigging clips, install the tube, link to the control board, set the level and then shoot the shot. This is a great selling point for these products, and for this purpose nothing can beat it. However, when the film crew is planning an all-day shoot, they don't want to spend wasted time replacing tubes in the overhead fixtures of an office building with fresh batteries every few hours, or even worse, running the risk of losing a light when the actor is giving the best performance of a lifetime. Wireless works great when your fixture is unobstructed, within line of sight and within range of the transmitter. However, once the tube is enclosed in a metal housing (creating a Faraday Cage), or set behind the concrete pillar of an underpass, the signal to the transmitter is effectively lost or connection is weak at best. As a result, rigging crews are constantly asked to run power and control cables to every tube installed in a set or location, negating the usefulness of the battery and wireless capability that technology achieves. Wiring these systems has its own set of problems which we will discuss later.

Overheating of the LED tubes with wireless DMX control and internal batteries is another battle facing rigging crews, especially if they are rigged into airtight housings or set pieces with no air circulation. With all the technology installed in the tube housing itself, heat becomes a problem for sensitive computer chips. Most of these tubes will shut down to protect components, or lose data signal, or otherwise flicker or flash randomly if overheated.

Accessibility for trouble shooting. When problems arise, rigging crews must trouble shoot these issues, this is always part of the job. However, some products seem to add to the stress rather than alleviate it. When all the manual control elements of a fixture are built into the fixture itself, when things go wrong you need to get to that fixture to troubleshoot it. This means that when these tubes are built into a set piece, disassembly of set pieces must happen to gain access to the tube for inspection. When tubes are mounted to lighting rigs high above a set, and things go wrong, the technician must get into a lift and navigate their way up to the rig to inspect and diagnose the issue.

Rigging Hardware is usually screwed or bolted into whatever surface it's being rigged to, whether it is the metal housing of a lighting fixture, using self-taping screws or into premade set wall channels or other mounting surfaces. This hardware then friction holds or clamps to the outside of the LED tubes, holding them in place. Rigging hardware is often hard to conceal and is usually seen by camera when installed in open fixtures, not hidden by diffusion panels or lenses. Screwing and drilling into fixtures or walls of real locations will cause permanent damage and is costly to repair, plus reduces the willingness of the owner to allow film crews back into their property.

Proprietary Wiring of these systems makes customization difficult. As technicians scout a new location, being flexible is key to being a successful rig. What worked great for one location won't necessarily be the case for the next. Sometimes many tubes will be wired within feet of each other, in other, hundreds of feet could be separating them. Sometimes it would be nice to hide a controller up high controlling 4 tubes, while also rigging a different controller low with other 6 others 50 ft away in a back room. But with most of these systems you are limited with your reach and effectiveness to run separate spots based on what comes in a kit, forcing you to order many different kits accomplish the job of one. The LED systems used today each use their own proprietary cables and ports to connect their tubes to their charging/control stations/controllers. Each one has a maximum length they can run. Some only come with one control module for a set of 10 tubes from the rental house, and the length between those cables is only 50 linear feet. Some have power cables which also run data in the same line, some do not. Again, most have all their wireless DMX control components in the tubes and only need power run to them but then have power adapters that need to be installed to change the AC power to DC to run the tubes. Most of these tubes have been used for many years and the ports are wearing out, cables past their prime and not connecting to the ports they are meant to connect with. Thus, creating data connection issues, creating errors in the color, timing issues with lighting cues, or power drain and charging issues. In all these cases, there is nothing the technician can do to service these faulty tubes and cables except return faulty equipment to the rental house and wait for a new one to be delivered. Some older style tubes function with dimmable AC power and can be installed with ungrounded 18/2 AWG lamp cord commonly called "zip cord". This adds to the customization because you can cut cable runs to length and install quick on plugs to plug in your lights. However, when not installed properly, not paying attention to polarity, can result in flicker problems of the lights when dimmed and even shock or fire hazards. All these different restrictions come into play with little time to figure it out before the shooting crew arrives expecting everything lit up and ready to go.

Summary of Concepts

The goal of this invention was to address the challenges outlined in previous discussion regarding traditional fluorescent tubes and current LED fixtures on the market. The present concepts include apparatus 10 and 10A both include a lightweight, magnetic, light diffusing housing for LED ribbon which is designed to look like a standard fluorescent tube in a practical lighting video filming application. A tube housing that is easily serviceable for the technician, who can install any LED ribbon of their choosing. A tube that mounts magnetically without any intrusive rigging hardware into most fluorescent housings, creating no damage to the existing fixture. A fixture that can be wired with any length of multiconductor wire of appropriate gauge relative to the amperage needs of the LED ribbon. Control wires can be easily and repeatedly removed or connected via either the discreet terminal block or an industry standard phoenix connection port, housed discreetly one of either apparatus two end caps. Utilizing external DMX control modules for ease of access and trouble shooting from the ground and the ability to customize installation of systems based on the needs of the rig.

Issues of Historical Fluorescents Addressed by Apparatus 10 and 10A

Color is chosen and installed by the end user of apparatus 10 and 10A. LED ribbon is manufactured in multiple sizes and voltages from various manufacturers.

Flicker is controlled by plugging apparatus 10 and 10A into external DMX control modules which utilize a high frequency, constant current, PWM dimming system. (Pulse Width Modulation) This system ensures a dimming curve which seamlessly matches with any camera frame rate, with no flicker during playback.

Control by using external DMX control modules, linked to the lighting control board, the board operator has full control of color, brightness, and lighting effects.

Issues of Existing LED Fixtures Addressed by Apparatus 10 and 10A

Appearance and Size Apparatus 10 and 10A is designed to look like a traditional fluorescent tube. The length is just shy of standard tombstones in traditional housings, within one and a half inches between each end cap and tombstone without phoenix connector installed. Width is very similar to that of a fluorescent tube. End caps are slim and flush with the tube housing, and the connector port is discreetly molded into one end cap. The white diffused housing has the appearance of glass in a traditional fluorescent tube while being structurally strong and less fragile. As noted in FIG. 33C, apparatus 10 and 10A achieves a 240-degree angle of illumination whereas previous LED tubes only can manage 180 degrees of light output. This is due to apparatus 10 and 10A having no internal batteries or onboard computers. The space taken up by these elements in previous LED style tubes is utilized in apparatus 10 and 10A for light output. Yet again creating a more realistic, fluorescent tube replacement viewed from many angles of view.

Internal Batteries and Wireless DMX Control Receivers Apparatus 10 and 10A has no internal batteries nor wireless DMX control technology in its housing. All control and power are external, which allows the housing to be lightweight and slender in appearance. Wireless control can still be achieved by connecting radio receivers to the DMX control module, completely external and separate from apparatus 10 and 10A. Controllers with wireless receivers can be rigged within range of the board transmitter while apparatus 10 and 10A rigged out of range but can still be connected via control wires to the control module.

Overheating Because the power and control are external, overheating of apparatus 10 and 10A is not an issue. No computer components are installed in the apparatus, so heat retained inside its housing does not affect control. The aluminum rail inside the housing does act as a heat sink, dispersing any heat generated by the LED ribbon, as well as a rigging platform for the magnets inside. Temperatures on the exterior of the tube when testing various ribbons never exceeded 100 degrees Fahrenheit in open, ventilated fixtures.

Accessibility Since the DMX control modules and power supplies are external from the tube, any trouble shooting of the system control can be done without the need to access apparatus 10 and 10A while rigged. Should the need arise to trouble shoot apparatus 10A for example, unplugging the phoenix control wires and pulling the tube from the housing is very easy. Should the need also arise to service inside apparatus 10 or 10A or change its ribbon within, this can easily be achieved by removing the mounting screws and pulling the components out from the housing. Other manufactured LED tubes are not serviceable and sealed units.

Rigging Hardware is not necessary for apparatus 10 and 10A in most applications. Leaving the existing housing undamaged during and after installation. If the need does arise where apparatus 10 and 10A needs to be rigged into nonmagnetic material, it fits in standardly utilized rigging hardware.

Proprietary Wiring is not the design choice of apparatus 10 and 10A rather giving the end user the freedom of utilizing their own means of cable distribution. Apparatus 10 offers gated port terminals to which the user can attach multiconductor wiring for control. Apparatus 10A implements the use of the phoenix connection system as the primary connection port, which is a widely used system for LED purposes in the film industry, these features make either apparatus very customizable and film friendly. Many crews already have these connectors in their tool kits. The phoenix terminal connection is reusable because of its screwed clamping gate port system. Bulk multiconductor wire known as Belden or security wire comes in many gauges and conductors and is sold in spools of 250 ft to 1000 ft. Technicians can decide its length, orientation, and application. Clamping the unsheathed wires into phoenix connectors or the terminal blocks allows for many different uses and applications, for example, creating wire harnesses for multiple fixtures fed by one control or "trunk line". Four apparatus in one fixture housing could easily be run from one main control multiconductor cable coming into the housing, jumped between the apparatuses in the fixture by wiring one to the other via the phoenix connection. Or all apparatus in the fixture could be individually cabled if the situation demands it, running a trunk line for each apparatus. Apparatus 10 and 10A are designed to be used in a customizable system created by the end user or technician as the situation presents itself.

Basic Construction and Operation of Apparatus 10

The present invention relates to a method and use of apparatus 10 for film and television lighting. The present concepts include apparatus 10 which includes a lightweight, magnetic, light diffusing housing for LED ribbon which is designed to look like a standard fluorescent tube in a practical lighting video filming application. A tube housing that is easily serviceable for the technician, who can install any LED ribbon of their choosing. A tube that mounts magnetically without any intrusive rigging hardware into most fluorescent housings, creating no damage to the existing fixture, but also be able to use existing rigging hardware when needed.

The Apparatus 10 includes the following general components

10. Apparatus 10
15. End Cap A (w/o connections)
20. Inserts
30. Screws
40. Oslo Tube
60. Magnets
70. Prefabricated Aluminum H Channel
80. Fasteners
90. Terminal Block Housing
100. LED Ribbon
110. LED Bridge Wires
120. Terminal Block
130. End Cap B (w/connections)

Generally described, apparatus 10 includes a tube housing 40 a $1/16^{th}$ inch thick polycarbonate tube with opposing interior slide channels 46 in the interior which accept a portion of an aluminum H channel 70. The channel includes magnets 60 adhered to its top side and LED ribbon adhered to its downwardly facing underside. Once the channel 70 is inserted into the tube 40 and the end caps 15, 130 are installed, the apparatus 10 looks like a standard flourecent tube in a practical lighting video filming application. One end cap 130 houses a terminal block screwed gate system which allows the user to clamp in the externally connected control wires necessary (bare ended or stripped sheath wire) to light the tube apparatus easily and repeatedly with out damage to the ribbon inside.

More Detailed Construction and Operation of Apparatus 10

Here follow more details of apparatus 10. This will be done by describing the detail of the various elements of FIG. 1 through FIG. 22 as well describing their fit and function as they relate to the whole. A detailed listing of components will be referenced from the complete Apparatus 10 elements list.

FIG. 1 is an exploded view of apparatus 10, showing its multiple components.

FIG. 2 is a pictorial view of Apparatus 10, showing its two ends A and B. Proximate each of said ends A and B are corresponding end caps 15 and 130. End cap 130 is the cap including wiring shown also in FIG. 3. End cap 15 at end B does not include wiring.

FIG. 2 is a pictorial view of Apparatus 10, showing its two ends A and B. Proximate each of said ends A and B are corresponding end caps 15 and 130. End cap 130 is the cap including wiring shown also in FIG. 3. End cap 15 at end B does not include wiring.

FIG. 4 is a partial view of Apparatus 10, showing the "upper" side of its end A, showing the two screws 30 which attach the end cap to the Oslo tube 40 as well as the end cap 15, as described in further detail below.

FIG. 5 is a view similar to that of FIG. 5 except that the end cap 15 has been removed from the main assembly 10, by removing the machine screws 30 and pulling out the end cap 15. Shown installed are two threaded inserts 20 which accept the machine screws 30, and are configured to frictionally engage holes drilled in the end cap 15, such that the end cap may be selectively attached in place by the screws 30 (not shown in FIG. 5). The axis of one of the two holes is shown with a dotted line.

End Cap 15 is configured to attach to one end of the Oslo Tube 40, and to close that end of the tube 40. End cap 15 consists in one embodiment of a cured, opaque, two-part epoxy resin which is extracted from a silicone mold. Circular disk OD 1.5" diameter, with ⅛" lip forms the exterior, while an inner ⅜ "shelf and alignment key are inset by 1/16" from the diameter.

End cap 15 seats inside the Oslo tube 40 with its upper key 96 (see briefly FIG. 16) aligning with the interior tube gap 45 of the Oslo tube 40 (see briefly FIG. 8). Interior shelves on Side A the Oslo tube 40 have holes drilled therein which allow screws to extend therethrough to accept threaded Inserts 20 on either side of the upper key of the End Cap 15. This allows the screws 30 to attach the end cap 15 to the Oslo tube 40.

Threaded inserts 20 (see FIG. 6) are press fit into the resin endcaps 15, 130, which allow engagement with threaded machine screws 30. In one configuration they are M3×6 mm×0.5 threaded inserts.

Screws 30 are configured to engage the threaded inserts 20. When assembled they are inserted through holes drilled into the Oslo Tube 40 shelf via the ¼ Inch wide channel cut into the Oslo Tube 40. The machine screws 20 are then screwed into the two inserts 20 press fitted into the resin end caps shelves, thus securing the end caps 15, 130, to their respective ends of the Oslo tube 40. In one embodiment the screws 20 are M3×6 mm×0.5.

Oslo tube 40 is a generally tubular member which simulates the outside circumferential shape of a conventional elongate florescent light. FIGS. 7A and 7B are illustrative transverse cross sections of the Oslo tube 40. FIG. 7A shows the Oslo tube 40 with its interior upper shelves 42 and interior lower shelves 43. Each of these interior shelves runs the length of the tube 40 (with the exception of certain parts cut out as discussed elsewhere). The upper and lower shelves combine to create two elongated slide channels 44, each of which is configured to accept an elongate side edge of the upper face member 72 of the channel, as shown in FIG. 7B.

FIG. 8 shows some typical dimensions of the Oslo tube 40, but these should not be limiting. Note that the "interior tube gap 45" which is shown as 13 mm in drawing is the gap into which the upper key 96 of the terminal block housing 90 fits when installed. This same gap 44 is the gap into which the upper key 136 of the terminal block housing 130 fits when installed.

FIG. 9 shows the Oslo tube 40, with holes and shelves as discussed elsewhere.

FIGS. 10A-C are various views showing how the end caps are attached. FIG. 10A shows End A of the apparatus 10, showing the end cap 15 in place, with a screw 30 being prepared to be installed into a threaded insert 20 in the end cap 15 to secure end cap 15 relative to the Oslo tube 40. FIG. 10B shows End B of the apparatus 10, showing the Oslo tube in isolation, with an access slot 46 being cut therein in to enable the drilling of holes in the lower interior shelf of the Oslo tube 40. FIG. 10C shows End B of the apparatus 10, showing the end cap 130 installed, and showing a screw 30 being installed into a threaded insert 20 (press fit in a hole in the end cap 130). It should be understood that the screw 30 in this configuration may be of a different length than the one in FIG. 10A, depending on the application).

On End (A) of the Oslo tube 40 two ¼" holes are notched ⅛" from the end of Side A. Holes are dilled through the interior shelf on either side to align with the resin End Caps and their M3 inserts 20. On End (B) of the Oslo tube 40 a ¼" inch slot 46 (see FIGS. 10B and 12) is cut perpendicular to the interior tube gap 45 running the length of the Oslo tube 40, ⅛" in from each end which exposes the rail shelf inside.

This interior tube gap 45 also allows wire access (bare ended or stripped sheath wire) to the ports on the terminal block housed in End Cap (B).

Magnets 60 are configured to provide an attachment of the overall apparatus 10 to an external ferrous element, such as the inside of a conventional florescent lighting housing.

FIG. 11 is a view showing an Oslo tube 40 having channel 70 installed in its interior. This figure also shows the upper small face member 72 and the lower larger face member 72. Also shown here is a transverse slot which has been cut into channel 70, such that a magnet 60 can be installed into the slot in the channel.

FIG. 12 is a view similar to that of FIG. 11, except that a magnet 60 has been installed therein.

In one embodiment, three Neodymium magnets are glued to the channel via the transverse slots in the small face side of the channel 70, are rated at a 20 lbs pull each, and have the dimensions 1"×½"×¼". Other embodiments could include securing the magnet with barrel nuts and bolds through counter sunk holes in the magnet.

FIG. 13 is an illustrative view of the Oslo tube 40, showing the LED ribbon 100 installed on the typically downwardly facing lower surface of channel 70.

Channel 70 is configured to support the LED ribbon 100 in a spaced apart relationship to the interior of the Oslo tube 40. A detailed transverse cross section of Channel 70 is shown in FIG. 14. FIG. 14 shows channel 70, which includes a large lower face member 74 having a one 1.25" wide face side and a smaller 0.625" upper face member 72 separated by a 0.10" spine 76 down the middle. These dimensions are exemplary only and should not be considered exclusive or limiting.

The small face of elongate channel 70 mates with the interior elongate channel of the Oslo tube 40 and runs the length of the Oslo tube 40 between the two endcaps 15, 130. This rail dissipates heat, creates the structure which the LED Ribbon 100 adheres to the large face side, and houses the magnets 60 on the smaller face side. Three 1" long 0.10"" deep magnet slots are cut from its small face side, perpendicular to its length. One is centered on the length of the rail, the other two on each end 4" from the end of the rail. These magnet slots allow three (3) magnets to be glued per rail.

FIGS. 15A-C are sequential illustrative views of the assembly of the LED Ribbon 100, channel 70, and magnet 60. FIG. 15A shows the LED Ribbon 100 being attached to the underside of channel 70, and the magnet 60 (shown in dotted line) in place atop channel 70. FIG. 15B shows the LED Ribbon 100 attached to the underside of channel 70, and the magnet 60 in place atop channel 70. FIG. 15C shows the assembly shown in FIG. 15B installed within the interior of Oslo tube 40.

Fasteners 80 are configured to fasten the terminal block housing 90 to end cap 130, by screwing into M3 inserts pressed into the plastic housing 90. In one embodiment, they are M3×12 mm×0.5 bolts.

Terminal Block Housing 90 is configured to support terminal block 120 relative to end cap 130. The housing 90 mates to the interior side face of End Cap 130, such that this mating connection is made within and is concealed by the Oslo tube 40.

FIG. 16 is a view of the terminal block housing 90, showing the terminal block housing access port, and the upper key 96, which when installed locates itself between the "interior tube gap 45" which is between the two opposing interior channels of the Oslo tube 40. Also shown is the lower key 98 which mates with the lower key slot 138 defined by the end cap 130.

FIG. 17 is a view of the end cap 130, showing the end cap access port as well as the upper key 96 which when installed locates between the "interior tube gap 45" which is between the two opposing interior channels of the Oslo tube 40. FIG. 8 shows some typical dimensions of the Oslo tube 40, but these should not be limiting. Note that the "interior tube gap" which is shown as 13 mm in drawing is the gap into which the upper key 96 of the terminal block housing 90 fits when installed. This same gap is the gap into which the upper key 136 of the terminal block housing 130 fits when installed.

Also shown is the lower key slot 138 which accepts the lower key 98 of the terminal block housing 90 when the elements 90, 130 are fastened together.

FIGS. 18A-B are sequential assembly views showing the attachment of the end cap 130 to the terminal block housing 90, in the process capturing the terminal block therebetween. FIG. 18A shows the terminal block in position before the end cap 130 is attached to the terminal block housing. This figure shows one screw 80 which will eventually have its free end engaging the end cap 130, thus fastening the end cap 130 to the terminal block housing 90. FIG. 18A shows the configuration "turned over" in an upside-down configuration in order to show the two screws 80 which will eventually have their free ends engaging the end cap 130, thus fastening the end cap 130 to the terminal block housing 90. In this configuration the terminal block is captured by the end cap 130 and the terminal block housing 90.

FIG. 19 shows the elements of FIG. 18B in their generally upright configuration, with the end cap 130 attached to the terminal block housing 90. In this configuration the terminal block 120 is captured by the end cap 130 and the terminal block housing 90.

The semi-circle, flat faced side of the housing 90 is ¾" thick and 1¼" in diameter. Its upper alignment key 96 matches the interior tube gap 45 of the Oslo tube 40. Two shelves, which house two M3 threaded inserts, extend ¼" out from the housings back flat face and mate with the back face of End Cap (B). Below these two shelves are a set of holes drilled perpendicular to the housings front face to allow an M3×12 mm bolt to pass thru and join the housing to the End Cap (B) Between the extended shelves is an access port through the face which allows access of pins from the terminal block to pass through. Below this access port is an lower alignment key 96 which extends from the back face of the housing that mates with the shelf of the End Cap (B). When joined with the End Cap (B) the housing cradles the Terminal Block within the End Cap allowing wires to be soldered to bridge the LED Ribbon 100 and the terminal block 120.

The housing 90 consists of a fully cured, clear, two-part epoxy extracted from a silicone mold. Clear resin is required to limit the shadow created by this housing. Light bounces through and does not appear as dead space when illuminated.

LED Tape Ribbon 100 is configured to provide lighting withing the apparatus 10. In one embodiment, ribbon 100 is premanufactured LED Tape Ribbon, including LED diodes circuited into linear ribbon. When installed via adhesive backing, the ribbon 100 is attached to the large face of the aluminum channel, which is typically facing downward when installed.

LED Bridge wires 110 (See FIG. 18B) are wires which extend from the LED ribbon 100 to the terminal block 120, providing electrical connection (including signaling) therebetween. In one embodiment they are 22 AWG Wires soldered at one end to the LED Ribbon 100, then soldered at their other ends to the terminal block 120 pins.

Terminal block 120 is configured to provide a detachable electrical connection between external wiring such as external wiring 200 and the LED tape ribbon 100. 5 mm pitch Side Entry. Consisting of metal pins which extend from a bonded socket, each socket utilizes a gate which screws which clamp shut.

End Cap 130 is configured to attach to the one end of the Oslo tube 40 and close said end (End A, see FIG. 2). It also combines with the terminal block housing 90 to capture and secure the terminal block 120 therebetween.

This cap 130 is attached to the terminal block housing via fasteners 80 (See FIG. 1). M3 threaded inserts, and together rests inside the Oslo Tube Housing with the key aligning with the interior channel of the Oslo Tube.

FIG. 21 is a view of End B of assembly 10, showing the end cap 130 attached to the Oslo tube 40. Also shown is the end cap access port in the end cap 130. This end cap access port allows for the manipulation of clamping screws in the terminal block 120, such that the screws can be screwed in or out in order to secure or release external control wires 200 (bare ended or stripped sheath wire) relative to the apparatus 10.

FIG. 22 is a view of End B of the assembly 10, showing the end cap 130 attached to the Oslo tube 40. Also shown is terminal block 120, viewable though a slot provided in the Oslo tube 40. This slot allows for external control wires 200 (bare ended or stripped sheath wire) to be connected to the terminal block 120, such that its clamping screws can be screwed in or out in order to secure or release the external control wires 200 relative to the apparatus 10.

As shown in FIG. 21, an access port through the face of the cap 130 allows access to the gate clamping screws of terminal block 120. The ports face towards the Oslo tube 40 interior. External control wires 200 (bare ended or stripped sheath wire) have access to the ports through the channel cut in the Oslo tube 40. This allows for quick and secure wiring of tails to the unit. External control wires 200 then run to DMX Controllers and power supply to run the LEDs within. consisting of a cured opaque two-part epoxy resin, extracted from a silicone mold.

External control wires 200 (bare ended or stripped sheath wire) can be 18-22 AWG gauged wire to be inserted and clamped to make semi-permanent connection with each corresponding power and data channel on the LED ribbon. This allows 18-22 AWG gauged wire to be inserted and clamped to make semi-permanent connections with each corresponding power and data channel on the LED ribbon.

Basic Construction and Operation of Apparatus 10A

The present invention relates to a method and use of apparatus 10A for film and television lighting. The present concepts include apparatus 10A which includes a lightweight, magnetic, light diffusing housing for LED ribbon which is designed to look like a standard fluorescent tube in a practical lighting video filming application. A tube housing that is easily serviceable for the technician, who can install any LED ribbon of their choosing. A tube that mounts magnetically without any intrusive rigging hardware into most fluorescent housings, creating no damage to the existing fixture, but also be able to use existing rigging hardware when needed.

The Apparatus 10A includes the following general components:

1. Apparatus 10A
10. End Cap A
20. Threaded Inserts
30. Tube Mounting Screws
35. Rail Mounting Screws
40. Tube Housing
50. Tube Screw Retention Block
60. Receiving Slot for Tube Screw Retention Block
70. Aluminum Rail
80. Barrel Nuts
90. Neodymium Magnet
100. LED Ribbon
110. LED Bridge Wires
130. End Cap B
200. Female Phoenix Connector
210. Contact Pin Retention Housing
220. Contact Pins Generally described, apparatus 10A includes a tube housing 40, with a flat spine 41 (aka flat wall section), made from a $1/16^{th}$ inch thick white diffused, polycarbonate tube which includes opposing interior shelves 42 on the interior which accept a portion of an aluminum rail 70. A channel of this rail 70 includes magnets 60 secured to its top side between rail wings 74, and LED ribbon 100 of the end users choosing adhered to its downwardly facing, underside rail face 72. Once the rail 70 is inserted into the tube housing 40 and the end caps A 10 and B 130 are installed, with tube mounting screws 30, the apparatus 10A looks like a standard flourecent tube in a practical lighting video filming application. End cap B 130 houses a male phoenix receptical 131 which mates to an industry standard female phoenix plug 200. A standardized system which utalizes a screwed gate ported plug and mating receptacles to allow the user to clamp external control wires into a plug then insert them into the recptacle housings, easily and repeatedly with out damage to the ribbon inside. The apparatus 10A is configured to be attached via magnetic attraction to a downwardly facing flat horizontal surface of an overhead member (not shown) which in practice is often the interior top panel of an existing florescent light assembly that has had its florescent light tubes removed, leaving a metal fixture enclosure behind. The interior of the enclosure includes a downwardly directed metal interior top panel wall which is attracted by the magnets of the apparatus 10A.

More Detailed Construction and Operation for Apparatus 10A

Here follow more details of apparatus 10A. This will be done by describing the detail of the various elements of FIG. 23 through FIG. 43 and also describing their fit and function as they relate to the whole. A detailed listing of components will be referenced from the complete Apparatus 10A elements list.

FIG. 23 is an exploded view of apparatus 10A, showing its multiple components. Length of apparatus 10A will be manufactured for a variety of typical fluorescent tube lengths. 2 Ft, 4 Ft or 8 Ft length are standard fluorescent sizes. However, these dimensions are exemplary only and should not be considered exclusive or limiting. Representations shown in all figures will be in a condensed fashion for illustration purposes.

FIG. 24 is a pictorial view of Apparatus 10A, showing its two ends A and B. Proximate each of said ends A and B are corresponding end caps A 10 and B 130. End cap B 130 is the cap including the male phoenix receptacle 131 shown also in FIG. 25. End cap A 10 does not include this receptacle. Tube Housing 40 is a white diffused, translucent polycarbonate tube housing which allows light to emit through its surface while diffusing the LED source within while also concealing the "hot spots" or points of light of each diode embedded in the LED ribbon 100. When illuminated, the tube emits a bright diffused source of light from its tube housing 40. Tube mounting screws 30 are installed connecting both end caps A 10, and B 130 through the flat spine 41 of the tube housing 40. The flat spine 41 also provides a stable mounting platform with a large surface area for the magnetic adhesion of the magnets 60 within and prevents rolling of the tube once mounted in a downwardly facing flat horizontal surface of a light fixture.

FIG. 25 is a full view of Apparatus 10A, focusing on End B, which shows where the premanufactured, external female control wire connecter, commonly known as a phoenix connector 200, connects to the apparatus 10A via the male phoenix receptacle 131. The arrow shows the travel of connector during insertion. Once inserted into the male receptacle, unsheathed ends of external control wires (not shown) which are clamped inside gated ports 201 via the gate screw 202 of the female connector 200, contact the male contact pins 220 of the male receptacle via the female contacts 204 (shown in FIG. 26) This connection of the plug to the port creates the circuit for controlling the LED ribbon externally. The control wires connect to DMX controllers and power supplies which feed the tube its data and power. Control wires can be easily hidden behind set walls or in drop ceilings of location rigs. FIG. 33A will show the internal connections made from the contact pins 220 to the LED ribbon 100.

FIG. 26 is a close-up view of End B with end cap B 130 and female connector 200. A locking shelf 132 is recessed just above the male receptacle 131 in end cap B 130 which allows the retention tab 203 of the female connector 200 to grab and retain itself to the end cap B 130 which also allows male contact pins 220 to insert into female contacts 204 thus contacting the external control wires. This creates a semi-permanent wire connection between the control wires and apparatus 10A.

FIG. 27 Shows the components that are released once the tube mounting screws 30 are unthreaded from threaded inserts 20 and 21 and removed from countersunk mounting holes 43 in the flat spine 41 of tube housing 40. Tube mounting screws 30 also release the following components once removed: retention holes 51 of each end caps tube screw retention block 50 and tube screw holes 72 in the A and B side of aluminum rail 70. (Shown in more detail in FIG. 28A and FIG. 28B). Arrows show the motion of travel for each component when released. Once the tube mounting screws 30 are removed, end cap A 10 can be removed from the tube housing 40 and the aluminum rail 70 which mates with the rail face shelf 11 of end cap A 10. End cap B 130 is attached to the aluminum rail 70 via rail mounting screws 35 which are threaded into the press fit threaded inserts 20 seated in threaded insert holes B 134 of end cap B's rail face shelf B 133. (Shown in more detail in FIG. 29B) Both cap and rail slide out from the tube housing along the tube rail shelf 42 of the tube housing 40 which mates to the rail channel 77 and rail wings 74. (Shown in more detail in FIGS. 34A and 34B)

The process described in FIG. 27 is the extent and ease of which a technician would need to access the interior of the tube housing to change or modify the LED ribbon 100. Just remove the two tube mounting screws 30, remove end cap A 10 and slide out end cap B 130 with the attached rail 70 from the tube housing 40. If needed the technician could remove rail 70 from end cap B 130, however this is not necessary for intended use. Reinstalling the housing is just a reversal of this process. Further descriptions herein are for the manufacturing process and not intended for the end user. Better detail of the first step of reassembly is shown in (FIG. 34B)

FIG. 28A looks at the mounting mechanism for components of End A. Arrow indicates the mounting path of tube mounting screw 30 into end cap A 10 (tube housing 40 and magnet 90 are not pictured. Aluminum rail 70 is removed from the rail face shelf 11 for illustration purposes). The tube screw passes through the exterior of the tube housing 40 via countersunk mounting hole 43, then through the retention block 50 via the tube screw retention hole 51, through the drilled tube screw hole 72 of side A of the aluminum rail 70, which mates to the end cap on the rail face shelf A 11 of end cap A 10. Tube screw 30 threads into the threaded insert 20 which is friction pressed into the threaded insert hole 12 (shown in FIG. 7A) centered on the rail face shelf A 11. When installed, the screw connects end cap A 10 with rail 70 and tube housing 40. Tube housing 40, when installed, contacts end cap A 10 along its interior edge face 15 and the tube rail shelves 42 mates with corresponding tube shelf retention slots A 13. (Shown in more detail in FIG. 34A)

FIG. 28B looks at the mounting mechanism for components of End B. Arrows indicate the mounting path of tube mounting screw 30 and rail mounting screws 35 into end cap B 130 (tube housing 40 not pictured and aluminum rail 70 is removed from the rail face shelf B 133 for illustration purposes). Tube screw 30 passes through the exterior of the tube housing 40 via countersunk hole 43, through the retention block 50 via the tube screw retention hole 51 then through the tube screw hole 72 in the B side of the aluminum rail 70, which mates to end cap B 130 mating with the rail face shelf 132. The tube screw 30 threads into the threaded insert 21 which is friction pressed into end cap B 130 centered on the rail face shelf 131. Threaded insert 21 is shorter than insert 20 to accommodate space for the contact pin housing slot 135. (Shown in more detail in FIG. 29B) When installed, the tube screw 30 connects end cap B 130 with the aluminum rail 70 and tube housing 40. Rail mount screws 35, pass through the counter sunk rail mount holes 71 of the B side of the aluminum rail 70, to thread into the threaded inserts 20 which are friction pressed into threaded insert holes 134 (shown in FIG. 29B) along the rail face shelf B 133. Tube housing 40, when installed, contacts the interior edge face 140, tube rail shelves 42 mates with corresponding tube shelf retention slots 139 (Shown in more detail in FIG. 29B). During the aluminum rail processing, a section of the aluminum rail wing 74 is cut create the rail screw wing cut 76, to allow access for drilling the rail mount holes 71 on the back side of the rail face 72. This allows access for the rail mount screws 35 to mount the aluminum rail 70 to the end cap B 130. Magnet 90 is shown secured to the rail 70 via barrel bolts 82 which thread into female barrel nuts 80 (shown in more detail in FIG. 32)

FIG. 29A shows an exploded view of components that connect to end cap A 10. Arrows show the motion of travel when installing components. Tube screw retention block 50 is designed to be permanently snapped into end cap A 10 via the receiving slot 60. This operation is shown in more detail in (FIG. 30). Installation of retention block 50 must be done after the threaded insert 20 is friction pressed into the threaded insert hole 12, which is centered in the rail face shelf A 11.

FIG. 29B shows and exploded view of components that insert into end cap B 130. Arrows show the motion of travel when installing components. Tube screw retention block 50 is designed to be permanently snapped into end cap B 130 via the receiving slot 60. This installation must be done after the threaded inserts 20 and 21 are friction pressed into the threaded insert holes 134 along the rail face shelf B 133. Installation of retention block 50 is shown in more detail in (FIG. 30). Premanufactured contact pins 220 are installed through the contact pin holes 142 (shown in more detail in FIG. 31A and FIG. 31B) pin rail 221 mates with the contact pin channel 141 on the rear face of the retention housing receiving slot 135. The pins extend through the pin holes 142 and protrude into the male receptacle 131 side of end cap B 130.

FIG. 30 Shows the permanent locking mechanism of the tube screw retention blocks 50 when pressed into the receiving slot 60 of each end cap. The mechanism is the same for both end caps A 10 and B 130 but is only shown in detail in FIG. 30. Blue arrow shows the motion of travel for the tube screw retention block 50. As stated in FIGS. 29A and B, only after threaded inserts 20 and 21 are press fit into the insert holes 12 and 134 of cap A 10 and B 130 can the tube screw retention block 50, be installed. Each component, the receiving slot 60 and tube screw retention block 50, has alignment rails (52, 62) and channels (53,61) for each other to mate with during the installation. Alignment rails 52 of the tube screw block 50, align with the alignment channels 61 of the receiving slot 60, as well as the alignment rails 62 of the receiving slot 60 in each end cap align with the corresponding alignment channel 53 of the tube screw block 50. Once retention block 50 is placed above the receiving slot 60 and the channels and rails have made contact, downward force is applied to install. The locking tab displacement face 64 contacts the locking tab 54 at the beginning of its travel downwards, the alignment channels and rails retain the retention block 50 laterally and only allows vertical motion. The displacement face 64 is set at an angle from its top face along the alignment channel to the bottom at the locking tab shelf 63. This angle, as the tube retention block 50 is pressed downward, laterally forces the locking tab 54 to recess into its lock tab displacement channel 56 bending the locking tab arm 55. Once the screw retention block 50 reaches the end of its travel downwards resting on the receiving slot base 65, the locking tab pushes beyond the displacement face 64 and the locking tab arm 55, relieved of its lateral force, snaps back to its original orientation mating the locking tab 54 with the lock tab locking shelf 63. Once mated the locking tab 54 prevents any vertical travel, locking the tube screw retention block 50 permanently to the end cap.

FIG. 31A details the components and installation of the contact pin 220 and the contact pin retention housing 210 into the retention housing receiving slot 135 of end cap B 130. Blue arrow denotes travel of components. An expanded view window shows details of the retention housing receiving slot 135 and its components. As stated before, premanufactured contact pins 220 are installed through the contact pin holes 142, the pin rail 221 mates with the contact pin channel 141 on the rear face of the retention housing receiving slot 135. The pins extend through the pin holes 142 and protrude into the male receptacle 131 side of end cap B 130. (Shown in FIG. 31B) The contact pin retention housing 210 mates with the receiving slot 135. Both top and bottom locking tabs 211 of the retention housing 210 contact the locking tab channels 143 of the receiving slot 135. When pressure is applied to the retention housing 210 the angle of the front face of the locking tabs 211 contacting the tab channel 143 causes the tab to recess into the tab displacement channels 212 bending the lock tab arm 215. Once the retention housing 210 is seated against the back face of the receiving slot 135, the locking tabs 211 push beyond the tab channel 143, the tab arm 215 releases its tension returning to its original position. The locking tabs 211 mate with the lock tab shelves 136 permanently mating the retention housing 210 to end cap B 130 via the receiving slot 135. When installed the retention face 213 of the retention housing 210 contacts and retains the pin rail 221 in the pin channel 137 permanently securing the contact pins 220 into end cap B 130. Pin slots 214 in the retention face 213 allow the contact pins to protrude out the rear of the retention housing 210.

FIG. 31B shows both interior face and exterior face of end cap B 130 when all components are installed. Contact pins 220 are retained by the contact pin housing 210. The retention face 213 holds pin rail 221 in the contact pin channel 137. Pin slots 214 between the retention faces 213 allow the contact pins 220 to protrude out of the retention housing 210. Contact pins 220 protrude out of the contact pin holes 142 of the male phoenix receptacle 131.

FIG. 32 is an exploded view of the components which mount to the aluminum rail 70. Arrows show the path of travel of the components to mount to rail 70. High strength neodymium magnets 90 rest on rail 70 between the rail wings 74 and is secured when female threaded barrel nuts 80 are installed through magnet mounting holes 75 on rail 70, flat head barrel bolts 82 thread into the barrel nuts 80 and mate with the countersunk holes 91 in magnet 90. Only one magnet is shown in this figure, however 2-6 magnets will be installed on rail 70 for the various lengths described in description of FIG. 23. After magnets 90 are installed with corresponding barrel nuts 80 and bolts 82, Light Emitting Diode (LED) ribbon 100 can be installed on the rail face 72 and over the flush mounted barrel nut heads 81 via adhesive backing which is standard for most LED ribbon 100 (shown in more detail in Z-FIG. 11A)

FIG. 33A shows rail face 72 of the aluminum rail 70 with end cap B 130 attached. LED ribbon 100 can be seen adhered to the rail face 72 over the barrel nut heads 81 which mount the magnet 90 to the rail 70. Bridge wires 110 (represented by arrows) solder to contact pins 220 and solder to corresponding solder pads 102 of the LED ribbon 100. Diodes 101, when electrified by the bridge wires 110, emit light from the rail face 72 illuminating the tube housing 40 (not shown).

FIG. 33B is a view of A side of the aluminum rail 70 installed into the tube housing 40 with the tube shelf 42 mating with the rail channel 77 and rail wing 74. End cap a 10 and end cap B 130 are removed for illustration purposes. Magnet 90, which is secured to the rail in between the rail wings 74, clears just under the interior face of the tube housing 40 flat spine 41 when installed with rail 70. LED ribbon 100 is shown adhered to the rail face 72 facing downward.

FIG. 33C is the same view as FIG. 33B. However, the curved and connected radial lines diagrams illustrate the angle of light emissions from the tube when LED 100 is illuminated. The properties of the tube housing 40, allows light to pass through while also being diffused in the process. Tube housing 40 and its relation to the aluminum rail 70 creates 240 degrees of illuminated circumference of tube housing 40. This creates a better illusion of a true fluorescent lamp. This is accomplished by the lower surface of the rail being above the height midpoint of said tube housing (in FIG. 33C this is the solid horizontal line passing through the height midpoint of the tube housing). Said another way the lower surface of the rail is above the central circumferential axis. As the tube housing is translucent, this allows for light emitted from said LED ribbon attached to the rail to pass through the translucent housing to illuminate approximately 240 degrees of the housing's circumference.

FIG. 34A is a partial view of all the components on the A side of apparatus 10A showing the connections made when installing end cap A 10. (Please note during actual installation, rail 70 will already be fixed to end cap B 130 via rail mount screws 35 and will not be protruding as shown, this is for illustration purposes) This figure shows the detail of the tube rail shelf 42 mating with the rail channel 77 and the rail wing 74 as well as the tube shelf retention slot 13 of end cap A 10. When the tube housing 40 contacts end cap A 10's interior edge face 140 (shown in FIG. 28A) the tube rail shelf 42 seats with the tube shelf retention slot 13.

FIG. 34 B is a similar view to FIG. 34A but showing the B side of the apparatus 10A connections, detailing the tube rail shelf 42, mated with the rail channel 77 and the rail wing 74. The arrow shows the path of travel for the tube housing 40 to connect with end cap B 130. When tube housing 40 contacts to the interior edge face 140 of end cap B 130 (shown in FIG. 28B) the tube rail shelf 42 mates with the tube shelf retention slot B 138 of end cap 130.

The process described in FIG. 34B is the first step in reassembly by the technician of apparatus 3. The tube housing 40 would seat with the end cap B 130, then the tube mounting screw 30 would be installed via countersunk mounting hole 43 joining all components of side B. The technician would then install end cap A 10 and install the tube mounting screw 30 joining all components of side A.

FIGS. 35 through 43 are dimensions of the apparatus 10A components in their current embodiments. These dimensions are exemplary only and should not be considered exclusive or limiting.

FIG. 35 details the dimensions of end cap A 10.

FIG. 36 details the dimensions of end cap B 130.

FIG. 37 details the dimensions of the tube screw retention block 50.

FIG. 38 details the dimensions of the contact pin retention housing 210.

FIG. 39 details the dimensions of the tube housing 40. Blue line is a measurement reference for the distance between the flat spine 41 and the tube rail shelves 42.

FIG. 40 details the dimensions of the aluminum rail 70 and magnet 90.

FIG. 41 details the dimensions of the contact pins 220.

FIG. 42 details the dimensions of the female phoenix connector 200.

FIG. 43 detail the dimensions of screws (30, 35) inserts (20, 21) barrel nuts 80, and barrel bolt 82.

Advantages and Features

Advantages and features of this system include many.

This system solves a few of the main issues discussed in previous articles of the known prior art while taking certain features and combining them into an easy to use, easy to rig as well as be good looking enough to pass for a real fluorescent tube on camera.

Apparatus 10 and 10A is designed to look like a standard fluorescent tube and intended to be seen on camera with similar size and shape as the real thing. They mount into existing fluorescent fixtures seamlessly.

Magnetic attachments allow the user to click the tube into existing metal housing without the need for installing damaging mounting hardware.

Apparatus 10 and 10A are light weight; a complete configuration can be just over 1 lbs. Whereas most others on the market are much heavier due to onboard batteries.

If an enclosed fixture housing is not metal or magnetic, apparatus 10 and 10A will fit standard rigging hardware used by other products on the market.

Both apparatus 10 and 10A allow for repeatable and customizable control wire connection and removal via the gated port terminals of apparatus 10 or via the industry standard phoenix connection in apparatus 10A Both apparatuses 10 and 10A allow a DMX Control module and power supply to be separated from the apparatus yet connected by control wire. This reduces the chances of failure due to overheating and wireless connectivity issues when enclosed in overhead fixtures compared to prior systems having such elements enclosed in the tube housing. Also, these control systems can be mounted on or near the ground allowing for easy accessibility for trouble shooting versus being mounting in the air.

Apparatuses 10 and 10A are serviceable by the technician or user. Unscrewing the tube mounting screws, removing the endcaps, and removing the rail quickly allows the user to gain access to the LED ribbon inside, for any maintenance or customization needs.

Apparatuses 10 and 10A have a wide degree of illumination at 240 degrees. While prior technology typically only achieves 180 degrees. (See FIG. 33C)

Apparatuses 10 and 10A are customizable allowing multiple manufacturers of LED ribbon to be installed.

Variations

Various modifications and variations can be made in the present invention without departing from the spirit or scope of the invention.

For example, the number of contact pins of apparatus '10A, within the phoenix receptacle, could be altered relative to the remainder of the apparatus, to allow more, or less control wires as demand changes. FIGS. 23-43 show 6 contact pins, one for power and 5 for corresponding colors or channels. Red, Green, Blue, Tungsten, and Daylight are currently standard. However new ribbon colors are invented all the time which could add channels and therefore add contact points. 7 ports could be needing in future embodiments.

Terminal block channels in apparatus 10 vary in the same manner. FIGS. 1-22 only feature 3 channels, where up to 7 channel ports could be included.

Pixel ribbon is another example where only 3-5 contacts are needed. One for power, one for data, and a negative are standard in this configuration, sometimes an additional contact for clock is used or two data contacts for redundancy. This ribbon is also directional, meaning one end cap will be an input with data and power running through the tube and needing an out point, which then will connect to the next tube via its input. This creates the need for both end caps to have a phoenix receptacle, one for input and one being the output. This would allow the tubes to be daisy chained together.

Length variations have been discussed for typical fluorescent tube sizes, however fluorescent desk lamp sizes could be created which would still be covered as variations of the same apparatus.

Variations to tube materials could be made, currently the polycarbonate material is best choice for strength, transparency, and durability. However, should the need arise to change it for better light transmission, longevity etc. doing so should not change the mechanics of the design.

CONCLUSION

Other various modifications and variations can be made in the present invention without departing from the spirit or scope of the invention.

From the foregoing, it will be seen that this invention is one well adapted to obtain all the ends and objects herein set forth, together with other advantages which are obvious, and which are inherent to the method and structure.

It will be understood that certain features and sub combinations are of utility and may be employed without reference to other features and sub combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention claimed is:

1. A film lighting apparatus simulating the appearance of a fluorescent tube and configured to be attached relative to an overhead member having a downwardly facing flat horizontal surface being attracted to a magnet, said lighting apparatus configured for selective electrical connection with an external electrical power supply and with at least one external control module, said lighting apparatus itself comprising:

A) an elongate generally tubular housing, said housing defining an elongate internal cavity and at least one end opening, and having an elongate tubular housing portion being comprised of a surrounding wall surrounding said elongate internal cavity, said surrounding wall having a substantially consistent wall thickness;

B) an elongate internal rail configured to detachably fit within said elongate internal cavity of said tubular housing, said internal rail including an upwardly facing portion and an opposing, downwardly facing portion;

C) at least one light source configured to be attached relative to said downwardly facing portion of said internal rail;

D) at least one magnet including an upwardly facing portion and an opposing, downwardly facing portion, said downwardly facing portion of said magnet configured to be attached relative to said upwardly facing portion of said internal rail;

E) at least one detachable end cap configured to fit within said end opening of said tubular housing, said end cap including internally and externally facing terminal connection ports, said externally facing ports configured for selective electrical connection with said external electrical power supply and at least said one control module; and F) an internal wiring assembly configured to fit within said elongate internal cavity of said tubular housing, said wiring assembly providing electrical connection between said internally facing terminal connection ports of said detachable end cap and said light source, such that an electrical connection is provided between said external power supply and said light source, and such that a connection is provided between said external control module and said light source so as to allow for external control of color or brightness or lighting effects of said lighting source, such that said magnet attracts said overhead member sufficient to cause said film lighting apparatus to be detachably fixed relative to said overhead member.

2. The film lighting apparatus as claimed in claim 1, wherein said magnet is a first magnet, and further comprising a second magnet attached relative to said upwardly facing portion of said internal rail, such that said first and second magnets provide the primary means of connecting said film lighting apparatus to said overhead member.

3. The film lighting apparatus as claimed in claim 1, wherein said externally facing terminal connection ports in said end cap are provided at least in part by a Phoenix connector.

4. The film lighting apparatus as claimed in claim 1, wherein said internal rail is metal, and provides a heat sink for heat generated by said light source.

5. The film lighting apparatus as claimed in claim 1, wherein said detachable end cap is a first detachable end cap, wherein said end opening is a first end opening, and further comprising a second detachable end cap configured to fit within a second end opening of said tubular housing, said second end opening facing opposite to said first end opening.

6. The film lighting apparatus as claimed in claim 1, wherein said internal rail has elongate opposing long sides which fit within corresponding cofacing channels defined by said tubular housing, such that a sliding and guiding action is provided by said cofacing channels to said opposing long sides, such that said internal rail may slide in and out of place during installation and removal, respectively, while being guided by said cofacing channels.

7. The film lighting apparatus as claimed in claim 1, wherein said tubular housing is comprised of a generally tubular plastic having translucent properties through its walls to provide a diffusion of light from said light source when passing therethrough.

8. The film lighting apparatus as claimed in claim 1, wherein said light source is an LED ribbon.

9. The film lighting apparatus as claimed in claim 8, wherein said downwardly facing portion of said rail is above a height midpoint of said tubular housing, and above a central circumferential axis, and wherein said tubular housing is translucent, thus allowing for light emitted from said LED ribbon attached to said rail to pass through said translucent housing to illuminate approximately 240 degrees of said housing's circumference.

10. A film lighting apparatus simulating the appearance of a fluorescent tube and configured to be attached relative to an overhead member having a downwardly facing flat horizontal surface being attracted to a magnet, said lighting apparatus configured for selective electrical connection with an external electrical power supply and with at least one external control module, said lighting apparatus itself comprising:

A) an elongate generally tubular housing, said housing defining an elongate internal cavity and at least one end opening, and having a surrounding wall surrounding said elongate internal cavity, said surrounding wall having a substantially consistent wall thickness, said surrounding wall defining a cylindrical shape with the exception of a flat wall section in its otherwise tubular cylindrical wall shape, said flat section having parallel outer and inner wall surfaces, each of said flat section outer and inner wall surfaces lying in a plane being generally parallel to each other and with said longitudinal axis of said elongate generally tubular housing;

B) an elongate internal rail configured to detachably fit within said elongate internal cavity of said tubular housing, said internal rail including an upwardly facing portion and an opposing, downwardly facing portion;

C) at least one light source configured to be attached relative to said downwardly facing portion of said internal rail;

D) at least one magnet including an upwardly facing portion and an opposing, downwardly facing portion, said downwardly facing portion of said magnet configured to be attached relative to said upwardly facing portion of said internal rail such that said upwardly facing portion of said magnet is in substantial contact with said inner wall surface of said flat wall section of said tubular housing;

E) at least one detachable end cap configured to fit within said end opening of said tubular housing, said end cap including internally and externally facing terminal connection ports, said externally facing ports configured for selective electrical connection with said external electrical power supply and at least said one control module; and F) an internal wiring assembly configured to fit within said elongate internal cavity of said tubular housing, said wiring assembly providing electrical connection between said internally facing terminal connection ports of said detachable end cap and said light source, such that an electrical connection is provided between said external power supply and said light source, and such that a connection is provided between said external control module and said light source so as to allow for external control of color or brightness or lighting effects of said lighting source, such that said magnet attracts said overhead member sufficient to cause said film lighting apparatus to be detachably fixed relative to said overhead member with said magnet urging said flat section of said tubular housing into planar contact with and against said downwardly facing flat horizontal surface of said overhead member.

11. The film lighting apparatus as claimed in claim 10, wherein said magnet is a first magnet, and further comprising a second magnet attached relative to said upwardly facing portion of said internal rail, such that said first and second magnets provide the primary means of connecting said film lighting apparatus to said overhead member.

12. The film lighting apparatus as claimed in claim 10, wherein said externally facing terminal connection ports in said end cap are provided at least in part by a Phoenix connector.

13. The film lighting apparatus as claimed in claim 10, wherein said internal rail is metal, and provides a heat sink for heat generated by said light source.

14. The film lighting apparatus as claimed in claim 10, wherein said detachable end cap is a first detachable end cap, wherein said end opening is a first end opening, and further comprising a second detachable end cap configured to fit within a second end opening of said tubular housing, said second end opening facing opposite to said first end opening.

15. The film lighting apparatus as claimed in claim 10, wherein said internal rail has elongate opposing long sides which fit within corresponding cofacing channels defined by said tubular housing, such that a sliding and guiding action is provided by said cofacing channels to said opposing long sides, such that said internal rail may slide in and out of place during installation and removal, respectively, while being guided by said cofacing channels.

16. The film lighting apparatus as claimed in claim 10, wherein said tubular housing is comprised of a generally tubular plastic having translucent properties through its walls to provide a diffusion of light from said light source when passing therethrough.

17. The film lighting apparatus as claimed in claim 10, wherein said light source is an LED ribbon.

18. The film lighting apparatus as claimed in claim 17, wherein said downwardly facing portion of said rail is above a height midpoint of said tubular housing, and above a central circumferential axis, and wherein said tubular housing is translucent, thus allowing for light emitted from said LED ribbon attached to said rail to pass through said translucent housing to illuminate approximately 240 degrees of said housing's circumference.

19. A method of replacing a light source in a film lighting apparatus simulating the appearance of a fluorescent tube and configured to be attached relative to an overhead member having a downwardly facing flat horizontal surface being attracted to a magnet, said apparatus configured for selective electrical connection with an external electrical power supply and with at least one external control module, said method including the following steps:

A) providing a lighting apparatus itself comprising:

1) An elongate generally tubular housing, said housing defining an elongate internal cavity and at least one end opening, and having a tubular housing portion being comprised of a surrounding wall surrounding said elongate internal cavity, said surrounding wall having a substantially consistent wall thickness;

2) An elongate internal rail configured to detachably fit within said elongate internal cavity of said tubular housing, said internal rail including an upwardly facing portion and an opposing, downwardly facing portion;

3) At least one first light source configured to be attached relative to said downwardly facing portion of said internal rail;

4) At least one magnet including an upwardly facing portion and an opposing, downwardly facing portion, said downwardly facing portion of said magnet configured to be attached relative to said upwardly facing portion of said internal rail;

5) At least one detachable end cap configured to fit within said end opening of said tubular housing, said end cap including internally and externally facing terminal connection ports, said externally facing ports configured for selective electrical connection with said external electrical power supply and at least said one control module; and 6) An internal wiring assembly configured to fit within said elongate internal cavity of said tubular housing, said wiring assembly providing electrical connection between said internally facing terminal connection ports of said detachable end cap and said light source, such that an electrical connection is provided between said external power supply and said light source, and such that a connection is provided between said external control module and said light source so as to allow for external control of color or brightness or lighting effects of said lighting source, such that said magnet attracts said overhead member sufficient to cause said film lighting apparatus to be detachably fixed relative to said overhead member; and B) replacing said first light source by performing the following sub-steps:

1) Detaching said selective electrical connection between said externally facing ports of said end cap and said external electrical power supply and said at least one control module;

2) Removing said end cap from said elongate generally tubular housing;

3) Removing said elongate internal rail by sliding it out of place from within said elongate internal cavity of said tubular housing;

4) Detaching said first light source from said downwardly facing portion of said internal rail;
5) Attaching a second light source to said downwardly facing portion of said internal rail;
6) Replacing said elongate internal rail by sliding it into place from within said elongate internal cavity of said tubular housing;
7) Replacing said end cap on said elongate generally tubular housing; and
8) reattaching said selective electrical connection between said externally facing ports of said end cap and said external electrical power supply and said at least one control module.

20. The method as claimed in claim 19, wherein said light source is an LED ribbon.

* * * * *